US012790821B2

(12) United States Patent
Harvey

(10) Patent No.: US 12,790,821 B2
(45) Date of Patent: Nov. 10, 2026

(54) EXPANDABLE BUILDING SYSTEMS AND RELATED METHODS

(71) Applicant: James F. Harvey, Magnolia, TX (US)

(72) Inventor: James F. Harvey, Magnolia, TX (US)

( * ) Notice: Subject to any disclaimer, the term of this patent is extended or adjusted under 35 U.S.C. 154(b) by 106 days.

(21) Appl. No.: 18/939,027

(22) Filed: Nov. 6, 2024

(65) Prior Publication Data

US 2026/0125900 A1 May 7, 2026

(51) Int. Cl.
*E04B 7/16* (2006.01)
*E04B 1/344* (2006.01)

(52) U.S. Cl.
CPC ..... *E04B 7/163* (2013.01); *E04B 1/344* (2013.01)

(58) Field of Classification Search
CPC ..... E04B 1/3441; E04B 1/3445; E04B 1/344; E04B 7/163
See application file for complete search history.

(56) References Cited

U.S. PATENT DOCUMENTS 1,787,167 A * 12/1930 Purdy ..... E04B 1/2604 16/249
2,461,916 A * 2/1949 Omar ..... E04B 1/3447 52/641
2,541,784 A * 2/1951 Shannon ..... E04B 7/022 D25/13
2,642,825 A * 6/1953 Mcelhone ..... E04B 1/3441 52/641
3,426,495 A * 2/1969 Glasgow ..... E04B 1/3441 52/641
3,485,346 A * 12/1969 Ballard ..... E04B 7/163 52/645
3,557,500 A * 1/1971 Schmidt ..... E04B 1/3441 52/109
3,593,471 A * 7/1971 Fields ..... E04B 1/34838 52/79.5

(Continued)

FOREIGN PATENT DOCUMENTS

| | | |
|---|---|---|
| AU | 2002301966 | 6/2003 |
| CN | 113957813 | 11/2021 |
| GB | 1525144 | 9/1978 |

OTHER PUBLICATIONS

BASE 4, "Build Apartment Walls in a Factory", Datasheet [online], 11 pages, [retrieved on Nov. 14, 2024], Retrieved from the Internet: <URL: https://www.base-4.com/build-apartment-walls-in-a-factory/>.

(Continued)

*Primary Examiner* — Rodney Mintz
(74) *Attorney, Agent, or Firm* — Norton Rose Fulbright US LLP

(57) ABSTRACT

A building assembly can comprise two or more roof trusses, one or more ceiling panels, and two or more walls. Each of the roof trusses can comprise one or more upper chords, a lower chord, and a plurality of braces that each extend between and are coupled to one of the upper chord(s) and the lower chord. A first one of the ceiling panels can be fixed to the lower chord of each of the roof trusses of the building assembly. Each of the walls can be coupled to one of the ceiling panel(s) and can be pivotable between a stowed position in which the wall is substantially parallel to the first ceiling panel and a deployed position in which the wall is substantially perpendicular to the first ceiling panel.

20 Claims, 59 Drawing Sheets

(56) References Cited

U.S. PATENT DOCUMENTS 3,605,355 A * 9/1971 Solesbee ..... E04B 1/3441 52/645
3,646,725 A * 3/1972 Troutner ..... E04C 3/17 52/693
3,712,006 A * 1/1973 Bea ..... E04B 1/3445 52/143
3,729,877 A * 5/1973 Hall ..... B66F 3/22 52/645
3,736,708 A * 6/1973 Chapman ..... E04B 1/3442 52/645
3,760,550 A 9/1973 Mueller et al.
3,785,108 A * 1/1974 Satchell ..... E04C 3/11 52/645
3,823,522 A * 7/1974 Jureit ..... E04B 1/3441 52/645
4,062,167 A * 12/1977 Gilb ..... E04C 3/292 52/693
4,167,090 A 9/1979 Sanford
4,170,852 A * 10/1979 Danis, Jr. ..... E04B 1/3441 52/745.06
RE31,234 E * 5/1983 Jureit ..... E04C 3/005 52/645
4,381,635 A * 5/1983 Solo ..... E04C 3/17 52/639
4,745,724 A * 5/1988 Reetz ..... E04C 3/292 52/645
4,831,807 A * 5/1989 Bolt ..... E04C 3/17 403/53
4,912,891 A * 4/1990 Bertrand ..... E04B 1/3444 52/66
5,094,059 A * 3/1992 Ganescu ..... E04C 3/005 52/645
5,426,822 A * 6/1995 Weir ..... E04B 2/8635 52/645
5,553,961 A * 9/1996 Olden ..... E04C 3/005 403/DIG. 15
5,596,844 A * 1/1997 Kalinowski ..... E04B 1/3442 52/79.5
5,722,210 A * 3/1998 Baker ..... E04C 3/17 52/643
5,778,604 A * 7/1998 Snow ..... E04H 1/1205 52/36.2
5,819,492 A 10/1998 Konicek
5,884,448 A * 3/1999 Pellock ..... E04B 7/022 52/696
5,890,339 A * 4/1999 Willis ..... E04C 3/11 52/645
5,899,042 A * 5/1999 Pellock ..... E04C 3/02 52/696
5,901,522 A 5/1999 Slater
5,950,392 A * 9/1999 Short, V ..... B27F 7/155 52/645
6,401,422 B1 6/2002 Olden
6,430,887 B1 * 8/2002 Daudet ..... E04C 3/005 52/645
6,634,152 B1 10/2003 Pilkinton
6,948,280 B2 * 9/2005 Marcinkowski .... E04B 1/34321 52/79.5
7,131,243 B1 * 11/2006 Sirowatka ..... E04C 3/17 52/645
7,200,972 B1 * 4/2007 Freeman ..... F16B 15/0046 52/712
7,475,514 B2 * 1/2009 Rulquin ..... E04B 1/3445 52/79.5
7,677,009 B2 * 3/2010 Bowman ..... E04C 3/09 52/645
7,963,084 B2 * 6/2011 Merrifield ..... E04C 3/005 52/645
8,122,669 B2 2/2012 Legnini et al.
8,245,479 B2 * 8/2012 Gannon ..... E04C 3/005 52/713
8,800,238 B2 * 8/2014 Davies ..... E04C 3/02 52/646
8,851,096 B2 * 10/2014 De Villenfagne De Sorinnes ..... E04H 15/44 135/122
8,863,446 B2 * 10/2014 Strachan ..... E04B 1/34347 52/79.5
9,062,448 B2 * 6/2015 Richardson ..... E04B 1/1903
9,127,458 B2 * 9/2015 Donnelly ..... E04C 3/11
9,222,250 B2 * 12/2015 Peterson ..... E04B 1/34331
9,266,786 B2 * 2/2016 Kloepper ..... A01G 24/00
9,376,800 B2 * 6/2016 Martyn ..... E04B 1/34384
9,528,579 B2 * 12/2016 Martyn ..... F16H 21/44
9,593,487 B2 * 3/2017 Harvey ..... E04C 2/044
9,784,347 B2 * 10/2017 Martyn ..... F16H 21/04
9,797,487 B2 * 10/2017 Martyn ..... E04F 10/0629
9,909,314 B2 * 3/2018 Jobin ..... E04C 3/08
10,156,073 B2 * 12/2018 Harvey ..... E04C 5/168
10,234,003 B2 * 3/2019 Martyn ..... E04H 3/126
10,253,854 B2 * 4/2019 Martyn ..... F16H 21/04
10,260,211 B2 * 4/2019 Peterson ..... E04B 1/24
10,267,030 B1 * 4/2019 Lepage ..... E04B 1/34838
10,352,415 B2 * 7/2019 Martyn ..... E04B 1/344
10,533,313 B2 * 1/2020 Kochanowski ..... B65D 88/526
11,009,109 B2 * 5/2021 Martyn ..... F16H 21/04
11,041,324 B2 * 6/2021 Carter ..... E04B 1/3447
11,078,995 B2 * 8/2021 Martyn ..... F16H 21/44
11,248,685 B2 * 2/2022 Martyn ..... F16H 21/44
11,536,018 B2 * 12/2022 Peterson ..... E04B 1/3445
11,592,086 B2 * 2/2023 Martyn ..... F16H 21/04
11,713,798 B2 * 8/2023 Martyn ..... F16H 21/44 74/101
11,788,284 B1 * 10/2023 Parham ..... E04C 3/06 52/92.2
11,927,008 B2 * 3/2024 Giacomini ..... E04B 1/345
12,037,782 B2 * 7/2024 Ellenberger ..... E04B 1/3445
12,227,946 B2 * 2/2025 Robles ..... E04C 3/40
2002/0116891 A1 * 8/2002 Waldrop ..... E04B 2/7818 52/843
2002/0116893 A1 * 8/2002 Waldrop ..... E04B 2/7818 52/843
2003/0140573 A1 * 7/2003 Marcinkowski .... E04B 1/34321 52/79.5
2006/0248809 A1 * 11/2006 Rulquin ..... E04B 1/3445 52/79.5
2007/0044415 A1 * 3/2007 Merrifield ..... E04C 3/005 52/633
2007/0151200 A1 * 7/2007 Madray ..... E04C 3/005 52/690
2008/0083189 A1 * 4/2008 Dulac ..... E04B 1/3445 52/79.5
2008/0184651 A1 * 8/2008 Bowman ..... E04B 7/022 52/645
2008/0222989 A1 * 9/2008 Greeff ..... F16B 7/048 403/188
2009/0293408 A1 * 12/2009 Legnini ..... E04C 3/17 52/712
2010/0269445 A1 * 10/2010 Gannon ..... E04C 3/17 52/645
2012/0317898 A1 * 12/2012 Strachan ..... E04B 1/34347 52/79.5
2013/0118110 A1 * 5/2013 Davies ..... E04C 3/02 52/643
2013/0276385 A1 * 10/2013 White ..... B32B 3/26 428/411.1
2014/0076370 A1 * 3/2014 De Villenfagne De Sorinnes ..... E04C 3/005 52/836
2014/0157714 A1 * 6/2014 Richardson ..... E04B 1/1903 52/646
2014/0212203 A1 * 7/2014 Kochanowski ..... B65D 88/522 403/91
2014/0260062 A1 * 9/2014 Donnelly ..... E04C 3/11 52/646
2015/0121776 A1 * 5/2015 Peterson ..... E04B 1/34331 52/79.5

(56) References Cited

U.S. PATENT DOCUMENTS

2015/0122081 A1* 5/2015 Martyn ..... F16H 21/04 74/99 R
2015/0218794 A1* 8/2015 Martyn ..... E04B 1/34384 52/79.5
2016/0069063 A1* 3/2016 Harvey ..... E04C 2/28 52/220.1
2016/0090741 A1* 3/2016 Jobin ..... E04B 1/34326 52/646
2016/0102740 A1* 4/2016 Martyn ..... E04B 1/3441 74/96
2016/0186842 A1* 6/2016 Martyn ..... F16H 21/10 74/99 R
2016/0195174 A1* 7/2016 Martyn ..... F16H 21/04 52/9
2016/0195175 A1* 7/2016 Martyn ..... F16H 21/10 74/99 R
2017/0152659 A1* 6/2017 Harvey ..... E04C 5/06
2017/0233997 A1* 8/2017 Stevenson ..... E04B 1/34384 29/592
2017/0234413 A1* 8/2017 Martyn ..... F16H 21/10 74/99 R
2017/0241523 A1* 8/2017 Martyn ..... E04F 10/04
2017/0284080 A1* 10/2017 Vidal de la Fuente ..... E04B 1/34815
2018/0340310 A1* 11/2018 Peterson ..... E02D 27/50
2019/0360232 A1* 11/2019 Carter ..... E04B 1/3441
2019/0383366 A1* 12/2019 Martyn ..... F16H 21/04
2019/0383367 A1* 12/2019 Martyn ..... F16C 7/02
2019/0383368 A1* 12/2019 Martyn ..... F16H 21/04
2020/0332512 A1* 10/2020 Smith ..... A01G 9/16
2021/0239196 A1* 8/2021 Martyn ..... E04B 1/3441
2021/0285527 A1* 9/2021 Martyn ..... F16H 21/04
2022/0112939 A1* 4/2022 Martyn ..... F16C 29/02
2022/0127840 A1* 4/2022 Giacomini ..... E04B 1/34384
2022/0235549 A1* 7/2022 Robles ..... E04B 1/26
2022/0274519 A1* 9/2022 Mackay ..... B60P 3/34
2022/0364353 A1* 11/2022 Peterson ..... E04B 7/045
2023/0068992 A1* 3/2023 Streeter ..... E04B 1/34321
2023/0167884 A1* 6/2023 Martyn ..... F16H 21/44 74/99 R
2023/0272613 A1* 8/2023 Ellenberger ..... E04B 1/2608 52/645
2024/0229446 A1* 7/2024 Li ..... E04B 1/3444
2026/0022553 A1* 1/2026 Kushner ..... E04B 1/34384
2026/0085544 A1* 3/2026 Norris ..... E04B 1/3445
2026/0125893 A1* 5/2026 Harvey ..... E04B 1/344
2026/0125894 A1* 5/2026 Harvey ..... E04B 1/3441

OTHER PUBLICATIONS

Boxabl Casita, Datasheet [online], 2 pages, [retrieved on Nov. 14, 2024], Retrieved from the Internet: https://www.boxabl.com/casita.
Dogwood Industries, "Olympic Folding Building", Datasheet [online], 11 pages, [retrieved on Nov. 14, 2024], Retrieved from the Internet: <URL: https://www.dogwoodindustries.com/ofb>.
Madi, "We fold innovative houses", Datasheet [online], 10 pages, [retrieved on Nov. 14, 2024], Retrieved from the Internet: <URL: https://madihome.com/>.
Tenfold Engineering, "Welcome to Tenfold Engineering", Datasheet [online], 2 pages, [retrieved on Nov. 14, 2024], Retrieved from the Internet: <URL: https://www.tenfoldengineering.com/>.

* cited by examiner

EXPANDABLE BUILDING SYSTEMS AND RELATED METHODS

FIELD OF INVENTION

The present invention relates generally to expandable building components and building construction methods using such components.

BACKGROUND

Almost all buildings such as homes are constructed by bringing materials to a building site where the materials are measured, cut to size, and assembled. For example, over 96% of homes in the United States are made in this manner with a stick-built wood frame construction. This construction technique grants architects wide latitude in the customization of the building design. However, with the effort needed to bring all of the materials to the building site and to tailor them for the custom building design, it can be expensive to construct the building in this manner. Additionally, this building process can required a significant amount of time to finish the building, often up to 6 months—or longer if there are delays, such as from weather—for a single-family home depending on the level of customization. And there can be a wide variance in the quality of building construction depending on, for example, the skill of the individuals constructing the buildings.

Some buildings are made using modular construction where prefabricated units are manufactured offsite and are transported to the building site where they are assembled. Modular construction can cost less than other conventional construction techniques like stick-built wood frame construction because most of the fabrication is performed in a factory where construction, due to controlled processes, can be more efficient than at the building site. Additionally, the time required to install prefabricated units at the building site can be significantly less than that required to assemble a custom building at the building site.

Modular construction, however, still faces challenges that have hindered widespread adoption thereof. For example, while assembly of prefabricated components at a factory can be more cost-effective than assembly at the building site, transportation of the prefabricated components to the building site can be more expensive that transportation of the components'constituent materials because the constituent materials can be packed at a higher density than prefabricated components. Additionally, regulations regarding the size of loads transported over a road can limit the size of the prefabricated components, including their footprint and rooflines, such that buildings made using a modular construction often have a less-desirable architecture than custom-built buildings.

SUMMARY

There is accordingly a need in the art for building components and building construction techniques that promote affordability and allow for the quick construction of buildings that can have features larger than those of conventional modular constructions. To address this need, the present building systems can include one or more expandable components that can have a compact form for transportation to a building site (e.g., over one or more roads) to allow them to be densely-packed and accordingly mitigate transportation costs, and the expandable component(s) can be expanded at the building site to define one or more features of a building constructed therefrom that can be larger than those defined by prefabricated components in conventional modular construction. The transportability of the expandable component(s) allows them to be constructed off-site (e.g., at a factory) such that they can be produced cost-effectively and with consistent quality, and the expandable component(s), when deployed, can define significant portions of the building such that limited finishing work is required at the building site, which can reduce the amount of time needed to construct the building. In this manner, transporting the expandable component(s) to construct a building can be more cost effective than in conventional modular construction, rendering construction using the same even more cost-effective—and faster—than conventional custom-built techniques. And with their expandability allowing them to define relatively large portions of the building, the expandable component(s) can be used to make a building having an architecture that is more desirable than conventional modular constructions.

One expandable component that can be used in some of the present building systems is an expandable roof truss, which can comprise a lower chord and one or two upper chords. With two upper chords, each of the upper chords can have a first end and a second end that overlies the lower chord and is pivotably coupled to the second end of the other of the upper chords. Furthermore, the roof truss can comprise a plurality of braces that include two or more pivotable braces that each have a first end pivotably coupled to the lower chord and a second end pivotably coupled to one of the upper chords, where at least two of the pivotable braces include extendible braces that are each extendible from a shortened state to an extended state. With such a configuration, the roof truss can be movable between a collapsed state and an expanded state in which the second end of each of the upper chords is disposed further from the lower chord than when the roof truss is in the collapsed state. In particular, to accommodate the expansion, each of the pivotable braces can pivot relative to the lower chord and relative to the upper chord to which it is pivotably coupled when the roof truss moves between the collapsed and expanded states, and each of the extendible braces can be extended from the shortened state to the extended state when the roof truss moves from the collapsed state to the expanded state. As such, the roof truss can have a short profile when in the collapsed state to facilitate its transportability, and can have a large height when moved to the expanded state such that the roof truss can be used to define a roof pitch that is higher than that achievable with conventional modular construction. In some embodiments, a plurality of such roof trusses can be part of a roof assembly including at least two roof panels—which can comprise a roofing material—coupled to the upper chords of the roof trusses, which can likewise be transported to a building site when the roof trusses are in the collapsed state and expanded at the building site by moving its roof trusses to the expanded state.

Another expandable component that can be used in some of the present building systems is an expandable wall assembly. The wall assembly can comprise a plurality of wall segments that can include at least two, optionally at least three, pivotable wall segments that are each pivotably coupled to at least one other of the wall segments such that the wall assembly is movable between folded and unfolded states. In the folded state, at least two of the wall segments can extend in a widthwise direction and at least four of the wall segments that include the pivotable wall segments can each extend in a lengthwise direction that is substantially perpendicular to the widthwise direction. The pivotable wall segments can be pivoted to bring the wall assembly to the unfolded state in which at least four of the wall segments that include at least two of the pivotable wall segments extend in the widthwise direction and at least two of the wall segments, which can optionally include at least one of the pivotable wall segments, extend in the lengthwise direction. With such unfoldability where each of the pivotable wall segments extends in the lengthwise direction when the wall assembly is in the folded state and at least some of the pivotable wall segments are pivoted to extend in the widthwise direction when the wall assembly is in the unfolded state, the wall assembly can have a relatively compact width when in the folded state for transport, which can be increased by moving the wall assembly to the unfolded state at the building site to yield a building footprint that is larger than that of conventional modular construction. Furthermore, when in the folded state, the wall assembly can have an interior volume circumscribed by the wall segments such that the wall assembly can function as a container where one or more other building components can be disposed in the interior during transportation, which can promote the density of material packing and accordingly reduce shipping costs.

One other expandable component that can be used in some of the present building systems is an expandable building assembly. The building assembly can comprise two or more roof trusses—which can, but need not, be some of the above-described expandable roof trusses—that each comprise one or more upper chords, a lower chord, and a plurality of braces that each extend between and are coupled to one of the upper chord(s) and the lower chord. Additionally, the building assembly can comprise one or more ceiling panels, a first one of which can be fixed to the lower chord of each of the roof trusses of the building assembly. The building assembly can be vertically expandable via two or more walls thereof, which can each be coupled to one of the ceiling panel(s) can be pivotable between a stowed position in which the wall is substantially parallel to the first ceiling panel and a deployed position in which the wall is substantially perpendicular to the first ceiling panel. In this manner, the building assembly can have a relatively compact height when each of its walls is in the stowed position for transportation, and can be quickly expanded to a height suitable for a building by pivoting each of its walls to the deployed position at the building site.

Some of the present roof trusses comprise a lower chord and two upper chords, and some of the present methods of constructing a building site comprise transporting, over one or more roads, a plurality of roof trusses to the building site that each comprise a lower chord and two upper chords. In some embodiments, each of the upper chords has a first end and a second end that is pivotably coupled to the second end of the other of the upper chords. The second end of each of the upper chords, in some embodiments, overlies the lower chord. The braces, in some embodiments, include two or more pivotable braces that each have a first end pivotably coupled to the lower chord and a second end pivotably coupled to one of the upper chords. In some embodiments, the pivotable braces include at least two extendible braces that are each extendible from a shortened state to an extended state, wherein a length of the extendible brace is longer when in the extended state than when in the shortened state. Each of the upper chords, in some embodiments, is pivotably coupled to the second end of at least one of the pivotable braces. In some embodiments, the roof truss is movable between a collapsed state in which each of the extendible braces is in the shortened state and an expanded state in which each of the extendible braces is in the extended state. In some methods, each of the roof trusses is in the collapsed state during the transporting.

In some embodiments, the second end of each of the upper chords is disposed further from the lower chord when the roof truss is in the expanded state than when the roof truss is in the collapsed state. Each of the pivotable braces, in some embodiments pivots relative to the lower chord and relative to the upper chord to which the second end of the pivotable brace is pivotably coupled when the roof truss moves between the collapsed state and the expanded state. Some methods comprise, for each of the roof trusses, at the building site and while the roof truss is fixed to at least one wall, moving the roof truss from the collapsed state to the expanded state such that the second end of each of the upper chords moves upwardly away from the lower chord and each of the pivotable braces pivots relative to the lower chord and relative to the upper chord to which the second end of the pivotable brace is pivotably coupled. Some methods comprise, for each of the roof trusses, at the building site and while the roof truss is fixed to at least one wall, fixing the length of each of the extendible braces when the roof truss is in the expanded state such that the extendible brace is not compressible to the shortened state.

In some embodiments, each of the upper chords is extendible from a shortened state to an extended state. A length of the upper chord, in some of such embodiments, is longer when in the extended state than when in the shortened state. In some embodiments, when the roof truss is in the collapsed state and the upper chord is in the shortened state, the first end of the upper chord overlies the lower chord. In some methods, during the transporting, each of the upper chords of the roof truss is in the shortened state. Some methods comprise, at the building site, extending each of the upper chords from the shortened state to the extended state and fixing the length of each of the upper chords when the upper chord is in the extended state such that the upper chord is not compressible to the shortened state.

In some embodiments, when the roof truss is in the collapsed state, for each of the pivotable braces a first portion of the pivotable brace is disposed in a channel of one of the upper chords; and a second portion of the pivotable brace is disposed in a channel of the lower chord. In some embodiments, each of the pivotable braces is substantially parallel to the lower chord and one of the upper chords.

In some embodiments, a height of the roof truss, measured between the lower chord and the second ends of the upper chords, when the roof truss is in the expanded state is at least 7 times the height of the roof truss when the roof truss is in the collapsed state, is at least 25% of a length of the lower chord, and/or is greater than 10 feet. In some embodiments, a length of the lower chord is between 30 and 53 feet.

In some embodiments, one or more roof assemblies each include at least two of the roof trusses. Some of such roof assemblies each include two roof panels, each coupled to and overlying a respective one of the upper chords of each of the roof trusses of the roof assembly. Each of the roof panels of the roof assembly, in some embodiments, comprises a plurality of shingles, a plurality of tiles, or one or more metal sheets. Some roof assemblies comprise a ceiling panel coupled to and underlying the lower chord of each of the roof trusses of the roof assembly. In some methods, transporting the roof trusses of the roof assembly comprises transporting, over the road(s), the roof assembly to the building site.

Some of the present wall assemblies comprise six or more wall segments, and some of the present methods comprise transporting, over one or more roads, one or more wall assemblies to the building site, wherein each of the one or more wall assemblies comprises six or more wall segments. The wall segments, in some embodiments, include at least two, optionally at least three, pivotable wall segments that are each pivotably coupled to at least one other of the wall segments such that the wall assembly is movable between a folded state and an unfolded state. In some embodiments, in the folded state at least two of the wall segments extend in a widthwise direction, at least four of the wall segments that include the pivotable wall segments extend in a lengthwise direction that is substantially perpendicular to the widthwise direction, and the wall assembly has an interior volume circumscribed by the wall segments. In some embodiments, in the unfolded state at least four of the wall segments that include at least two of the pivotable wall segments extend in the widthwise direction, at least two of the wall segments that optionally include at least one of the pivotable wall segments extend in the lengthwise direction, and the wall assembly has an interior volume circumscribed by four walls that are defined by at least six of the wall segments that include the pivotable wall segments. In some embodiments, a width of the wall assembly, measured in the widthwise direction, is larger when the wall assembly is in the unfolded state than when the wall assembly is in the folded state. In some embodiments, a length of the wall assembly, measured in the lengthwise direction, when the wall assembly is in the unfolded state is approximately the same as the length of the wall assembly when the wall assembly is in the folded state. The length of the wall assembly when the wall assembly is in the folded state, in some embodiments, is between 30 and 53 feet. In some methods, each of the one or more wall assemblies is in the folded state when the wall assembly is transported to the building site. In some methods, each of the one or more wall assemblies is transported to the building site on a trailer. Some methods comprise, for each of the one or more wall assemblies, pivoting each of the pivotable wall segments at the building site such that the wall assembly moves from the folded state to the unfolded state. Some methods that comprise transporting a plurality of roof trusses to the building site further comprise fixing the roof truss to at least one of the walls of one of the one or more wall assemblies that are in the unfolded state at the building site.

In some embodiments, the wall segments of the wall assembly include first and second fixed wall segments that each extend in the widthwise direction between first and second ends when the wall assembly is in the folded state and when the wall assembly is in the unfolded state. In some of such embodiments, when the wall assembly is in the folded state, the interior volume of the wall assembly is disposed between the first and second fixed wall segments. In some embodiments, a length of each of the first and second fixed wall segments, measured in the widthwise direction, is less than or equal to 40% of the length of the wall assembly when the wall assembly is in the folded state and/or is less than or equal to 102 inches. In some embodiments, the pivotable wall segments include one or more sets of the pivotable wall segments, each of the set(s) including first and second pivotable wall segments that each extend between first and second ends. The first end of the first pivotable wall segment, in some embodiments, is pivotably coupled to one of the ends of the first fixed wall segments. The first end of the second pivotable wall segment, in some embodiments, is pivotably coupled to one of the ends of the second fixed wall segment. In some embodiments, when the wall assembly is in the unfolded state, the first and second pivotable wall segments each extend in the widthwise direction. In some embodiments, for at least one of the set(s) of pivotable wall segments, the first and second pivotable wall segments each have a length that is approximately the same as the length of the wall assembly when the wall assembly is in the folded state. In some embodiments, for at least one of the set(s) of the pivotable wall segments, the length of the first pivotable wall segment and the length of the second pivotable wall segment are together approximately the same as the length of the wall assembly when the wall assembly is in the folded state.

The one or more sets of the pivotable wall segments, in some embodiments, include first and second sets of the pivotable wall segments. In some of such embodiments, for the first set of the pivotable wall segments, the first end of the first pivotable wall segment is pivotably coupled to the first end of the first fixed wall segment, the first end of the second pivotable wall segment is pivotably coupled to the first end of the second fixed wall segment, and the first and second pivotable wall segments each have a length that is approximately the same as the length of the wall assembly when the wall assembly is in the folded state. In some embodiments, for the second set of the pivotable wall segments, the first end of the first pivotable wall segment is pivotably coupled to the second end of the first fixed wall segment, the first end of the second pivotable wall segment is pivotably coupled to the second end of the second fixed wall segment, and the length of the first pivotable wall segment and the length of the second pivotable wall segment are together approximately the same as the length of the wall assembly when the wall assembly is in the folded state.

Some methods comprise, for each of the one or more wall assemblies, for at least one of the set(s) of pivotable wall segments, after pivoting the first and second pivotable wall segments, moving a movable one of the wall segments relative to the first and second pivotable wall segments such that the movable wall segment extends between the second end of the first pivotable wall segment and the second end of the second pivotable wall segment. Some of such methods further comprise fixing the movable wall segment to the second end of the first pivotable wall segment and the second end of the second pivotable wall segment. In some methods, for each of the one or more wall assemblies, for at least one of the set(s) of the pivotable wall segments the set of pivotable wall segments includes a third pivotable wall segment that extends between first and second ends, wherein the first end of the third pivotable wall segment is pivotably coupled to the second end of the first pivotable wall segment, wherein when the wall assembly is in the unfolded state, the third pivotable wall segment extends in the lengthwise direction. Some of such methods comprise fixing the second end of the third pivotable wall segment to the second end of the second pivotable wall segment after pivoting the first, second, and third pivotable wall segments.

In some embodiments, at least one of the wall segments includes one or more windows and/or one or more doors. In some embodiments, each of the wall segments comprises a plurality of vertically-extending studs and a plurality of horizontally-extending supports coupled to the studs, one or more drywall panels coupled to a first side of the studs, and exterior siding coupled to a second side of the studs. The studs and supports, in some embodiments, each comprise steel.

In some methods, for at least one of the one or more wall assemblies, one or more prefabricated walls and/or one or more floor assemblies are disposed in the interior volume of the wall assembly while the wall assembly is in the folded state and is transported to the building site. In some of such methods, each of the prefabricated wall(s) comprises a plurality of vertically-extending studs and a plurality of horizontally-extending supports coupled to the studs, wherein the studs and supports each optionally comprise steel, and one or more drywall panels coupled to a first side of the studs. In some embodiments, each of the one or more floor assemblies comprises a frame defining a periphery of the floor assembly, the frame optionally comprising steel. In some of such embodiments, the floor assembly comprises a plurality of joists that each extend between opposing edges of the frame, each of the joists optionally comprising wood, and optionally one or more wood panels coupled to the joists and the frame.

Some of the present building assemblies comprise two or more roof trusses, one or more ceiling panels, and two or more walls, and some of the present methods comprise transporting, over one or more roads, one or more building assemblies to the building site, each of the one or more building assemblies comprising two or more roof trusses, one or more ceiling panels, and two or more walls. In some embodiments, each of the roof trusses comprises one or more upper chords, a lower chord, and a plurality of braces that each extend between and are coupled to one of the upper chord(s) and the lower chord. A first one of the ceiling panels, in some embodiments, is fixed to the lower chord of each of the roof trusses of the building assembly. In some embodiments, each of the walls is coupled to one of the ceiling panel(s) and is pivotable between a stowed position in which the wall is substantially parallel to the first ceiling panel and a deployed position in which the wall is substantially perpendicular to the first ceiling panel. In some methods, the building assembly is transported to the building site while each of the walls of the building assembly is in the stowed position. Some methods comprise, for each of the one or more building assemblies, pivoting each of the walls of the building assembly from the stowed position to the deployed position at the building site.

In some embodiments, each of the roof trusses of the building assembly is one of the above-described roof trusses that is movable between a collapsed state and an expanded state. In some of such methods, transporting the roof trusses of the building assembly comprises transporting, over the road(s), the building assembly to the building site while each of the walls is in the stowed position. Some of such methods comprise, for each of the roof trusses of the building assembly, at the building site and after pivoting each of the walls of the building assembly, moving the roof truss from the collapsed state to the expanded state and fixing the length of each of the extendible braces when the roof truss is in the expanded state such that the extendible brace is not compressible to the shortened state.

In some embodiments, the one or more ceiling panels of the building assembly comprise two or more ceiling panels that include at least one slidable ceiling panel, optionally two or more slidable ceiling panels. In some of such embodiments, when the walls are each in the deployed position, each of the slidable ceiling panel(s) is configured to slide vertically along two of the walls between which the slidable ceiling panel extends. Some methods comprise, after pivoting each of the walls of the building assembly from the stowed position to the deployed position, sliding each of the slidable ceiling panel(s) vertically along two of the walls and, after sliding each of the slidable ceiling panel(s), fixing the slidable ceiling panel(s) relative to the walls.

In some embodiments, each of the walls of the building assembly overlies the roof trusses and the ceiling panels when the wall is in the stowed position. In some of such embodiments, when the walls are each in the deployed position, each of the roof trusses is configured to slide vertically along two of the walls between which the roof truss extends. In some methods, sliding each of the slidable ceiling panel(s) comprises lifting each of the slidable ceiling panel(s). Some methods comprise sliding each of the roof trusses upwardly along two of the walls between which the roof truss extends and, after sliding each of the roof trusses, fixing the roof trusses relative to the walls.

In some embodiments, the one or more ceiling panels of the building assembly comprise two or more ceiling panels and the two or more walls comprise four or more walls that include two or more pairs of the walls. For some of such embodiments, for at least one of the pairs of the walls, each of the walls of the pair has a first end pivotably coupled to one of the ceiling panels that overlies the wall when the wall is in the stowed position and a second end slidably coupled to one of the ceiling panels that underlies the wall when the wall is in the stowed position. In some methods, for at least one of the pairs of the walls, for reach of the walls of the pair, pivoting the wall comprises lifting the ceiling panel that overlies the wall when the wall is in the stowed position such that the second end of the wall slides along the ceiling panel that underlies the wall when the wall is in the stowed position.

In some embodiments, each of the walls of the building assembly has a length that is approximately the same as a length of the building assembly when the walls are each in the stowed position. A length of the building assembly, in some embodiments, is between 30 and 53 feet when the walls are each in the stowed position. In some embodiments, a width of the building assembly, measured in a direction perpendicular to the length of the building assembly, is between 7 and 16 feet when the walls are each in the stowed position.

Each of the walls of the building assembly, in some embodiments, comprises a plurality of vertically-extending studs and a plurality of horizontally-extending supports coupled to the studs, wherein the studs and supports each optionally comprise steel. In some embodiments, each of the walls of the building assemblies comprise one or more drywall panels coupled to a first side of the studs and/or exterior siding coupled to a second side of the studs.

In some methods, the building site includes a slab. Some of such methods comprise, for each of the one or more building assemblies, fixing at least two of the walls of the building assembly to the slab. The slab, in some methods, comprises concrete.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified—and includes what is specified; e.g., substantially 90 degrees includes 90 degrees and substantially parallel includes parallel—as understood by a person of ordinary skill in the art. As used herein, "substantially parallel" means within 10 degrees of parallel to, and "substantially perpendicular" means within 10 degrees of perpendicular to. In any disclosed embodiment, the terms "approximately" and "about" may each be substituted with "within [a percentage] of" what is specified, where the percentage includes 0.1, 1, 5, and 10 percent.

The terms "comprise" and any form thereof such as "comprises" and "comprising," "have" and any form thereof such as "has" and "having," and "include" and any form thereof such as "includes" and "including" are open-ended linking verbs. As a result, an apparatus or system that "comprises," "has," or "includes" one or more elements possesses those one or more elements but is not limited to possessing only those elements. Likewise, a method that "comprises," "has," or "includes" one or more steps possesses those one or more steps but is not limited to possessing only those one or more steps.

Any embodiment of any of the apparatuses, systems, and methods can consist of or consist essentially of—rather than comprise/have/include—any of the described steps, elements, and/or features. Thus, in any of the claims, the term "consisting of" or "consisting essentially of" can be substituted for any of the open-ended linking verbs recited above in order to change the scope of a given claim from what it would otherwise be using the open-ended linking verb.

Further, an apparatus or system that is configured in a certain way is configured in at least that way, but it can also be configured in other ways than those specifically described.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

In FIGS. 6A and 6B, the roof assembly's roof trusses are each in the collapsed state.

In FIG. 10A, the wall assembly is in the folded state.

In FIG. 11A, the wall assembly is in the folded state.

In FIG. 12A, the wall assembly is in the folded state.

In FIGS. 21A-21C, the walls are in the stowed position and the roof trusses are in the collapsed state.

In FIG. 23A, the walls are in the stowed position and the roof trusses are in the collapsed state.

In FIG. 24A, the walls are in the stowed position and the roof trusses are in the collapsed state.

In FIG. 25A, the walls are in the stowed position and the roof trusses are in the collapsed state.

In FIG. 26A, the walls are in the stowed position and the roof trusses are in the collapsed state.

In FIGS. 32B and 32C, the wall assembly is positioned on the slab while in the folded state.

DETAILED DESCRIPTION

Embodiments of the present building systems can comprise one or more components—including one or more roof trusses (e.g., 10*a*-10*e*), one or more roof assemblies (e.g., 82*a*-82*b*), one or more wall assemblies (e.g., 134*a*-134*c*), and/or one or more building assemblies (e.g., 294*a*-294*f*)—that can have a compact form for transport to a building site and can be expanded such that a building can be readily constructed at the building site using the component(s).

Figure 1A:
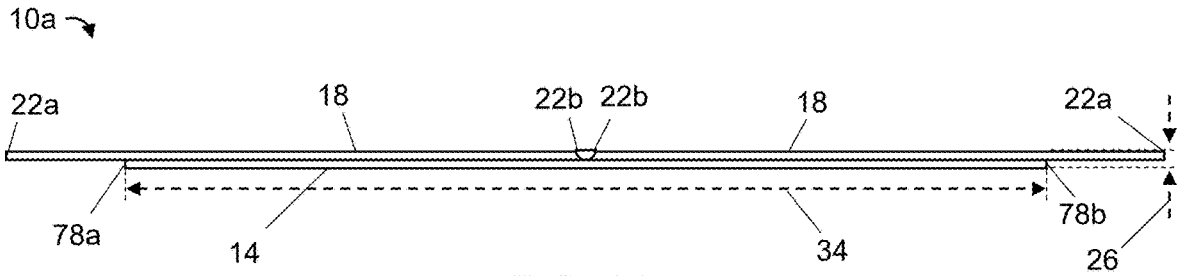
FIG. 1A is a front view of a first embodiment of the present roof trusses while the roof truss is in a collapsed state. The roof truss includes two upper chords, a lower chord, and a plurality of braces that are each coupled to the lower chord and one of the upper chords. In the collapsed state, the braces of the roof truss are nested within the upper and lower chords.
Figure 1B:
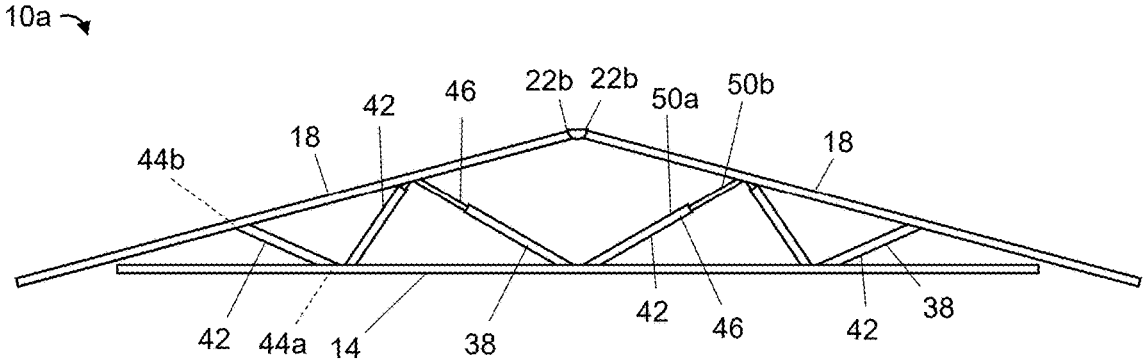
FIG. 1B is a front view of the roof truss of FIG. 1A while being moved to the expanded state.
Figure 1C:
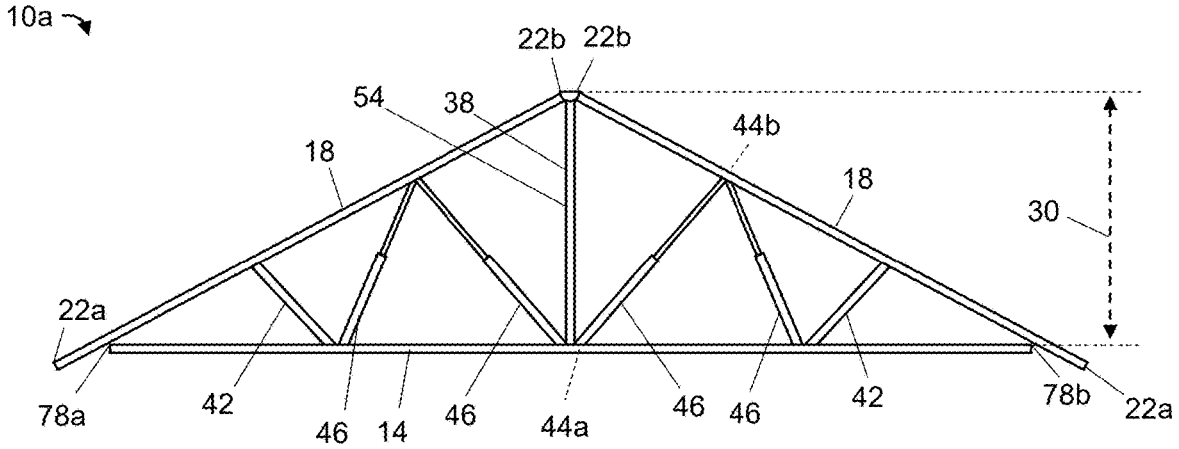
FIG. 1C is a front view of the roof truss of FIG. 1A in the expanded state.

Referring to FIGS. 1A-1C, shown is a first embodiment 10*a* of the present expandable roof trusses that can be used in the construction of a roof of a building. Roof truss 10*a* can comprise a lower chord 14, two upper chords 18, and braces 38 that can be coupled in a manner that allows the roof truss to be movable between a collapsed state (FIG. 1A) and an expanded state (FIG. 1C). In particular, each of upper chords 18 can have a first end 22*a* and a second end 22*b* that overlies lower chord 14 and is pivotably coupled to the second end of the other of the upper chords. Accordingly, as illustrated in FIGS. 1A-1C—which show roof truss 10*a* moved from the collapsed state (FIG. 1A) to an intermediate state between the collapsed and expanded states (FIG. 1B) and finally to the expanded state (FIG. 1C)—this coupling allows upper chords 18 to pivot at their second ends 22*b* as the second end of each of the upper chords is drawn upward away from lower chord 14 such that the second end is disposed further from the lower chord when the roof truss is in the expanded state (FIG. 1C) than when the roof truss is in the collapsed state (FIG. 1A). To facilitate movement of upper chords 18 relative to lower chord 14 in a manner that yields a desired roof pitch and to couple the upper chords to the lower chord, braces 38 can include two or more pivotable braces 42 that each have a first end 44*a* pivotably coupled to lower chord 14 and a second end 44*b* pivotably coupled to one of upper chords 18, where each of the upper chords is pivotably coupled to the second end of at least one of the pivotable braces. Pivotable braces 42 can accommodate a change in roof truss 10*a*'s geometry when the roof truss moves between the collapsed (FIG. 1A) and expanded (FIG. 1C) states by each pivoting relative to lower chord 14 and relative to upper chord 18 to which second end 22*b* of the pivotable brace is pivotably coupled when the roof truss moves between the collapsed and expanded states. Additionally, pivotable braces 42 can include at least two extendible braces 46 (e.g., with each upper chord 18 pivotably coupled to at least one of the extendible braces) that are each extendible from a shortened state to an extended state in which a length of the extendible brace is longer than when in the shortened state. For example, each of extendible braces 46 can comprise a first segment 50*a* that includes the extendible brace's first end 44*a* and a second segment 50*b* that includes the extendible brace's second end 44*b* and is configured to slide linearly relative to the first segment, such as with the first segment being a tube (which can have, for example, a square, rectangular, C-shaped, or circular cross-section) within which the second segment can slide. Extendible braces 46 can each be in the shortened state when roof truss 10*a* is in the collapsed state and in the extended state when the roof truss is in the expanded state to accommodate the increased separation between lower chord 14 and upper chords 18 when the upper chords'second ends 22*b* are moved upward away from the lower chord. When roof truss 10*a* is in the expanded state, a length of each of extendible braces 46 can be fixed (e.g., by fixing its second segment 50*b* relative to its first segment 50*a* with a fastener such as a pin) and/or a fixed brace 54 (e.g., whose length is fixed) can extend between and be coupled to lower chord 14 and second ends 22*b* of upper chords 18 to keep the roof truss in the expanded state.

With this configuration, a height 30 of roof truss 10*a*, measured between lower chord 14 and second ends 22*b* of upper chords 18, when the roof truss is in the expanded state (FIG. 1C) can be significantly larger than a height 26 of the roof truss when the roof truss is in the collapsed state (FIG. 1A) such that the roof truss can be easily transported when in the collapsed state and quickly expanded to the expanded state at a building site to achieve a desired roof pitch. For example, roof truss 10*a*'s height 30 in the expanded state can be greater than or equal to any one of, or between any two of, 7, 8, 9, 10, 11, 12, 13, 14, 15, 16, 17, or 18 times (e.g., at least 12 times) the roof truss's height 26 in the collapsed state, such as with a height 30 in the expanded state that is greater than or equal to any one of, or between any two of, 5, 6, 7, 8, 9, 10, 11, 12, or 13 feet (e.g., at least 8 feet or at least 10 feet) and a height 26 in the collapsed state that is less than or equal to any one of, or between any two of, 1.5, 1.4, 1.3, 1.2, 1.1, 1.0, 0.9, 0.8, or 0.7 feet (e.g., less than or equal to 0.9 feet). And with such expandability, a pitch of upper chords 18 relative to lower chord 14 can significantly increase as well, such as with roof truss 10*a*'s height 30 when in the expanded state being greater than or equal to any one of, or between any two of, 10%, 11%, 12%, 13%, 14%, 15%, 16%, 17%, 18%, 19%, 20%, 21%, 22%, 23%, 24%, 25%, 30%, 35%, 40%, 45%, or 50% of a length 34 of the lower chord that can be, for example, greater than or equal to any one of, or between any two of, 20, 25, 30, 35, 40, 45, 50, 55, 60, 65, 70, 75, or 80 feet (e.g., between 30 and 53 feet or about 40 feet) to allow transportation using, for example, a truck as described below.

Figure 2A:
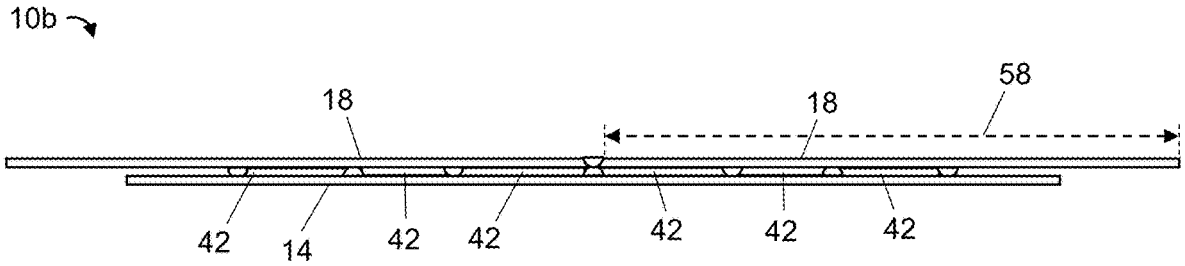
FIGS. 2A-2C are front views of a second embodiment of the present roof trusses in the collapsed state, while being moved to the expanded state, and in the expanded state, respectively, where the roof truss of FIGS. 2A-2C is substantially the same as the roof truss of FIGS. 1A-1C except that its braces are not nested within the lower chord when the roof truss is in the collapsed state.
Figure 2B:
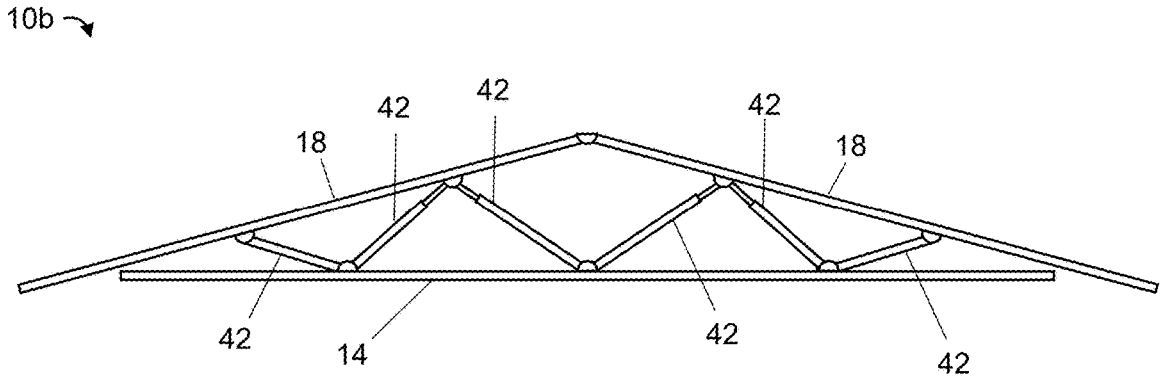
Figure 2C:
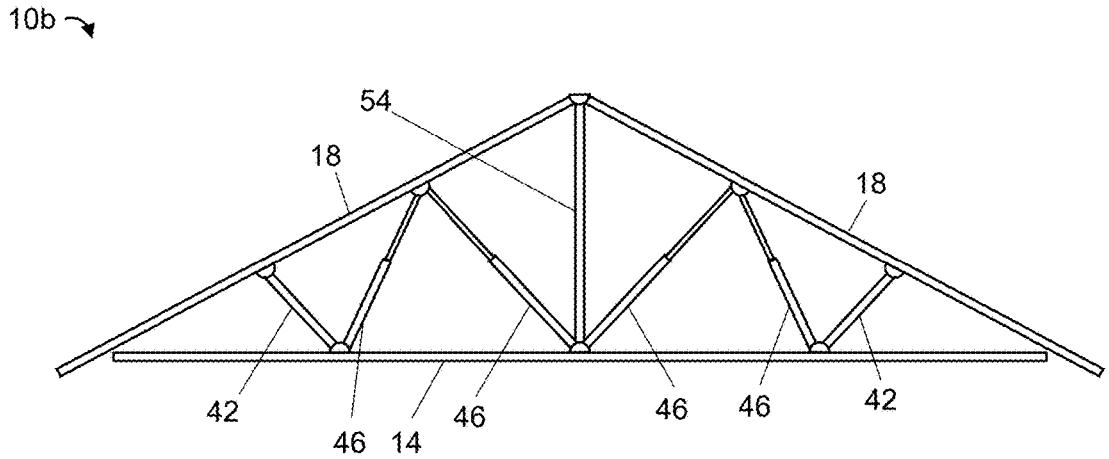

Preferably, when roof truss 10*a* is in the collapsed state, lower chord 14, upper chords 18, and pivotable braces 42 are substantially parallel to promote compactness and transportability. In the embodiment shown, each of pivotable braces 42 can be nested in one of upper chords 18 and lower chord 14 (e.g., a first portion of the pivotable brace can be received in a channel of the upper chord and a second portion of the pivotable brace can be received in a channel of the lower chord) when roof truss 10*a* is in the collapsed state, which can further promote the compactness of the roof truss for transportation. And, in some embodiments, upper chords 18 and pivotable braces 42 can each be nested in lower chord 14 to further promote compactness. However, in other embodiments pivotable braces 42 need not be nested, either with the pivotable braces coupled to a front or a rear exterior surface of one of upper chords 18 and lower chord 14 or, as illustrated in FIGS. 2A-2C that show a second embodiment 10*b* of the present roof trusses that is otherwise the same as roof truss 10*a*, between the upper and lower chords.

Because lifting second ends 22*b* of upper chords 18 to increase the upper chords' pitch relative to lower chord 14 can cause the upper chords' first ends to move inward toward one another, to maintain an appropriate roof truss geometry in which the upper chords overlie the entirety of the lower chord when the roof truss is in the expanded state, when the roof truss is in the collapsed state each of the upper chords—when having a fixed length—can extend past one of opposing ends 78*a* and 78*b* of the lower chord such that the upper chord's first end does not overlie to the lower chord. This can help ensure that a distance between first ends 22*a* of upper chords 18 when roof truss 10*a* is in the expanded state is still greater than or equal to length 34 of lower chord 14—and thus that the upper chords overlie the entirety of the lower chord—even though movement from the collapsed state to the expanded state causes that distance to decrease.

Figure 3A:
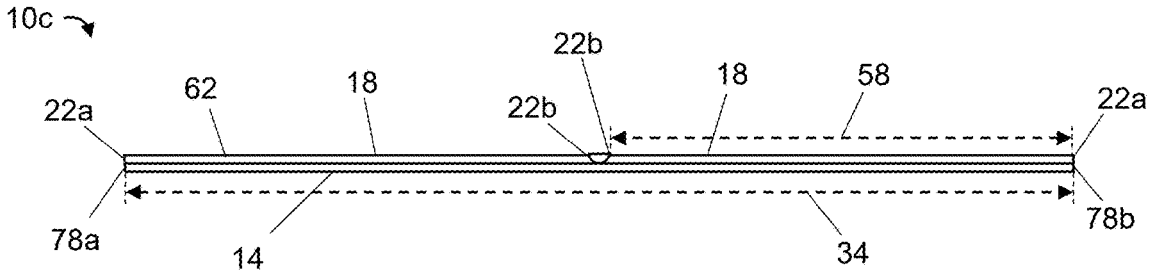
FIGS. 3A-3C are front views of a third embodiment of the present roof trusses in the collapsed state, while being moved to the expanded state, and in the expanded state, respectively, where the roof truss of FIGS. 3A-3C is substantially the same as the roof truss of FIGS. 1A-1C except that its upper chords are each extendible from a shortened state (FIG. 3A) to an extended state (FIG. 3C) by sliding a secondary segment of the upper chord relative to a primary segment of the upper chord.
Figure 3B:
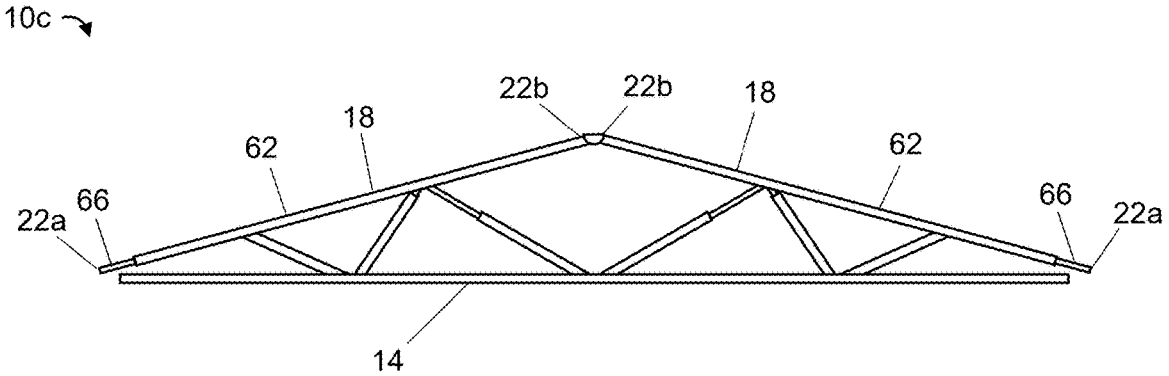
Figure 3C:
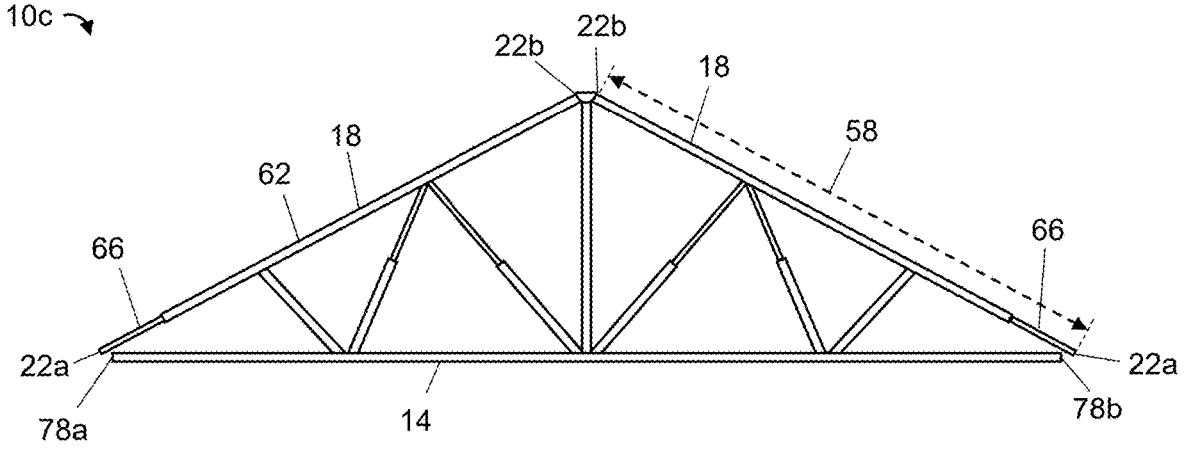

However, referring to FIGS. 3A-3C—which show a third embodiment 10*c* of the present roof trusses that is substantially the same as roof truss 10*a*—in other embodiments each of upper chords 18 need not extend past one of the opposing ends 78*a* and 78*b* of lower chord 14 when the roof truss is in the collapsed state (FIG. 3A), allowing the upper chord's first end 22*a* to overlie the lower chord. With no portion of upper chords 18 extending past the ends of lower chord 14, a length of roof truss 10*c* when in the collapsed state can be approximately the same as the lower chord's length 34, which can promote the roof truss's transportability. To still allow the distance between first ends 22*a* of upper chords 18 to be greater than or equal to lower chord 14's length 34 when roof truss 10*c* is in the expanded state despite the expansion's tendency to cause the first ends to move inward toward one another, each of upper chords 18 can be extendible from a shortened state (FIG. 3A) to an extended state (FIG. 3C), where a length 58 of the upper chord is longer when in the extended state than when in the shortened state. For example, length 58 of each of upper chords 18 can be approximately half of length 34 of lower chord 14 when the upper chord is in the shortened state, and can be at least 5%, 7.5%, 10%, 12.5%, or 15% larger than half the length of the lower chord when in the extended state. By increasing length 58 of each of upper chords 18 when roof truss 10*c* is in the expanded state, the upper chords can continue to overlie the entirety of lower chord 14.

To achieve such extendibility, each upper chord 18 can comprise a main segment 62 that can include the upper chord's second end 22*b* and an extension segment 66 that can include the upper chord's first end 22*a* and can be configured to move relative to the main segment. In the embodiment shown, for each upper chord 18, the upper chord's extension segment 66 can be configured to slide linearly relative to the upper chord's main segment 62, such as with the main segment being a tube (which can have, for example, a square, rectangular, or circular cross-section) within which the extension segment can slide. When upper chords 18 are each in the extended state and roof truss 10*c* is in the expanded state, length 58 of each of the upper chords can be fixed (e.g., by fixing the extension segment relative to the main segment with, for example, a fastener like a pin) to maintain the roof truss's geometry.

Figure 4A:
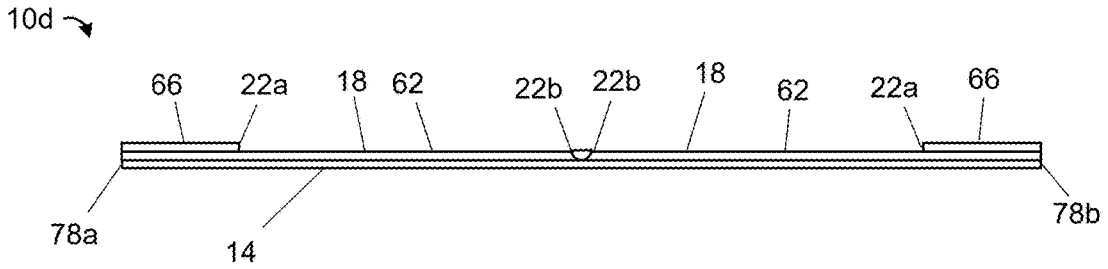
FIGS. 4A-4C are front views of a fourth embodiment of the present roof trusses in the collapsed state, while being moved to the expanded state, and in the expanded state, respectively, where the roof truss of FIGS. 4A-4C is substantially the same as the roof truss of FIGS. 1A-1C except that its upper chords are each extendible from a shortened state (FIG. 4A) to an extended state (FIG. 4C) by pivoting a secondary segment of the upper chord relative to a primary segment of the upper chord.
Figure 4B:
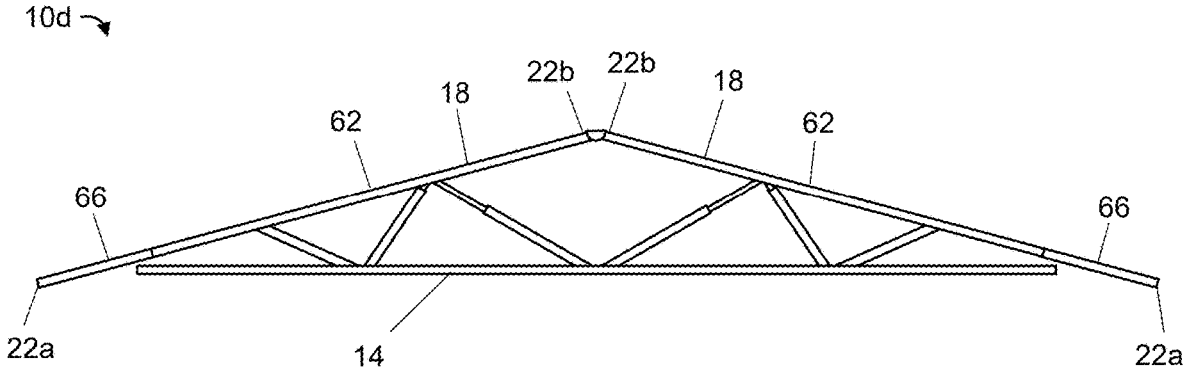
Figure 4C:
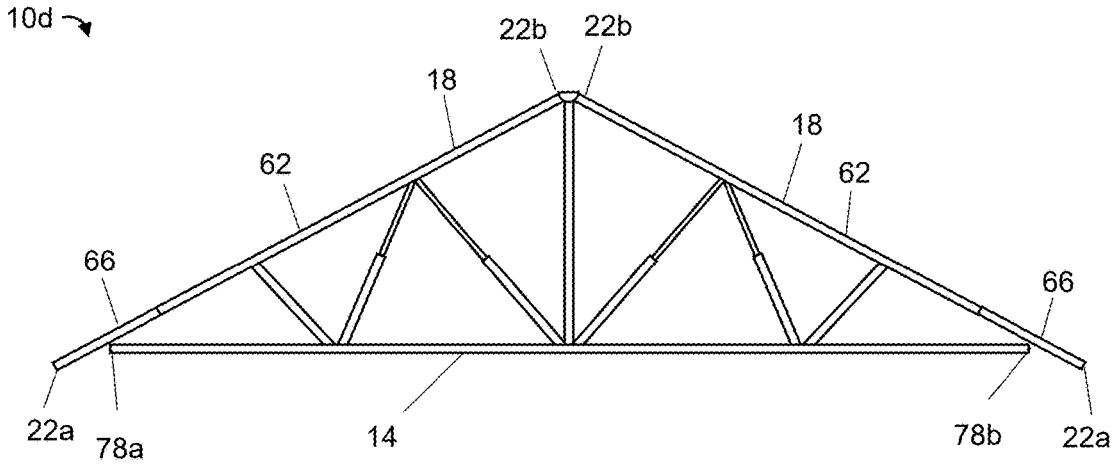

While as shown each of upper chords 18 is extendible via a slidable extension segment 66, in other embodiments length 58 of each of upper chords 18 can be extended in other mechanisms. For example, referring to FIGS. 4A-4C—which show a fourth embodiment 10*d* of the present roof trusses that is substantially the same as roof truss 10*c*—extension segment 66 of each of upper chords 18 can be pivotably coupled to main segment 62 of the upper chord such that the extension segment overlies the main segment when the upper chord is in the shortened state (FIG. 4A) and can be pivoted such that the extension segment does not overlie the main segment when the upper chord is in the extended state (FIG. 4C).

Figure 5A:
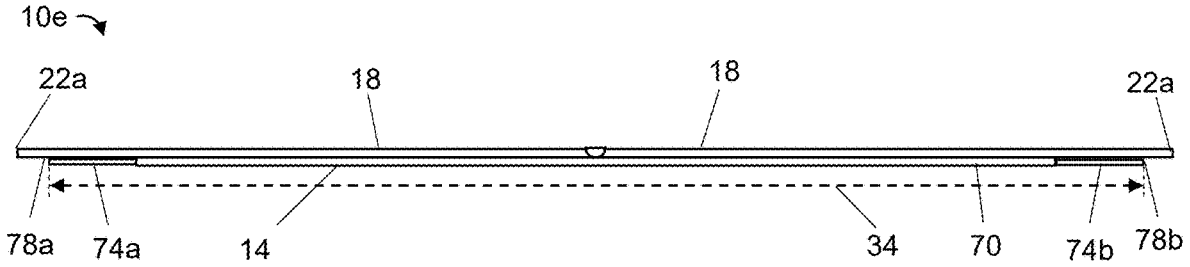
FIGS. 5A-5C are front views of a fifth embodiment of the present roof trusses in the collapsed state, while being moved to the expanded state, and in the expanded state, respectively, where the roof truss of FIGS. 5A-5C is substantially the same as the roof truss of FIGS. 1A-1C except that its lower chord is collapsible from an extended state (FIG. 5A) to a shortened state (FIG. 5C).
Figure 5B:
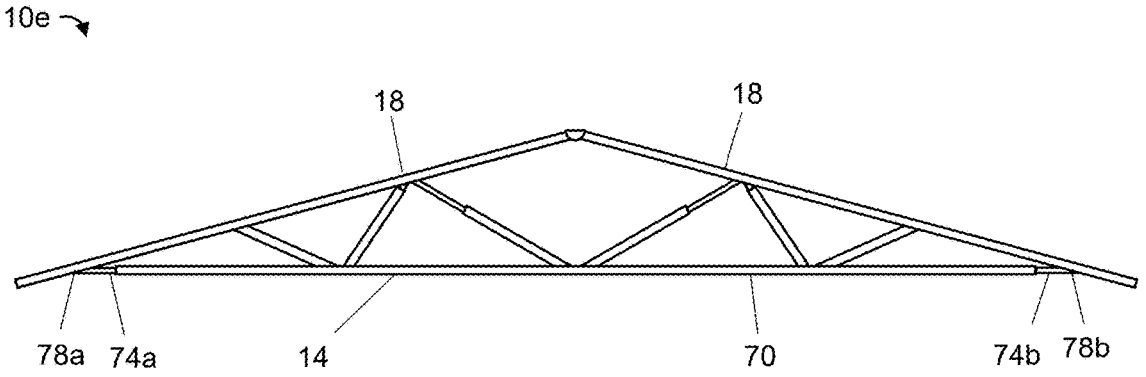
Figure 5C:
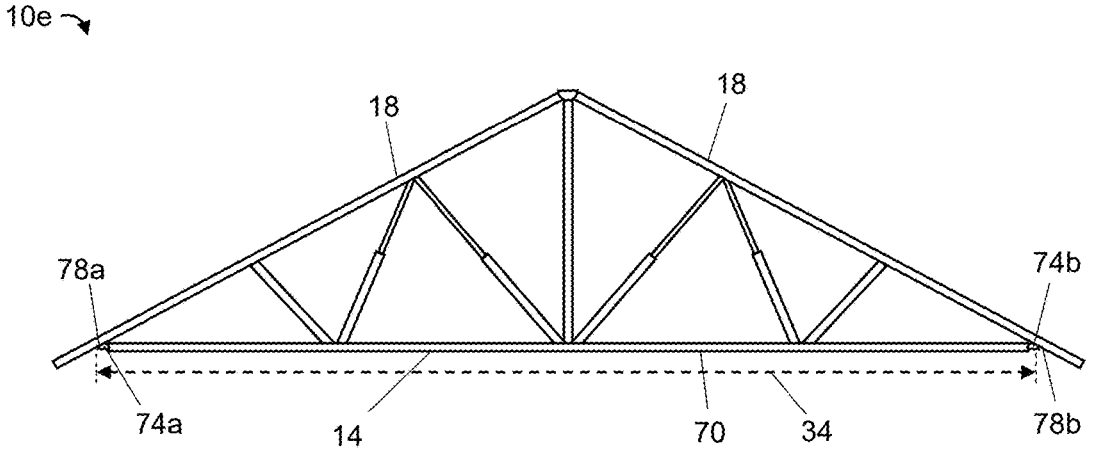
Figure 6A:
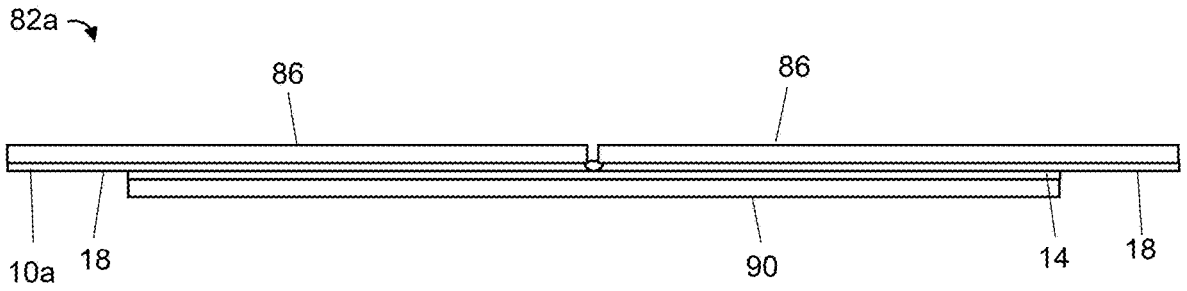
FIGS. 6A and 6B are front and top views, respectively, of first embodiment of the present roof assemblies, the roof assembly including at least two of the roof trusses of FIGS. 1A-1C, two roof panels that are each coupled to and overlie a respective one of the upper chords of each of the roof trusses of the roof assembly, and a ceiling panel coupled to and underlying the lower chord of each of the roof trusses of the roof assembly.
Figure 6B:
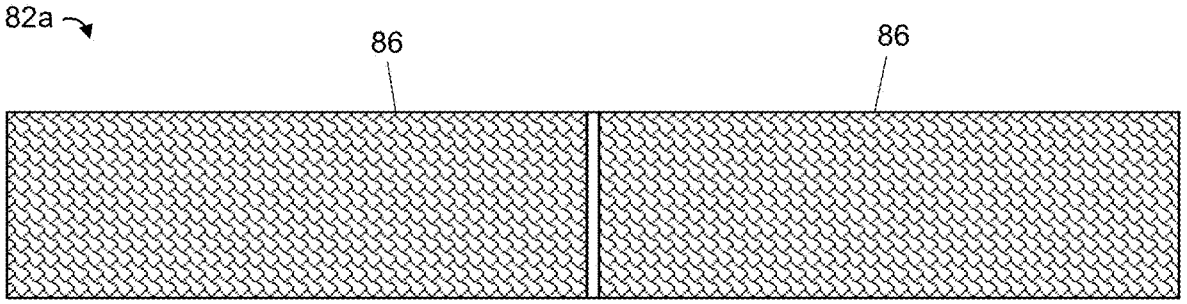
Figure 6C:
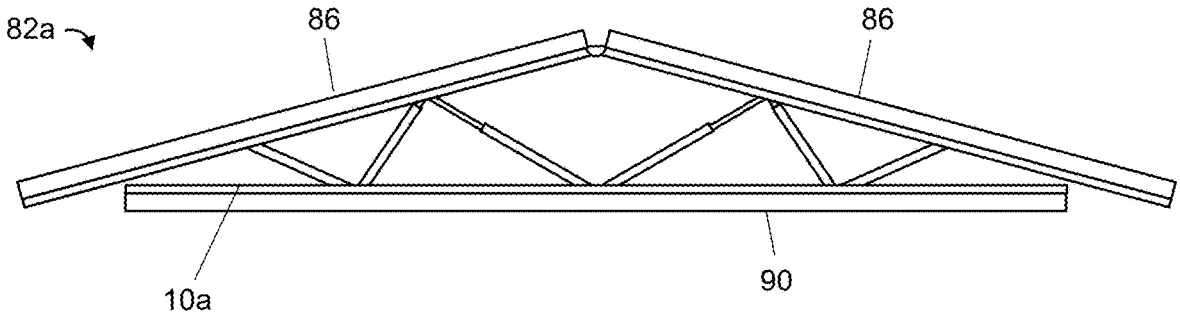
FIGS. 6C and 6D are front views of the roof assembly of FIG. 6A while the roof assembly's roof trusses are being moved to the expanded state and are in the expanded state, respectively.
Figure 6D:
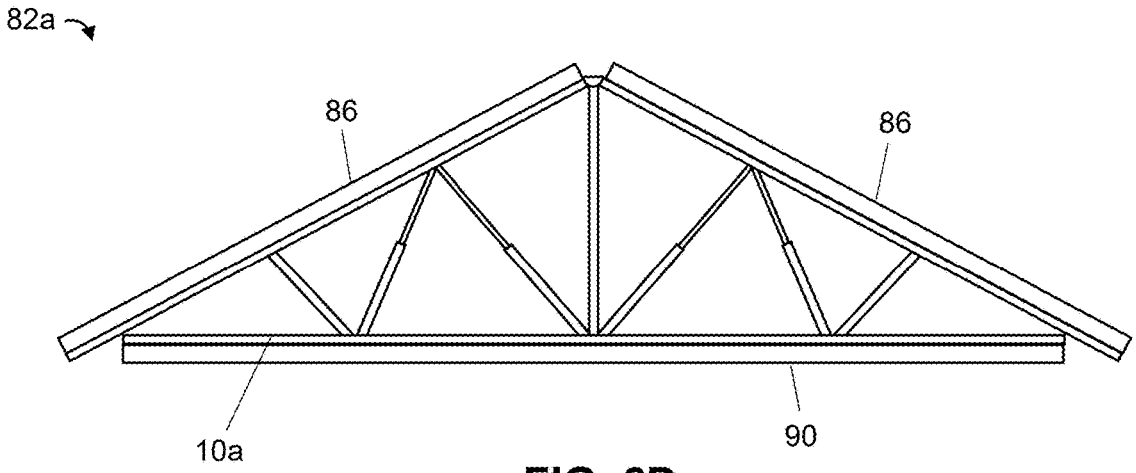

In some embodiments, lower chord 14 can be configured to be shortened from an extended state to a shortened state in which its length is shorter than when in the extended state, like as shown in FIGS. 5A-5C that depict a fifth embodiment 10*e* of the present roof trusses that is otherwise similar to roof truss 10*a*. For example, as shown lower chord 14 can comprise a main segment 70 and first and second extension segments 74*a* and 74*b* that can include the lower chord's first and second ends 78*a* and 78*b*, respectively, where each of the extension segments is linearly slidable relative to the main segment, such as with the main segment being a tube (which can have, for example, a square, rectangular, or circular cross-section) within which the extension segment can slide. Each of opposing ends 78*a* and 78*b* of lower chord 14—and thus each of extension segments 74*a* and 74*b*—can be coupled to a respective one of upper chords 18, and lower chord 14 can be in the extended state when roof truss 10*e* is in the collapsed state (FIG. 5A). Moving lower chord 14 to the shortened state (e.g., by sliding its extension segments 74*a* and 74*b* toward one another) can thus draw first ends 22*a* of upper chords 18 toward one another and thereby cause the upper chords' second ends 22*b* to move upwardly away from the lower chord such that roof truss 10*e* moves toward the expanded state (FIG. 5C). By allowing the horizontal shortening of lower chord 14 to cause second ends 22*b* of upper chords 18 to rise, roof truss 10*e* can be moved to the expanded state in a simple manner without the use of, for example, a crane.

In other embodiments of the present roof trusses, the roof truss can comprise only one upper chord 18 that can remain substantially parallel to lower chord 14 when the roof truss moves between the collapsed and expanded states, where second end 44*b* of each of pivotable braces 42 (which can include one or more, optionally two or more, expandable braces 46) is pivotably coupled to that single upper chord. With such embodiments, because there is no change in pitch to accommodate, upper chord 18 can have a fixed length that can substantially the same as length 34 of lower chord 14 (e.g., with the upper chord's ends 22*a* and 22*b* overlying the lower chord).

In any of the present roof trusses (e.g., 10*a*-10*e*), lower chord 14, upper chords 18, and braces 38 can have any suitable construction that can mitigate the risk of damage during transportation and provide adequate structural support for a roof. For example, lower chord 14, upper chords 18, and braces 38 each preferably comprise a metal such as steel and/or aluminum. However, in other embodiments, lower chord 14, upper chords 18, and braces 38 can each comprise wood, which while weaker than metal may be more cost-effective.

Referring to FIGS. 6A-6D, shown is a first embodiment 82*a* of the present roof assemblies that can be constructed prior to delivery to a building site. To maintain a compact profile for delivery, roof assembly 82*a* can comprise two or more of any of the present expandable roof trusses (e.g., 10*a*-10*e*), such as greater than or equal to any one of, or between any two of, two, three, four, five, six, seven, or eight roof trusses; in the embodiment shown, the roof assembly includes a plurality of roof trusses 10*a*. Roof assembly 82*a* can also comprise two roof panels 86 that can each be coupled to and overlie a respective one of upper chords 18 of each of the roof trusses of the roof assembly, although in embodiments in which each of the roof trusses comprises a single upper chord, the roof assembly can comprise a single roof panel that is coupled to and overlies the single upper chord of each of the roof trusses. Each of roof panels 86 can comprise a roofing material that faces away from the roof trusses to which the roof panel is coupled, such as a plurality of shingles (e.g., comprising asphalt), a plurality of tiles (e.g., comprising concrete, a polymer, clay, and/or slate), or one or more metal sheets (e.g., comprising steel and/or aluminum) to provide protection against the environment. Furthermore, roof assembly 82*a* can optionally comprise a ceiling panel 90 that is coupled to and underlies lower chord 14 of each of the roof trusses of the roof assembly such that the roof assembly provides a ceiling in the interior of a building when the roof assembly is installed.

As shown, with upper chords 18 of roof assembly 82*a*'s roof trusses coupled to roof panels 86, the roof trusses can move together from the collapsed state (FIG. 6A) to the intermediate state (FIG. 6C) and finally to the expanded state (FIG. 6D) to define at least a portion of a roof for a building.

Figure 7A:
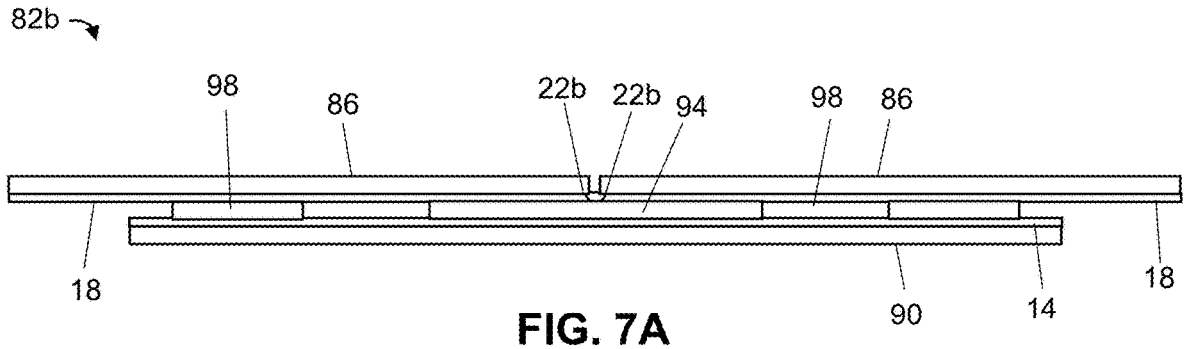
FIGS. 7A-7C are front views of a second embodiment of the present roof assemblies that includes at least two expandable roof trusses in the collapsed state, while being moved to the expanded state, and in the expanded state, respectively, where the roof assembly of FIGS. 7A-7C includes walls pivotable relative to the upper chords of the roof assembly to define a room when the roof assembly's roof trusses are in the expanded state.
Figure 7B:
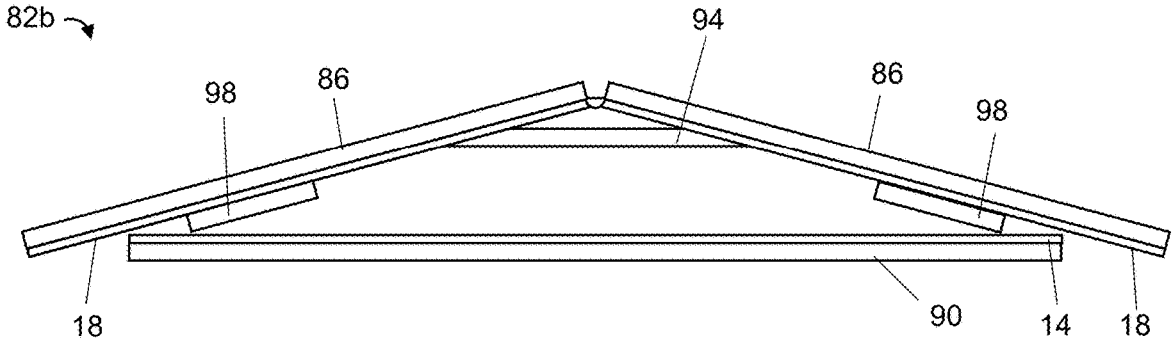
Figure 7C:
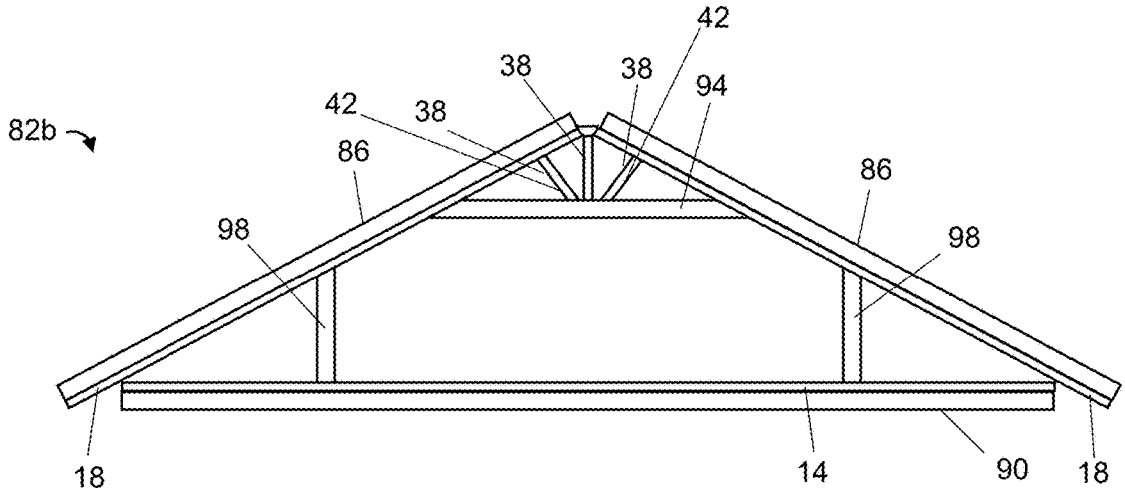
Figure 8A:
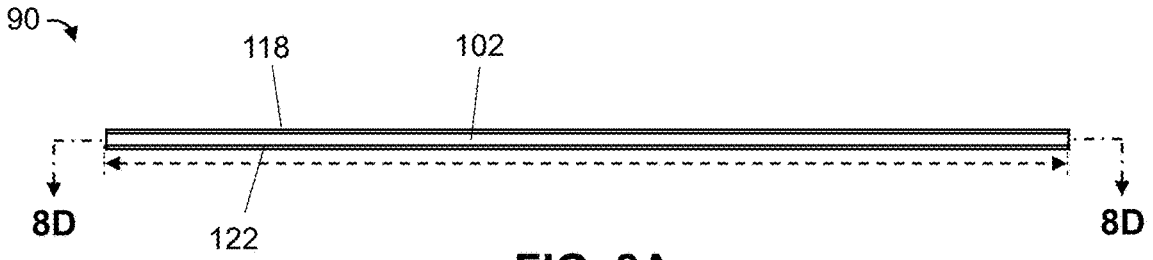
FIGS. 8A-8C are front, top, and bottom views, respectively, of a ceiling panel of some of the present roof assemblies.
Figure 8B:
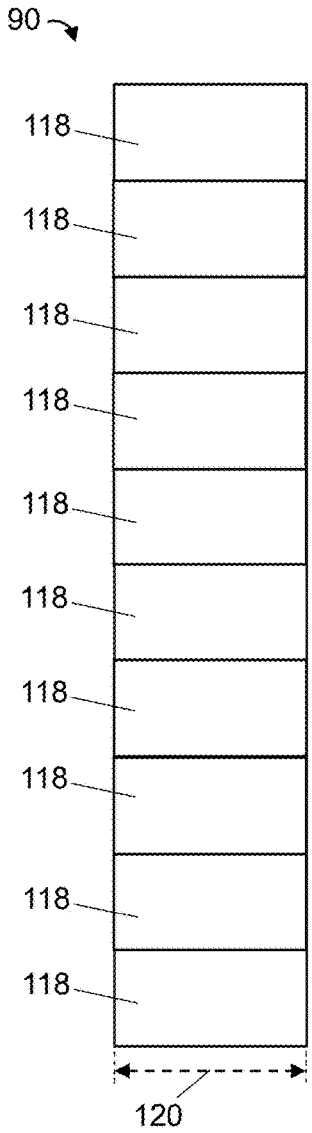
Figure 8C:
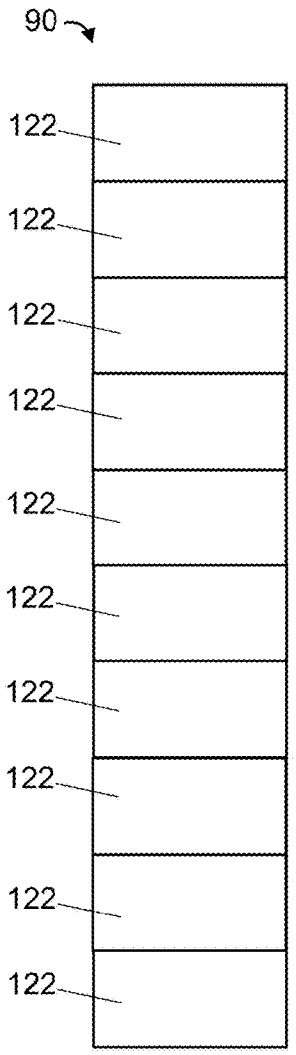
Figure 8D:
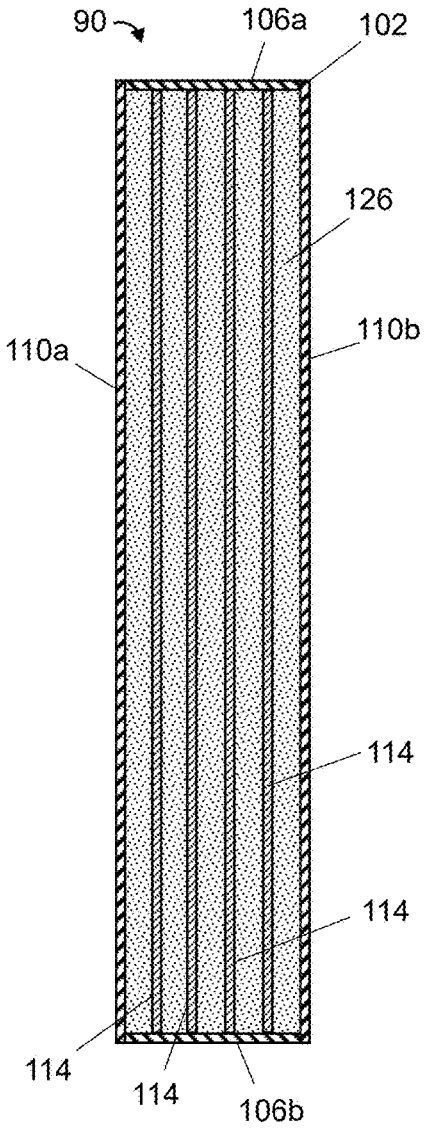
FIG. 8D is a cross-sectional view of the ceiling panel of FIGS. 8A-8C taken along line 8D-8D of FIG. 8A.

Referring to FIGS. 7A-7C, shown is a second embodiment 82*b* of the present roof assemblies that can define a living space (e.g., for a second story of a building). As with roof assembly 82*a*, roof assembly 82*b* can comprise two or more roof trusses that each have a lower chord 14, two upper chords 18 pivotably coupled to one another at their second ends 22*b* to allow the roof truss to be movable between collapsed and expanded states, two roof panels 86 that are each coupled to a respective one of the upper chords of each of the roof trusses, and a ceiling panel 90 coupled to and underlying the lower chord. Roof assembly 82*b* can also comprise a ceiling 94 that underlies and is coupled to upper chords 18 of each of the roof trusses such that the upper chords can pivot and slide relative to the ceiling when moving from the collapsed state (FIG. 7A) to the expanded state (FIG. 7C), as well as two walls 98 that are each pivotably coupled to a respective one of the upper chords of each of the roof trusses. When the roof trusses are moved to the expanded state, each of walls 98 can be pivoted relative to upper chords 18 of the roof trusses such that the wall extends from the upper chords to which it is pivotable coupled to the lower chords of the roof trusses (e.g., in a vertical direction that is substantially perpendicular to a horizontal direction in which ceiling 94 extends). When so-pivoted, walls 98 can help support upper chords 18 relative to lower chords 14 and can, with ceiling 94, define a living space. Roof assembly 82*b* can also comprise, for each of the roof trusses of the roof assembly, one or more—optionally two or more—braces 38 that can be coupled to and extend between ceiling 94 and upper chords 18 of the roof truss to help support the roof truss in the expanded state. For example, for each of the roof trusses, one or more—optionally two or more—of brace(s) 38 can be a pivotable brace 42 that is pivotably coupled to ceiling 94 and can be nested within the ceiling when the roof truss in the collapsed state and can be pivoted relative to the ceiling when the roof truss in the expanded state. While as shown ceiling 94 and walls 98 can be disposed below upper chords 18 of each of the roof trusses when roof assembly 82 is in the collapsed state such that the ceiling and walls are disposed between the upper chords and lower chords 14, in other embodiments they need not be and can each extend between at least one of the upper chords of one of the roof trusses and at least one of the upper chords of another one of the roof trusses (and can optionally have a thickness that is substantially the same as the thickness of the upper chords it extends between), which can further promote compactness in the collapsed state (e.g., because the thickness of the ceiling and walls can accordingly have less of an impact on the thickness of the assembly).

Referring to FIGS. 8A-8D, shown is a ceiling panel 90 that can be used in some of the present systems (e.g., as part of one of the present roof assemblies, one of the present below-described building assemblies, and/or the like). As shown, ceiling panel 90 can comprise a frame 102 that can define a periphery of the ceiling panel. Frame 102 can comprise two opposing widthwise edges 106*a* and 106*b* that can each extend in a first direction and two opposing lengthwise edges 110*a* and 110*b* that can each extend in a second direction that is substantially perpendicular to the first direction between ends of the opposing widthwise edges. Frame 102 preferably comprise a material that can mitigate the risk of damage during transportation, such as metal like steel and/or aluminum. Furthermore, to provide attachment points for flooring and/or ceiling material, ceiling panel 90 can comprise a plurality of joists 114, such as greater than or equal to any one of, or between any two of, two, three, four, five, six, seven, eight, nine, or ten joists, that can each extend between opposing edges (e.g., opposing widthwise edges 106*a*) of the frame and can each comprise, for example, wood. To increase the stiffness and strength of ceiling panel 90, the roof panel can comprise one or more—optionally two or more—wood panels 118 (which can each comprise, for example, plywood) that can be coupled to joists 114 and frame 102 and can overlie the joists and frame, preferably such that the wood panels overlie greater than or equal to any one of, or between any two of, 75%, 80%, 85%, 90%, or 95% of a planform of the ceiling panel. Wood panel(s) 118 can provide a surface on which flooring such as tile, wood planks, vinyl, and/or the like can be installed. Because ceiling panel 90 can include flooring, it can also be considered a floor assembly. Ceiling panel 90 can also define a ceiling of space over which the ceiling panel overlies, such as with one or more—optionally two or more—drywall panels 122 that can be coupled to joists 114 and frame 102 and can underlie the joists and frame, preferably such that the drywall panels underlie greater than or equal to any one of, or between any two of, 75%, 80%, 85%, 90%, or 95% of a planform of the ceiling panel. However, panel 90 need not define a ceiling with, for example, drywall panels 122, especially if it is a floor assembly for a ground-level floor that does not overlie a living space. Optionally, ceiling panel 90 comprises insulation 126 that comprises a thermally-insulative material and is disposed within a space circumscribed by frame 102 (e.g., between wood panel(s) 118 and drywall panel(s) 122) to mitigate heat transfer across the ceiling panel; preferable, the insulation comprises foam.

Figure 9A:
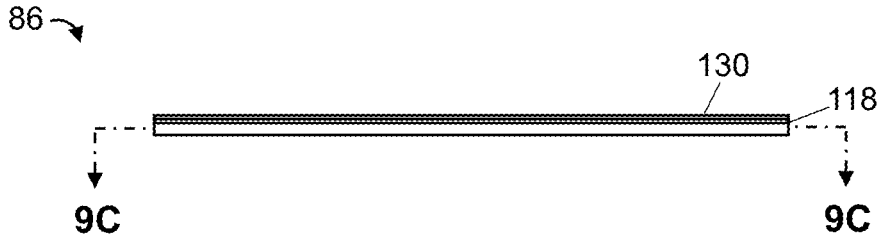
FIGS. 9A and 9B are front and top views, respectively, of a roof panel of some of the present roof assemblies.
Figure 9B:
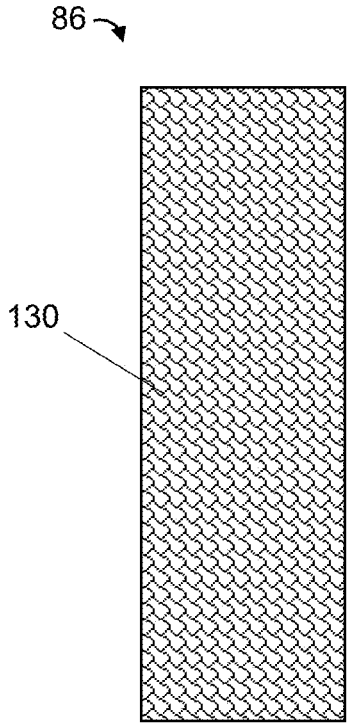
Figure 9C:
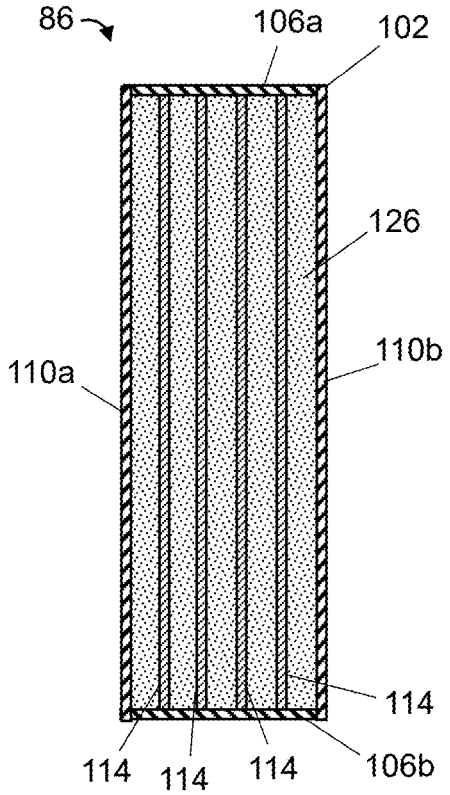
FIG. 9C is a cross-sectional view of the roof panel of FIG. 9C taken along line 9C-9C of FIG. 9A.

Referring to FIGS. 9A-9C, shown is a roof panel 86 that can be used in some of the present systems (e.g., as part of one of the present roof assemblies, one of the present below-described building assemblies, and/or the like). To facilitate manufacturability in plan used to construction multiple ones of the present components, as shown roof panel 86 can have frame 102 having substantially the same configuration as the frame of ceiling panel 90, with joists 114 extending between opposing edges (e.g., opposing widthwise edges 106*a*) of the frame of the roof panel and one or more—optionally two or more—wood panels 118 coupled to and overlying the joists and frame. However, roof panel 86 can comprise a roofing material 130 coupled to and overlying wood panel(s) 118, such as—as described above—a plurality of shingles (e.g., comprising asphalt), a plurality of tiles (e.g., comprising concrete, a polymer, clay, and/or slate), or one or more metal sheets (e.g., comprising steel and/or aluminum) to provide protection against the environment. Roof panel 86 need not, but can, comprise drywall panels coupled to and underlying its frame 102 and joists 114 (e.g., because such may be unnecessary in an attic space that the roof space overlies). And, as with ceiling panel 90, roof panel 86 can comprise insulation 126 that comprises a thermally-insulative material to mitigate heat transfer across the roof panel.

Figure 10A:
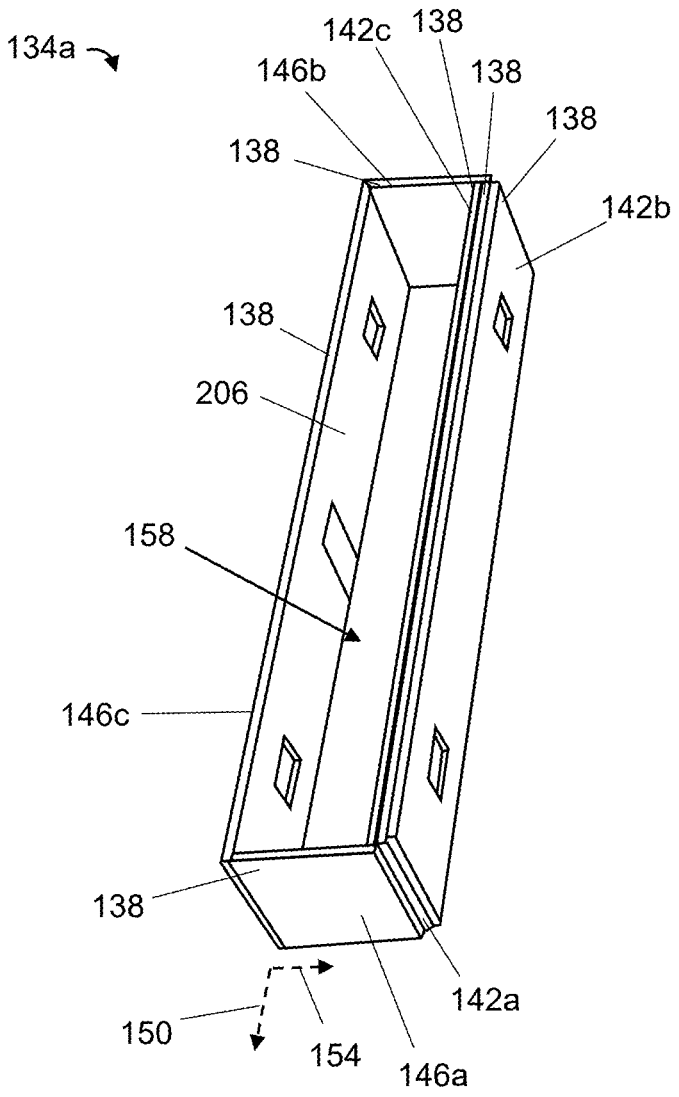
FIG. 10A is a perspective view of a first embodiment of the present wall assemblies that includes six wall segments, three of which are pivotable wall segments that are each pivotably coupled to at least one other of the wall segments such that the wall assembly is movable between folded and unfolded states.
Figure 10B:
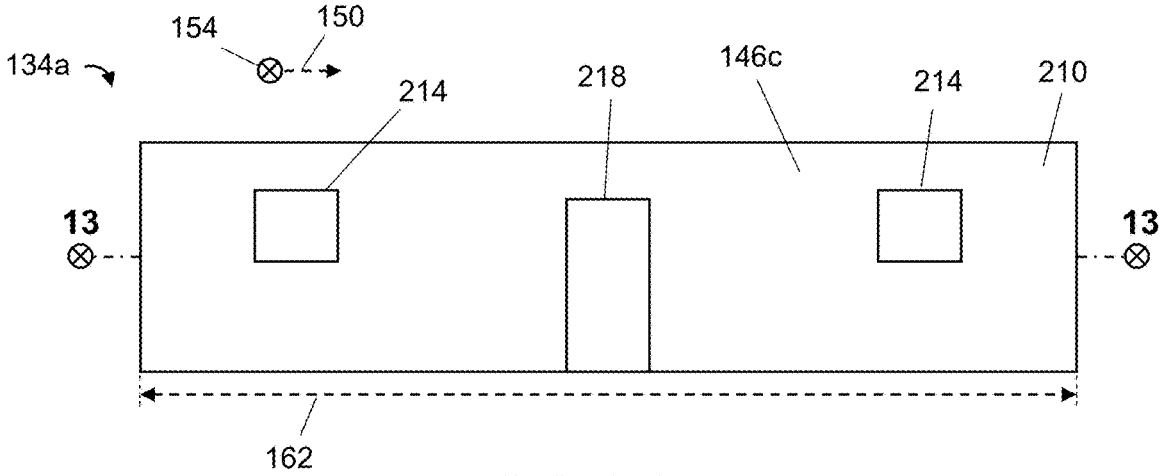
FIGS. 10B-10F are front, right, left, rear, and top views, respectively, of the wall assembly of FIG. 10A in the folded state.
Figure 10C:
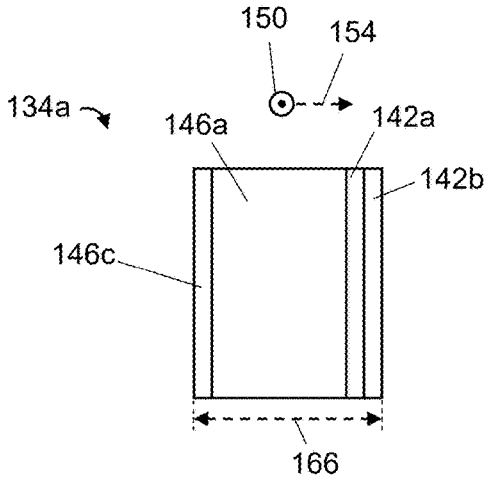
Figure 10D:
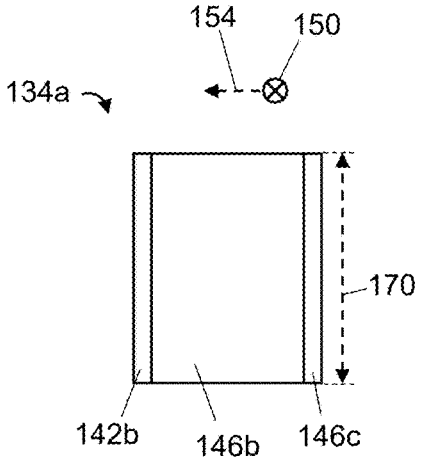
Figure 10E:
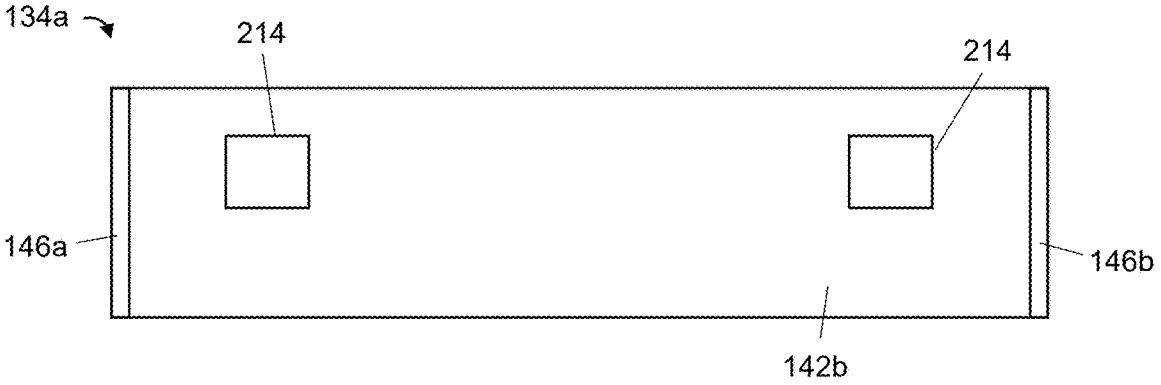
Figure 10F:
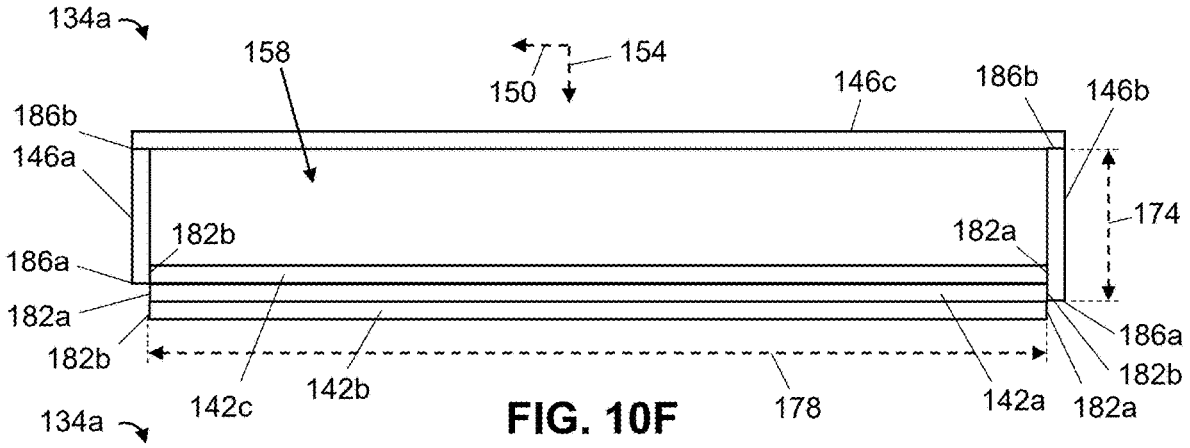
Figure 10G:
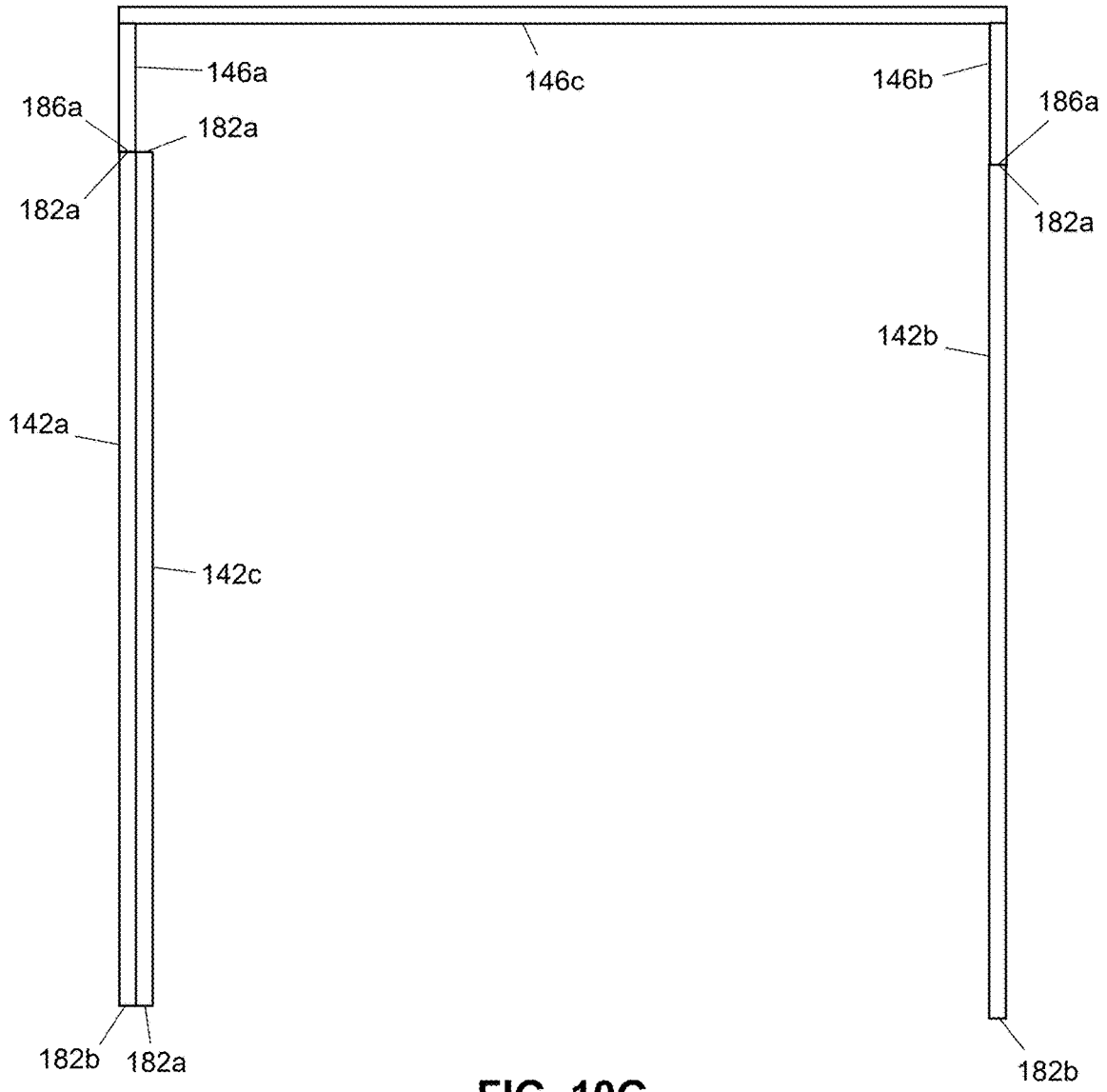
FIG. 10G is a top view of the wall assembly of FIG. 10A with two of its pivotable wall segments pivoted relative to the fixed wall segments to which they are coupled such that they each extend in a widthwise direction.
Figure 10H:
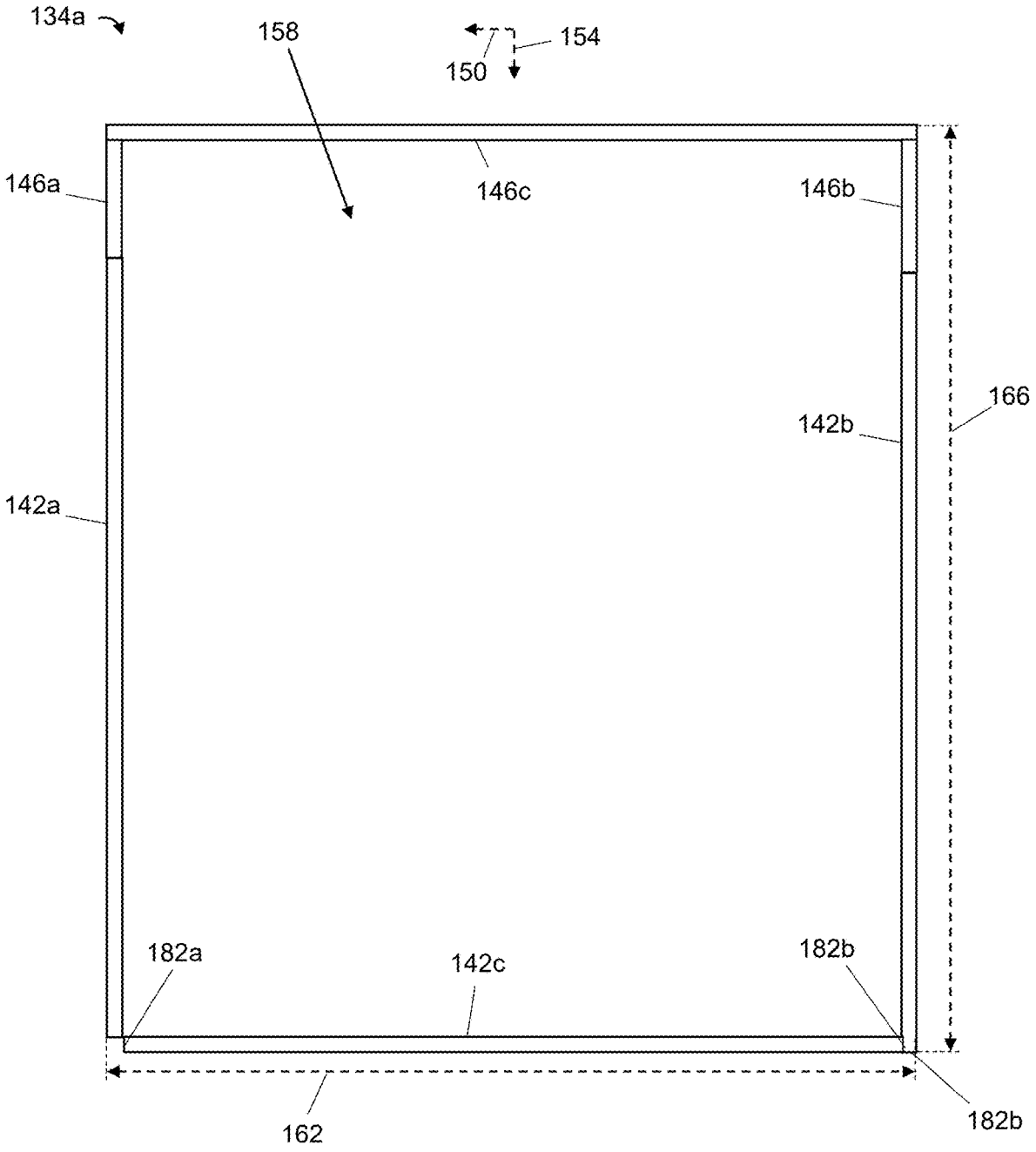
FIGS. 10H and 10I are top and perspective views, respectively, of the wall assembly of FIG. 10A in the unfolded state.
Figure 10I:
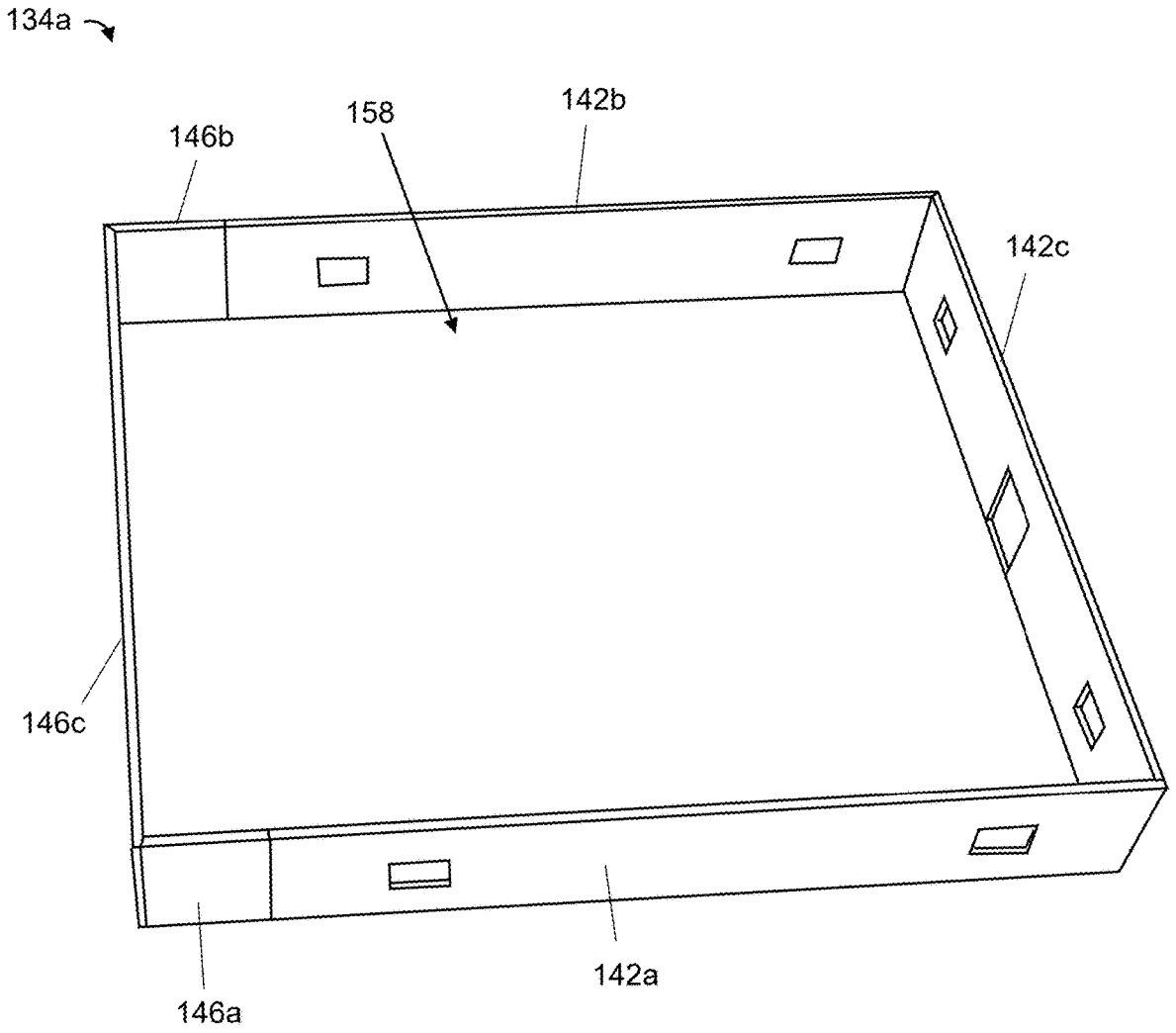

Referring to FIGS. 10A-10I, shown is a first embodiment 134*a* of the present wall assemblies that can be folded for transport and quickly unfolded at a building site to reduce the amount of time needed to construct a building. To do so, wall assembly 134*a* can comprise a plurality of wall segments 138—such as greater than or equal to any one of, or between any two of, four, five, six, seven, eight, nine, ten, eleven, twelve, thirteen, or fourteen wall segments (e.g., at least six well segments)—that include a plurality of pivotable wall segments 142*a*-142*c*—such as greater than or equal to any one of, or between any two of, three, four, five, six, or seven pivotable wall segments—that are each pivotably coupled to at least one other of the wall segments such that wall assembly 134*a* is movable between a folded state (FIGS. 10A-10F) and an unfolded state (FIGS. 10H and 10I).

As shown in FIGS. 10A-10F, when wall assembly 134*a* is in the folded state, at least two of wall segments 138—which can include at least first and second fixed wall segments 146*a* and 146*b*—can extend in a widthwise direction 154 and at least four of the wall segments—which can include pivotable wall segments 142*a*-142*c* and, optionally, a third fixed wall segment 146*c*—can extend in a lengthwise direction 150 that is substantially perpendicular to the widthwise direction to define an interior volume 158 circumscribed by the wall segments. With pivotable wall segments 142*a*-142*c* each extending in lengthwise direction 150 when wall assembly 134*a* is in the folded state, wall assembly 134*a* can have a relatively compact width 166, measured in widthwise direction 154, for transport. For example, width 166 can be less than or equal to any one of, or between any two of, 40%, 35%, 32.5%, 30%, 27.5%, 25%, 22.5%, 20% or 17.5% (e.g., less than or equal to 30%) of wall assembly 134*a*'s length 162 measured in lengthwise direction 150 when the wall assembly is in the folded state, such as with the width being less than or equal to any one of, or between any two of, 16, 15, 14, 13, 12, 11, 10, 9, 8, or 7 feet (e.g., less than or equal to 102 inches or between 7 and 10 feet) and the length being greater than or equal to any one of, or between any two of, 20, 25, 30, 35, 40, 45, 50, 55, 60, 65, 70, 75, or 80 feet (e.g., between 30 and 53 feet or about 40 feet) to allow for transport with a truck and/or within an ISO container. A height 170 of wall assembly 134*a*—which can remain the same when the wall assembly moves between the folded and unfolded states—can likewise be small enough to allow for transport within a truck and/or within a ISO container but large enough for a living space, such as greater than or equal to any one of, or between any two of, 7, 8, 9, 10, 11, or 12 feet.

As shown in FIGS. 10H and 10I, pivotable wall segments 142*a*-142*c* can be pivoted such that, when wall assembly 134*a* is in the unfolded state, at least four wall segments 138—which can include at least two of the pivotable wall segments (e.g., 142*a* and 142*b*) that previously extended in lengthwise direction 150, first fixed wall segment 146*a*, and second fixed wall segment 146*b*—can extend in widthwise direction 154, and at least two of the wall segments—which can include at least one of the pivotable wall segments (e.g., 142*c*) and third fixed wall segment 146*c*—can still extend in in the lengthwise direction. As such, wall assembly 134*a* can have an interior volume 158 circumscribed by four walls that are defined by at least six of wall segments 138, including pivotable wall segments 142*a*-142*c* and, optionally, first, second, and third fixed wall segments 146*a*, 146*b*, and 146*c*. With at least pivotable wall segments 142*a* and 142*b* extending in widthwise direction 154 when wall assembly 134*a* is in the unfolded state, the wall assembly's width 166 can be larger when the wall assembly is in the unfolded state than when the wall assembly is in the folded state and the wall assembly's length 162 can be approximately the same (e.g., any of the lengths described above), yielding a larger interior volume 158 and thus a larger living space in the building constructed using the wall assembly. For example, wall assembly 134*a*'s width 166 when it is in the unfolded state can be at least 2.75, 3.0, 3.25, 3.5, 3.75, 4.0, 4.25, 4.5, 4.75, 5.0, 5.25, 5.5, or 5.75 times its width when it is in the folded state, such as with the width being greater than or equal to any one of, or between any two of, 25, 35, 45, 55, 65, 75, 85, 95, 105, 115, 125, 135, 145, 155, or 165 feet (e.g., between 35 and 60 feet) when the wall assembly is in the unfolded state.

Any suitable configuration of wall segments 138 can be employed to achieve this movability between folded and unfolded states, as well as a desired building geometry. As described above, in the embodiment shown wall segments 138 include first and second fixed wall segments 146*a* and 146*b* that each extend in widthwise direction 154 between first and second ends 186*a* and 186*b* both when wall assembly 134*a* is in the folded state and when the wall assembly is in the unfolded state, where the first and second wall segments define opposing sides of the wall assembly such that interior volume 158 is disposed between the first and second fixed wall segments. First and second fixed wall segments 146*a* and 146*b* can thus define most of wall assembly 134*a*'s width 166 when the wall assembly is in the folded state, and accordingly can each have a length 174, measured in widthwise direction 154, that is relatively compact to promote the wall assembly's widthwise compactness during transport, such as a length that is less than or equal to any one of, or between any two of, 40%, 35%, 32.5%, 30%, 27.5%, 25%, 22.5%, 20% or 17.5% (e.g., less than or equal to 30%) of the wall assembly's length 162 and/or that is less than or equal to any one of, or between any two of, 16, 15, 14, 13, 12, 11, 10, 9, 8, or 7 feet (e.g., less than or equal to 102 inches or between 7 and 10 feet). Pivotable wall segments 142*a*-142*c* can include one or more—optionally two or more—sets of the pivotable well segments coupled relative to first and second fixed wall segments 146*a* and 146*b* in a manner that allows the above-described movability between the folded and unfolded states. To do so, each set can include at least first, second, and third pivotable wall segments 142*a*, 142*b*, and 142*c* that each extend between first and second ends 182*a* and 182*b*, where the first end of the first pivotable wall segment is pivotably coupled to one of ends 186*a* and 186*b* of first fixed well segment 146*a* (e.g., to its first end, as shown), the first end of the second pivotable wall segment is pivotably coupled to one of ends 186*a* and 186*b* of second fixed wall segment 146*b* (e.g., to its first end, as shown), and the first end of the third pivotable wall segment is pivotably coupled to the second end of the first pivotable wall segment. With this configuration, for each set of pivotable wall segments 142*a*-142*c*, when first and second pivotable wall segments 142*a* and 142*b* are pivoted relative to first and second fixed wall segments 146*a* and 146*b* such that they move from extending in lengthwise direction 150 (FIG. 10F) to widthwise direction 154 (FIG. 10G), third pivotable wall segment 142*c*—before being pivoted relative to the first pivotable wall segment—can also extend in the widthwise direction (e.g., with its first end disposed closer to the first pivotable wall segment's first end than to the first pivotable wall segment's second end). Third pivotable wall segment 142*c* can then be pivoted relative to first pivotable wall segment 142*a* to again extend in lengthwise direction 150 to complete wall assembly 134*a*'s movement to the unfolded state (FIG. 10H), at which point the third pivotable wall segment's second end 182*b* can be fixed to second pivotable wall segment 142*b*'s second end 182*b* to help maintain the wall assembly in the unfolded state. In other embodiments, third pivotable wall segment 142*c* of each set can be replaced with a movable wall segment that extends in lengthwise direction 150 when the wall assembly is in both the folded and unfolded states and, while otherwise similar to the third pivotable wall segment, is not coupled to the other of wall segments 38 such that it is movable relative to first and second pivotable wall segments 142*a* and 142*b* of the set after those pivotable wall segments have been pivoted. Such a movable wall segment can thus be moved to extend between and then be fixed to the pivoted first pivotable wall segment 142*a*'s second end 182*b* and the pivoted second pivotable wall segment 142*b*'s second end 182*b* (e.g., to define one of the walls of the assembly in the unfolded state).

For at least one—up to and including each—of the set(s) of pivotable wall segments, first and second pivotable wall segments 142*a* and 142*b* can each have a length 178 that is approximately the same as length 162 of wall assembly 134*a* when the wall assembly is in the folded state (e.g., greater than or equal to any one of, or between any two of, 2.5, 2.75, 3.0, 3.25, 3.5, 3.75, 4.0, 4.25, 4.5, 4.75, 5.0, 5.25, 5.5, or 5.75 times the wall assembly's width 166 in the folded state and/or greater than or equal to any one of, or between any two of, 20, 25, 30, 35, 40, 45, 50, 55, 60, 65, 70, 75, or 80 feet (e.g., between 30 and 53 feet or about 40 feet)). With such first and second pivotable wall segments 142*a* and 142*b* being pivoted to extend in widthwise direction 154 instead of lengthwise direction 150, when wall assembly 134*a* moves from the folded state to the unfolded state, the wall assembly's width 166 can increase by an amount that is at least approximately equal to its length 162 in the folded state. In the embodiment shown, for at least one—up to and including each—of the set(s) of pivotable wall segments, third pivotable wall segment 142*c* can also have a length 178 that is approximately the same as length 162 of wall assembly 134*a* when the wall assembly is in the folded state (e.g., greater than or equal to any one of, or between any two of, 2.5, 2.75, 3.0, 3.25, 3.5, 3.75, 4.0, 4.25, 4.5, 4.75, 5.0, 5.25, 5.5, or 5.75 times the wall assembly's width 166 in the folded state and/or greater than or equal to any one of, or between any two of, 20, 25, 30, 35, 40, 45, 50, 55, 60, 65, 70, 75, or 80 feet (e.g., between 30 and 53 feet or about 40 feet)). As shown, such a set of pivotable wall segments thus need only comprise three pivotable wall segments to form an enclosing portion of wall assembly 134*a* when the wall assembly is in the unfolded state.

Figure 11A:
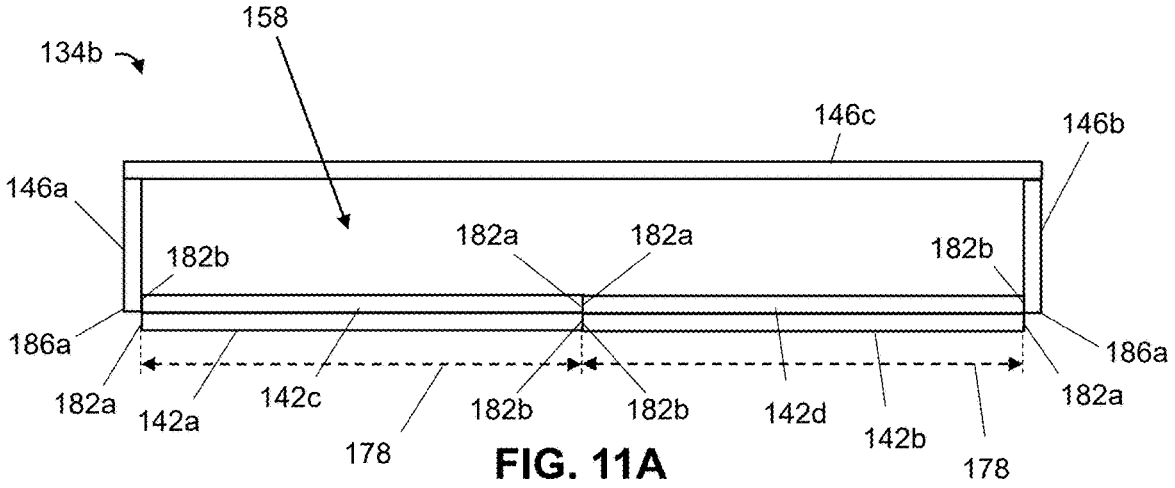
FIG. 11A is a top view of a second embodiment of the present wall assemblies that is substantially the same as the wall assembly of FIG. 10A, the primary exception being that the wall assembly of FIG. 11A has seven wall segments, four of which are pivotable wall segments that each have a length that is about half the length of the wall assembly in the folded state.
Figure 11B:
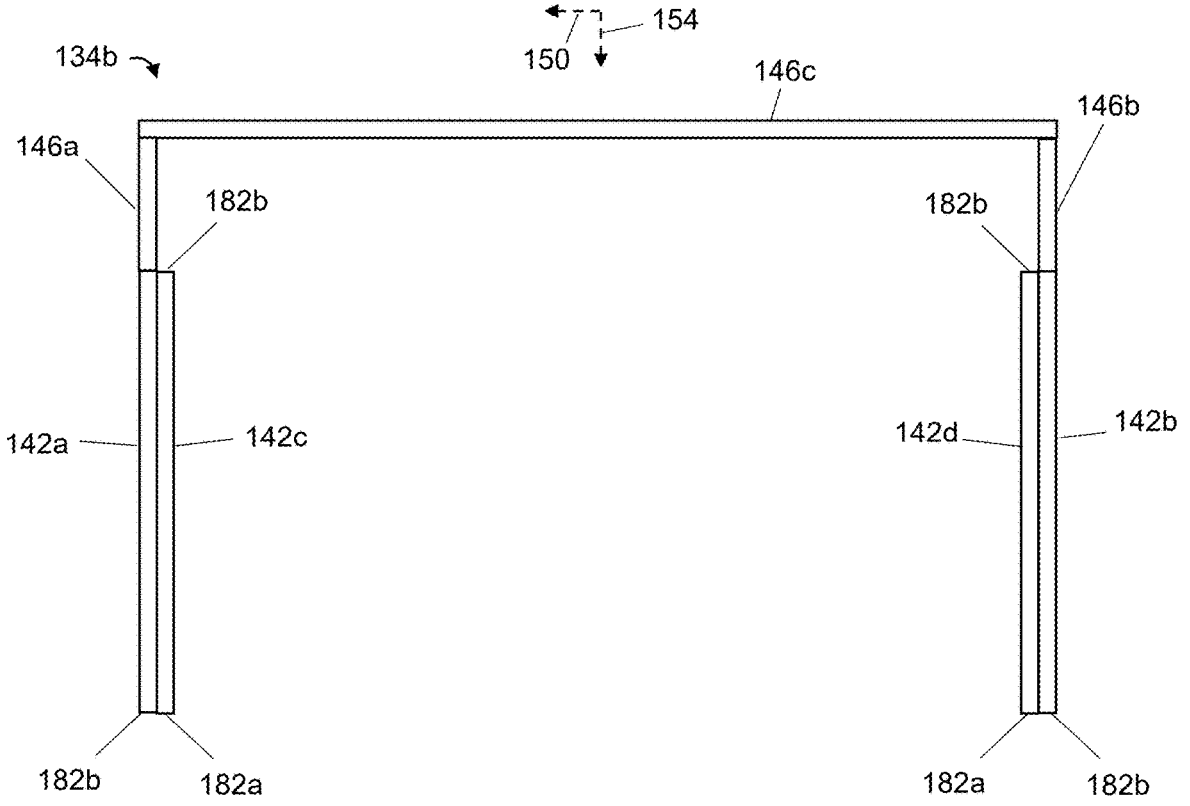
FIG. 11B is a top view of the wall assembly of FIG. 11A with two of its pivotable wall segments pivoted relative to the fixed wall segments to which they are coupled such that they each extend in a widthwise direction.
Figure 11C:
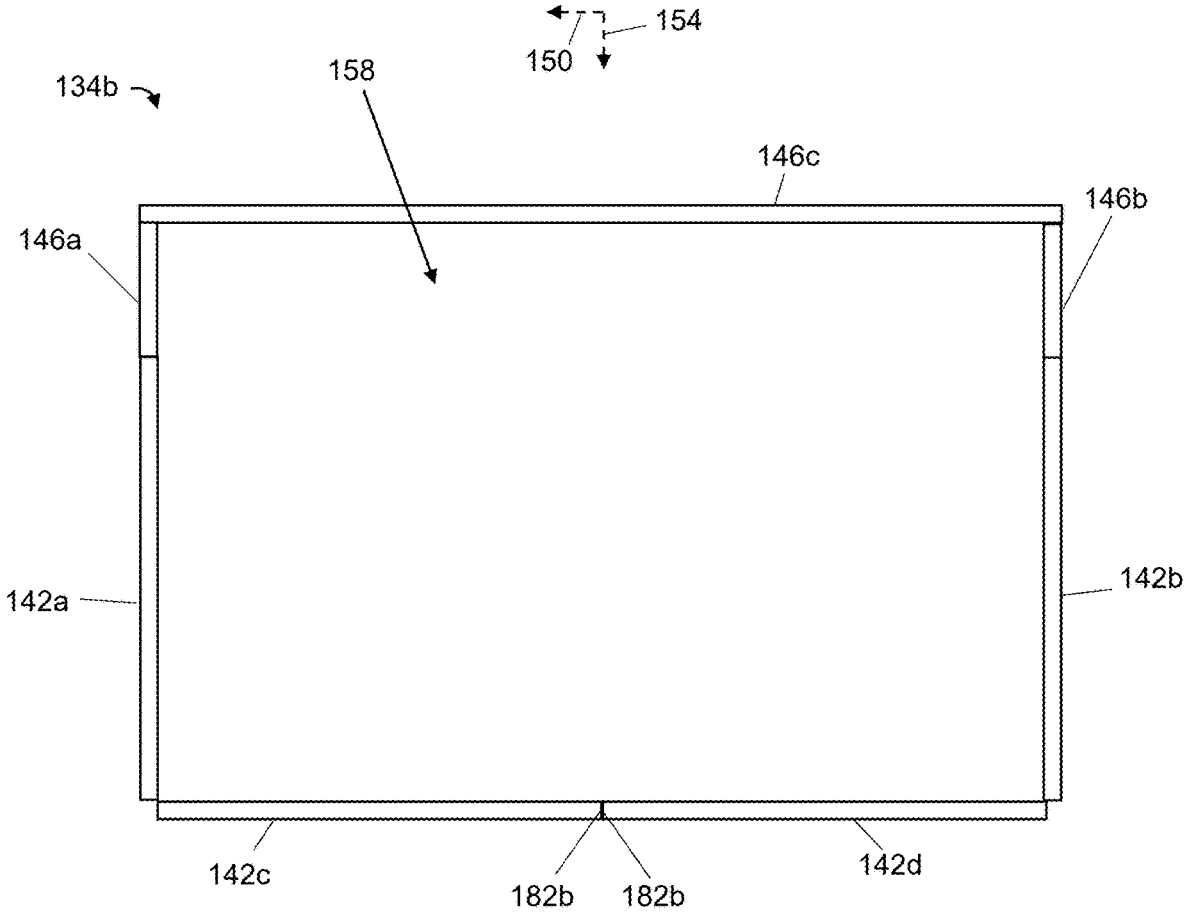
FIG. 11C is a top view of the wall assembly of FIG. 11A in the unfolded state.

However, referring to FIGS. 11A-11C, shown is another embodiment 134*b* of the present wall assemblies that is substantially the same as wall assembly 134*a*, except that in wall assembly 134*b* at least one—up to and including each—of the set(s) of pivotable wall segments includes pivotable wall segments whose length 178 is less than the wall assembly's length in the folded state. Such a set of pivotable wall segments can include—in addition to first, second, and third pivotable wall segments 142*a*-142*c* coupled in the manner described above—a fourth pivotable wall segment 142*d* that extends between first and second ends 182*a* and 182*b*, where the fourth pivotable wall segment's first end is pivotably coupled to second end 182*b* of the second pivotable segment. As shown, the coupled-together first and third pivotable wall segments 142*a* and 142*c* can have approximately the same length 178 and the coupled-together second and fourth pivotable wall segments 142*b* and 142*d* can have approximately the same length such that the pivotable segments of each pair are coextensive when wall assembly 134*b* is in the folded state (FIG. 11A), which promotes space efficiency. While length 178 of each of pivotable wall segments 142*a*-142*d* can be less than length 162 of the wall assembly when the wall assembly is in the folded state—such as less than or equal to any one of, or between any two of, 70%, 65%, 60%, 55%, 50%, 45%, or 40% (e.g., about 50%) of the wall assembly's length and/or less than or equal to any one of, or between any two of, 35, 30, 25, 20, or 15 feet (e.g., between 15 and 25 feet)—the first and second pivotable wall segments' lengths can together be approximately the same as the wall assembly's length and the third and fourth pivotable wall segments' lengths can together be approximately the same as the wall assembly's length such that, when the wall assembly is in the folded state, the first and second pivotable wall segments can cooperate and the third and fourth pivotable wall segments can cooperate to span approximately all of the wall assembly's length and help define interior volume 158. As shown in FIG. 11B, first and second pivotable wall segments 142*a* and 142*b* can be pivoted relative to first and second fixed wall segments 146*a* and 146*b* to extend in widthwise direction 154, with third and fourth pivotable wall segments 142*c* and 142*d*—before being pivoted relative to the first and second pivotable wall segments, respectively—also extending in the widthwise direction due to the movement of the first and second pivotable wall segments. Third and fourth pivotable wall segments 142*c* and 142*d* can then be pivoted relative to first and second pivotable wall segments 142*a* and 142*b* such that the third and fourth pivotable wall segments each again extend in lengthwise direction 150 to complete wall assembly 134*b*'s movement to the unfolded state (FIG. 11C). Because lengths 178 of third and fourth pivotable wall segments 142*c* and 142*d* can together be approximately the same as wall assembly 134*b*'s length 162 (e.g., in both the folded and unfolded states), they can cooperate and be fixed together at their second ends 182*b* to form an enclosing portion of the wall assembly when the wall assembly is in the unfolded state. In other embodiments, third and fourth pivotable wall segments 142*c* and 142*d* can be replaced with a movable wall segment as described above (e.g., with the movable wall segment having a length that is approximately the same as length 162 of wall assembly 134*b* when the wall assembly is in the folded state and being movable relative to first and second pivotable wall segments 142*a* and 142*b* after the pivotable wall segments have been pivoted to extend between and thereafter be fixed to second ends 182*b* of the pivoted first and second pivotable wall segments).

With lengths 178 of first and second pivotable wall segments 142*a* and 142*b* being less than wall assembly 134*b*'s length 162, pivoting them to extend in widthwise direction 154 when the wall assembly moves to the unfolded state can increase the pivotable wall segment's width 166 by an amount that is less than the wall assembly's length (e.g., by an amount that is less than or equal to any one of, or between any two of, 70%, 65%, 60%, 55%, 50%, 45%, or 40% (e.g., about 50%) of the wall assembly's length). Length 178 of each of pivotable wall segments 142*a*-142*d* can thus affect the size of the building constructed using unfolded wall assembly 134*b*, and can be chosen to yield a building of desired size.

Figure 12A:
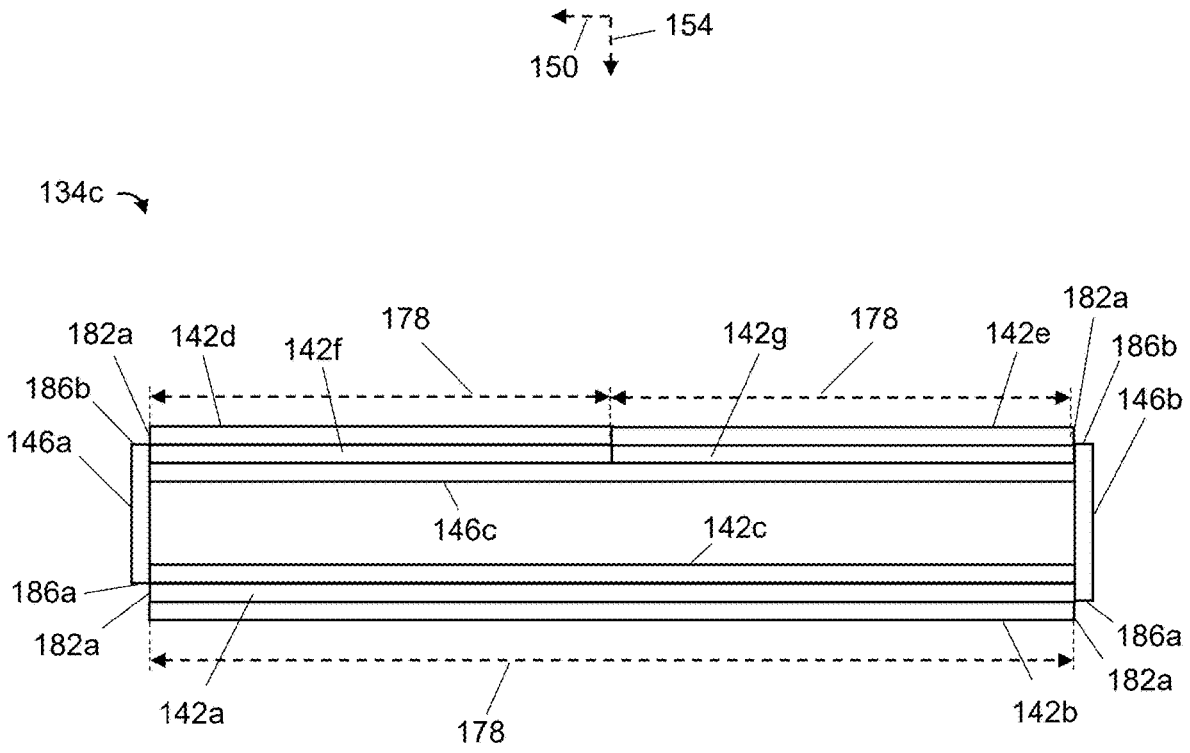
FIG. 12A is a top view of a third embodiment of the present wall assemblies that is substantially the same as the wall assembly of FIG. 10A, the primary exception being that the wall assembly of FIG. 12A has ten wall segments, seven of which are pivotable wall segments.
Figure 12B:
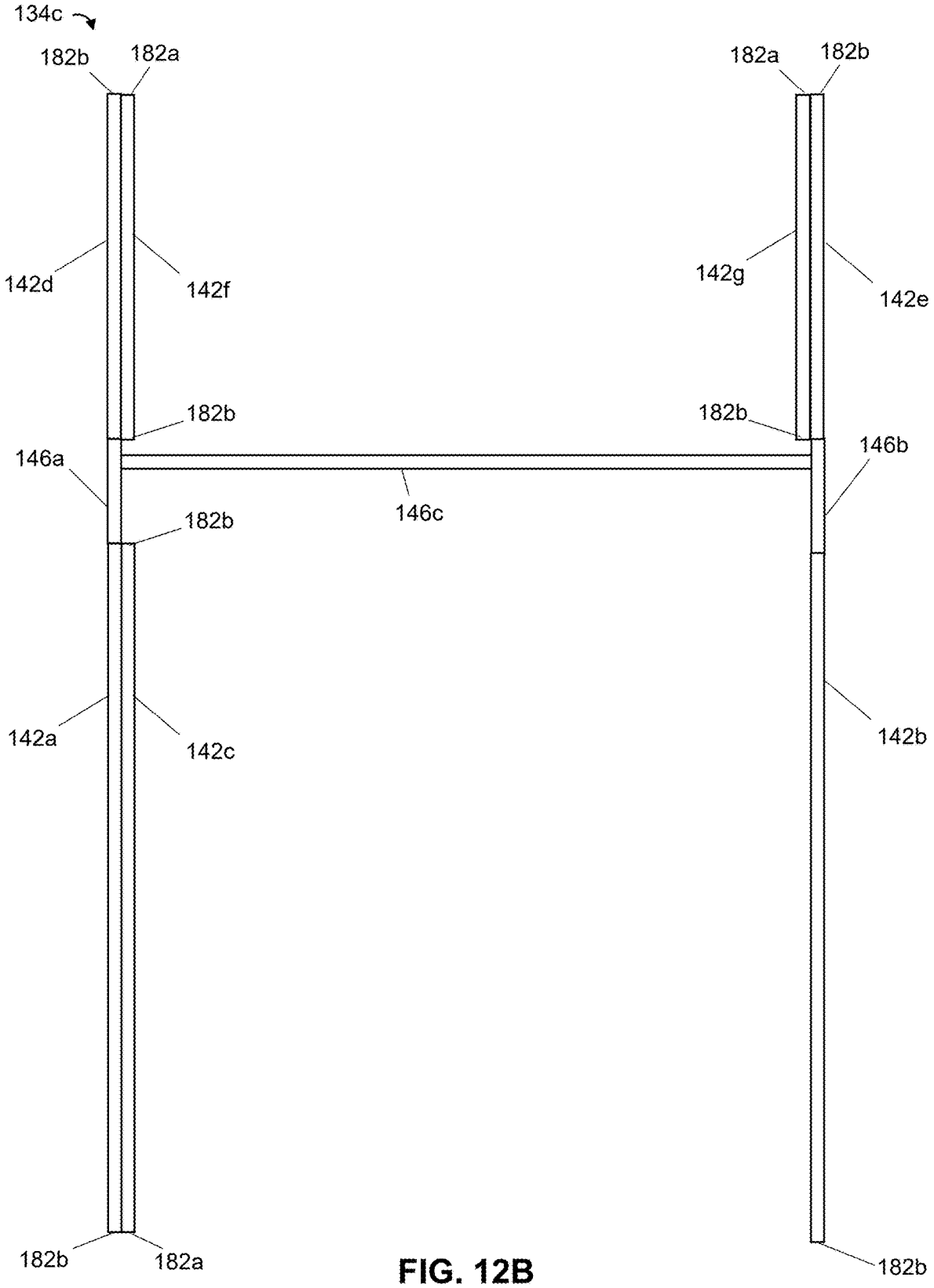
FIG. 12B is a top view of the wall assembly of FIG. 12A with four of its pivotable wall segments pivoted relative to the fixed wall segments to which they are coupled such that they each extend in a widthwise direction.
Figure 12C:
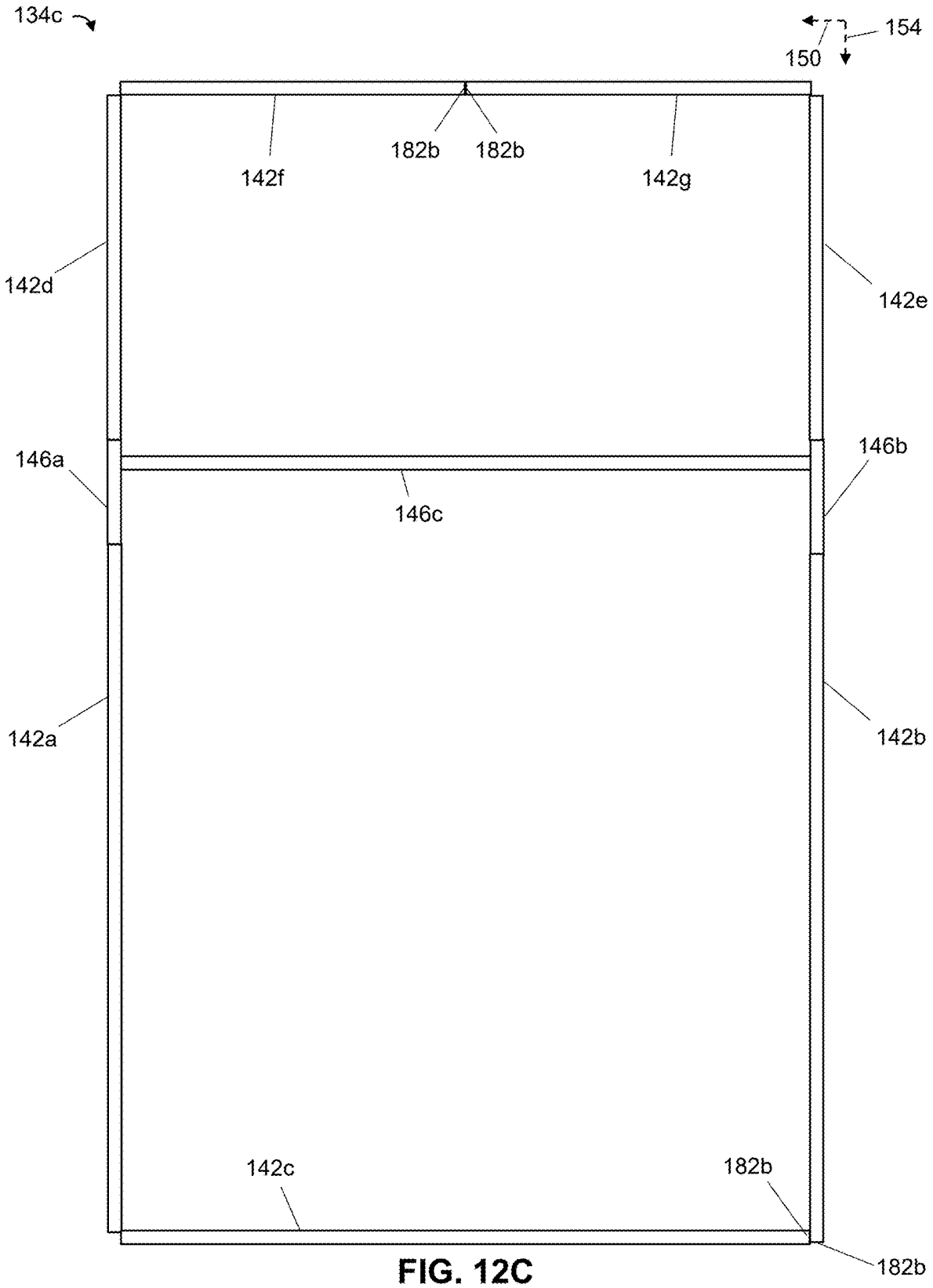
FIG. 12C is a top view of the wall assembly of FIG. 12A in the unfolded state.

Wall assemblies 134*a* and 134*b* can each comprise a single set of pivotable wall segments whose first and second pivotable wall segments 142*a* and 142*b* are pivotably coupled to first end 186*a* of first fixed wall segment 146*a* and first end 186*a* of second wall segment 146*b*, respectively. With such a configuration, wall segments 138 of each of wall assemblies 134*a* and 134*b* can comprise a third fixed wall segment 146*c* that is coupled to and extends between first and second wall segments 146*a* and 146*b* (e.g., between second ends 186*b* thereof) in lengthwise direction 150 (when the wall assembly is in the folded and unfolded states) such that the wall segments circumscribe interior volume 158 when the wall assembly is in the folded state and when the wall assembly is in the unfolded state. However, in other embodiments, there can be multiple sets of pivotable wall segments. For example, referring to FIGS. 12A-12C, shown is a third embodiment 134*c* of the present wall assemblies that is substantially the same as wall assembly 134*a*, the primary exception being that that wall assembly 134*c* has two sets of pivotable wall segments: a first set having first, second, and third pivotable wall segments 142*a*-142*c* that are the same as the pivotable wall segments of wall assembly 134*a*, and a second set having first, second, third, and fourth pivotable wall segments 142*d*-142*f* that are the same as the pivotable wall segments of wall assembly 134*b* except that the second set's first and second pivotable wall segments 142*d* and 142*e* have first ends 182*a* pivotably coupled to second end 186*b* of first fixed wall segment 146*a* and second end 186*b* of second fixed wall segment 146*b*, respectively. While as shown the two sets of pivotable wall segments can include different configurations of pivotable wall segments (e.g., that of wall assembly 134*a*'s set and that of wall assembly 134*b*'s set), in other embodiments both sets of pivotable wall segments can have the same configuration of pivotable wall segments (e.g., with both sets having the three-pivotable-wall configuration of wall assembly 134*a*'s set or both sets having the four-pivotable-wall configuration of wall assembly 134*b*'s set). Furthermore, while as shown each set of pivotable wall segments includes a third pivotable wall segment 142*c* or third and fourth pivotable wall segments 142*f* and 142*g*, in other embodiments each set can comprise only first and second pivotable wall segments (e.g., 142*a*-142*b* and 142*d*-142*e*) along with a movable wall segment that can be moved to extend between second ends 182*b* of the pivoted first and second pivotable wall segments as described above for wall assembly 134*a* and wall assembly 134*b*. As shown, by including multiple sets of pivotable wall segments, when wall assembly 134*c* moves from the folded state (FIG. 12A) to the unfolded state (FIG. 12C), it can achieve a larger increase in its width 166 than wall assemblies 134*a* and 134*b* (e.g., with the width increasing by an amount that is at least approximately equal to the combined lengths 178 of first pivotable wall segments 142*a* and 142*d* of the first and second sets and/or the combined lengths 178 of second pivotable wall segments 142*b* and 142*e* of the first and second sets). Wall assembly 134*c* can optionally comprise third fixed wall segment 146*c* extending between first and second fixed wall segments 146*a* and 146*b* in lengthwise direction 150 (when the wall assembly is in the folded and unfolded states), which can divide the resulting interior volume 158 into multiple living spaces.

Figure 13:
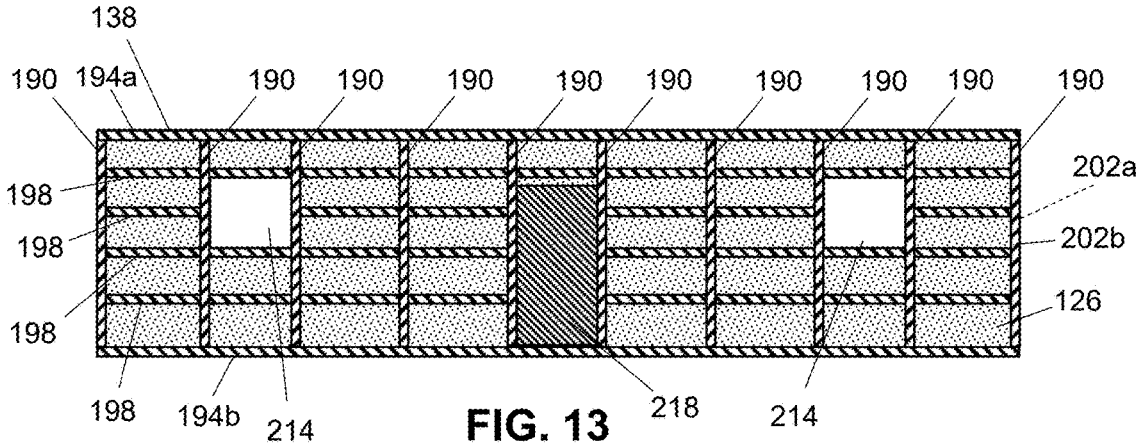
FIG. 13 is a cross-sectional view of a wall segment of the wall assembly of FIG. 10A taken along line 13-13 of FIG. 10B.

Referring to FIG. 13, shown is a structure that each of wall segments 138 (e.g., pivotable wall segments 142*a*-142*g* and/or fixed wall segments 146*a*-146*c*) can have. Wall segment 138 can have a frame comprising a plurality of vertically-extending studs 190, such as greater than or equal to any one of, or between any two of, ten, eleven, twelve, thirteen, fourteen, fifteen, sixteen, seventeen, eighteen, nineteen, twenty, or twenty-one vertically-extending studs, and a plurality of horizontally-extending supports 194*a*, 194*b*, and 198, such as greater than or equal to any one of, or between any two of, three, four, five, six, seven, eight, nine, or ten horizontally-extending supports, coupled to the studs in a manner that promotes the strength of the wall segment to mitigate damage during transport. As shown, the horizontally-extending supports can include upper and lower horizontally-extending supports 194*a* and 194*b* that can each extend between opposing first and second ends (e.g., 182*a* and 182*b*, if a pivotable wall segment, or 186*a* and 186*b*, if a fixed wall segment) of wall segment 138 (e.g., such that each defines a respective one of opposing lengthwise edges of the wall segment), which can promote the wall segment's resistance to bending moments during transport and installation. Each of studs 190 can extend between upper and lower horizontally-extending supports 194*a* and 194*b* to couple those supports together and support vertical compressive loads, with two of the studs optionally each disposed at a respective one of the opposing first and second ends of the wall (e.g., such that each defines a respective one of opposing heightwise edges of the wall segment). Furthermore, the horizontally-extending supports can include a plurality of intermediate supports 198 that are each disposed between upper and lower horizontally-extending supports 194*a* and 194*b* to facilitate the attachment of interior and/or exterior sheathing. Such sheathing can include, for example, one or more—optionally two or more—interior panels 206 (e.g., comprising steel and/or drywall panels) (FIG. 10A) coupled to a first side 202*a* of studs 190 (and intermediate supports 198) (e.g., which can be the interior side facing interior volume 158 of the wall assembly) and exterior siding 210 (e.g., comprising wood, polymer, aluminum, fiberglass, fiber cement board, stucco, brick, stone, and/or tiles) (FIG. 10B) coupled to second side 202*b* of the studs (and the intermediate supports) (e.g., which can be the exterior side facing away from interior volume 158 of the wall assembly). Studs 190 and supports 194*a*, 194*b*, and 198 can each comprise a relatively strong material to promote wall segment 138's strength and resistance to damage during transport, such as a metal like steel and/or aluminum, and can each comprise a tube (which can have, for example, a square, rectangular, or circular cross-section) to achieve a balance between strength and weight.

As shown, at least one—up to and including each—of wall segments 138 can have one or more features to permit viewing and/or access through the wall segment, such as one or more—optionally two or more—windows 214 and/or one or more—optionally two or more—doors 218. Furthermore, as with ceiling panel 90, at least one—up to and including each—of wall segments 138 can comprise insulation 126 that comprises a thermally-insulative material (e.g., a foam) and is disposed within the space between upper and lower supports 194*a* to mitigate heat transfer through the wall segment. And at least one—up to and including each—of wall segments 138 can comprise one or more utility distribution systems, such as an electrical distribution system (e.g., comprising one or more wires, conduits, junction boxes, and/or the like), a water distribution system (e.g., comprising one or more pipes for hot and/or cold water), and/or a sewage distribution system (e.g., comprising one or more pipes for sewage).

Figure 14:
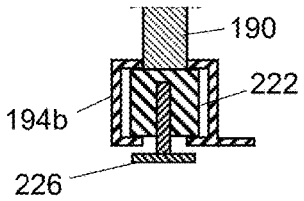
FIG. 14 is a cross-sectional view of a portion of the frame of the wall segment of FIG. 13 that includes a leveling system thereof.
Figure 15A:
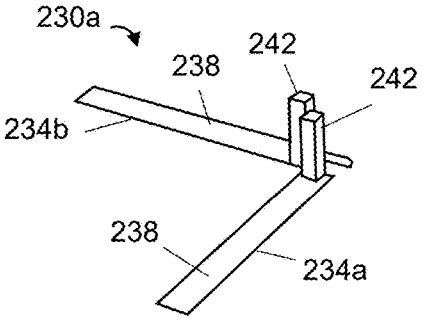
FIGS. 15A and 15B are perspective views of a first hinge usable to pivotably couple two of the wall segments of some of the present wall assemblies in folded and unfolded states, respectively.
Figure 15B:
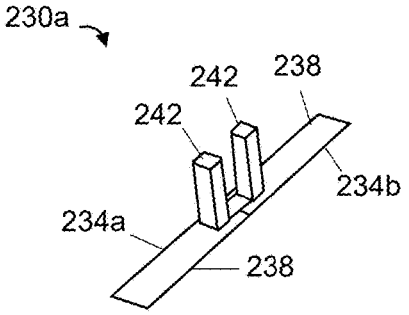

Referring to FIG. 14, to facilitate level installation of a wall assembly, each of wall segments 138 of the wall assembly can comprise one or more—optionally two or more—jacks 222 that can each be coupled to lower horizontally-extending support 194*b*. As shown, each jack 222 can be disposed in a channel of lower horizontally-extending support 194*b* and can underlie one of studs 190. Furthermore, each jack 222 can have a leg 226 configured to move vertically relative to lower horizontally-extending support 194*b* to adjust the lower horizontally-extending support's height relative to the ground at the jack. In this manner, leg 226 of each jack 222 can be adjusted to accommodate uneven terrain on which the wall assembly is installed to ensure that the wall assembly is even.

Referring to FIGS. 15A-15B and 16A-16B, shown are first and second hinges 230*a* and 230*b*, respectively, that can each be used to pivotably couple one of a wall assembly's pivotable wall segments (e.g., 142*a*-142*f*) to another one of the wall segments. As shown, hinges 230*a* and 230*b* can each comprise first and second couplings 234*a* and 234*b* that are pivotably coupled to one another, where each of the couplings can be coupled to one of wall segments 138. For example, each of couplings 234*a* and 234*b* can comprise a bar 238 that can be coupled to lower horizontally-extending support 194*b* of one of wall segments 138 and a protrusion 242 that can extend upwardly from the bar and can be coupled to one of the wall segment's studs. Couplings 234*a* and 234*b* of first hinge 230*a* can be pivotably coupled such that, when the wall assembly including the first hinge is in the folded state, bar 238 of the first coupling extends in lengthwise direction 150 and bar 238 of the second coupling extending in widthwise direction 154 (FIG. 15A), and when the wall assembly is in the unfolded state, the bars of the couplings each extend in the widthwise direction (FIG.

Figure 16A:
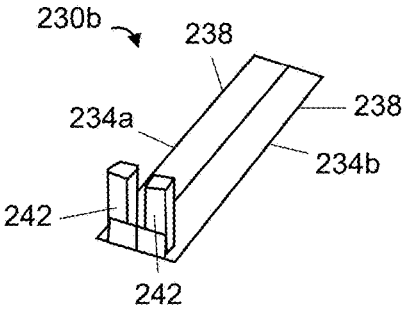
FIGS. 16A and 16B are perspective views of a second hinge usable to pivotably couple two of the wall segments of some of the present wall assemblies in folded and unfolded states, respectively.
Figure 16B:
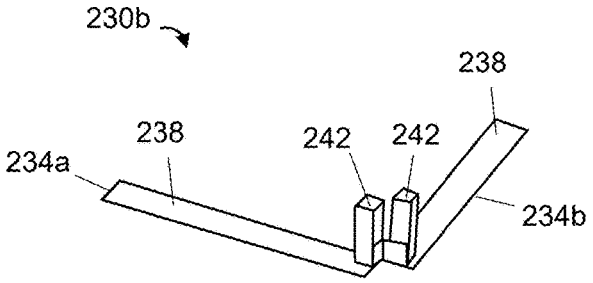

15B). First hinge 230*a* can be used to, for example, pivotably couple one of the pivotable wall segments to one of the widthwise-extending fixed wall segments (e.g., 146*a* or 146*b*) (e.g., with the first coupling coupled to the pivotable wall segment and the second coupling coupled to the fixed wall segment). Couplings 234*a* and 234*b* of second hinge 230*b* can be pivotably coupled such that, when the wall assembly including the second hinge is in the folded state, bar 238 of the first coupling and bar 238 of the second coupling each extend in lengthwise direction 150 (FIG. 16A), and when the wall assembly is in the unfolded state, the bar of the first coupling can extend in widthwise direction 154 and the bar of the second coupling can extend in the lengthwise direction (FIG. 16B). Second hinge 230*b* can be used to, for example, pivotably couple one of the pivotable wall segments to another one of the pivotable wall segments.

Figure 17A:
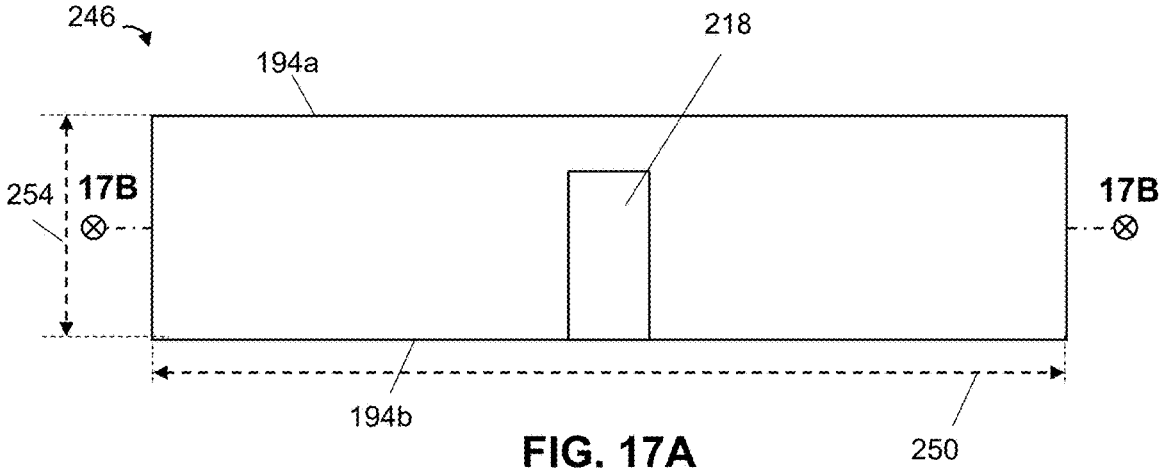
FIG. 17A is a front view of one of the present prefabricated walls.
Figure 17B:
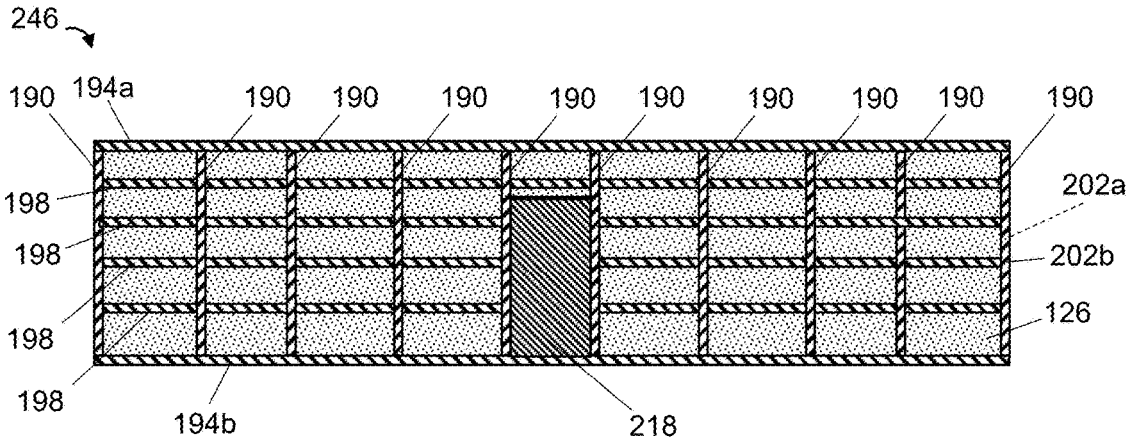
FIG. 17B is a sectional view of the prefabricated wall of FIG. 17A taken along line 17B-17B of FIG. 17A.

Because a wall assembly (e.g., 134*a*-134*c*) can have an interior volume 158 when in the folded state, one or more components for constructing the building can be disposed in the interior volume during transport, such as one or more of the present roof trusses (e.g., 10*a*-10*e*), roof assemblies (e.g., 82*a*-82*b*), roof panels (e.g., 86), and/or ceiling panels (e.g., 90). Some systems can include one or more prefabricated building components that can interface with and architecturally enhance some of the present expandable components. Referring to FIGS. 17A and 17B, for example, some systems can include one or more prefabricated walls 246 that can, for example, each be coupled to at least one of the walls defined by one of the present wall assemblies when in the unfolded state and can each be disposed in interior volume 158 circumscribed by those walls (e.g., to define one or more rooms therein). As shown, each prefabricated wall 246 can have the frame structure of a wall segment 138 (e.g., with vertically-extending studs 190 coupled to horizontally-extending supports 194*a*, 194*b*, and 198 as described above), can have one or more features to permit viewing and/or access through the prefabricated wall (e.g., one or more doors 218, as shown, and/or at least one window), and insulation 126. Each prefabricated wall 246 can be sized to fit within interior volume 158 of a wall assembly when the wall assembly is in the folded state. For example, a length 250 of prefabricated wall 246 can be less than or equal to any one of, or between any two of, 60, 55, 50, 45, 40, 35, 30, or 25 feet (e.g., between 27 and 50 feet) and a height 254 of the prefabricated wall can be approximately the same as height 170 of a wall assembly, such as greater than or equal to any one of, or between any two of, 7, 8, 9, 10, 11, or 12 feet.

Figure 18A:
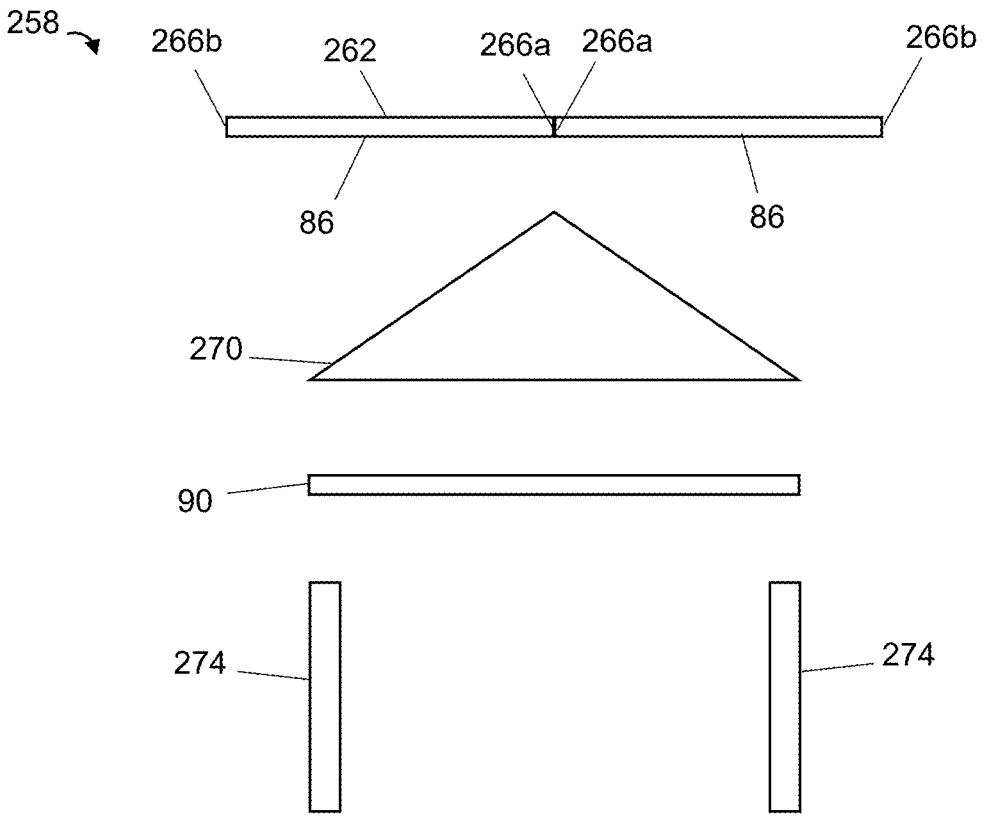
FIGS. 18A and 18B are front views of one of the present porch assemblies when unassembled and assembled, respectively.
Figure 18B:
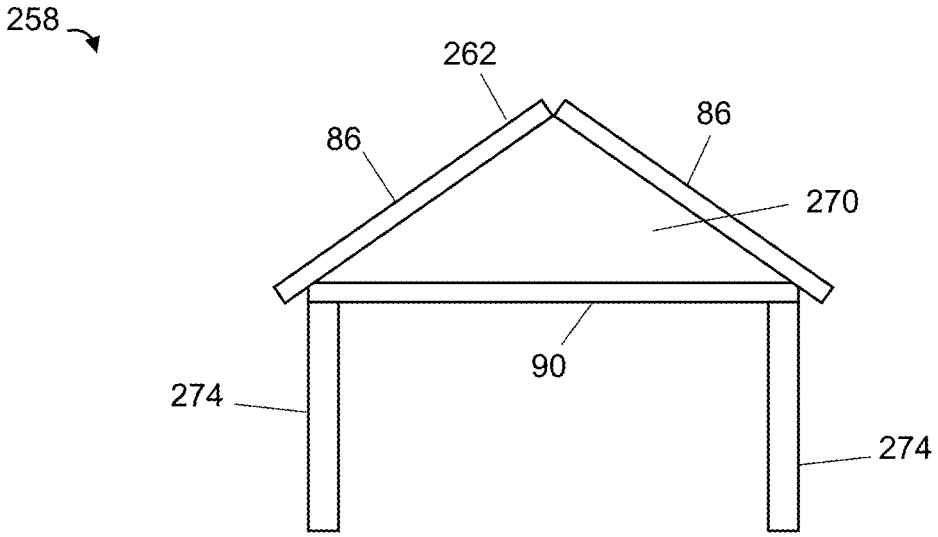

Referring to FIGS. 18A and 18B, some systems can include a porch assembly 258 that can be coupled to a building constructed using some of the present components to enhance its exterior appearance. Porch assembly 258 can include components that can remain disassembled during transport and have a compact configuration for transport (e.g., to fit within interior volume 158 of a wall assembly) but can be readily assembled and deployed during construction. As shown, porch assembly 258 can comprise a roof 262 having two roof panels 86 (e.g., any of those described above) that each extend between first and second ends 266*a* and 266*b*, where the first end of each roof panel is pivotably coupled to the first end of the other of the roof panels such that the roof is movable between a flat state in which the roof panels are substantially parallel (FIG. 18A) and a deployed state in which the roof panels are angularly disposed (FIG. 18B). Porch assembly 258 can also comprise a support 270 having two angularly-disposed edges that roof panels 86 of roof 262 can be coupled to and overlie when the roof is in the deployed state. Additionally, porch assembly 258 can comprise a ceiling panel 90 (e.g., any of those described above) that can be coupled to a lower edge of support 270, and two support posts 274 that can each be coupled to and extend vertically downward from ceiling panel 90 to support porch assembly 258. Some systems can also comprise a wall protrusion assembly that is substantially the same as porch assembly 258 except that it includes—instead of support posts 274—two side walls that can each be coupled to and extend away from a wall of a deployed wall assembly (e.g., 134*a*-134*c*) and a front wall (e.g., comprising) that can be coupled to and extend between the side walls, with the side and front walls coupled to and underlying ceiling panel 90 to define a protruding portion of the building.

Figure 19A:
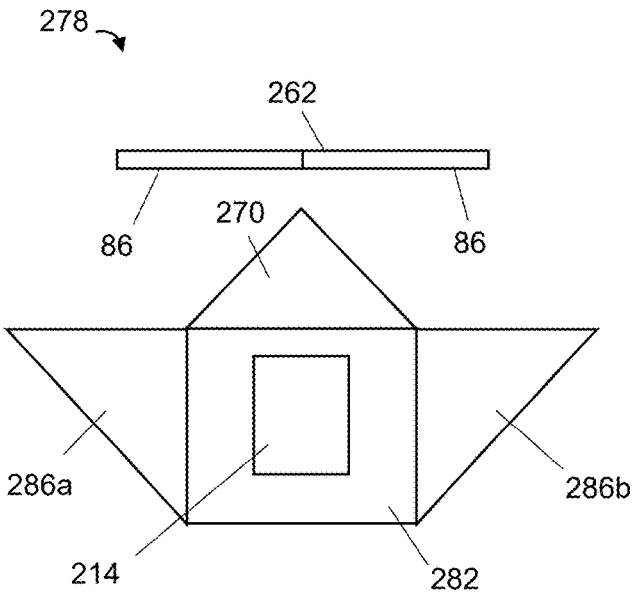
FIGS. 19A and 19B are front views of one of the present dormer assemblies when unassembled and assembled, respectively.
Figure 19B:
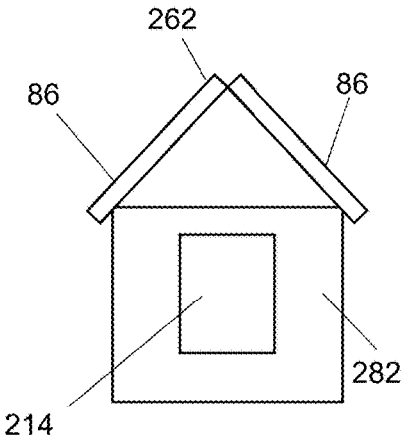
Figure 20A:
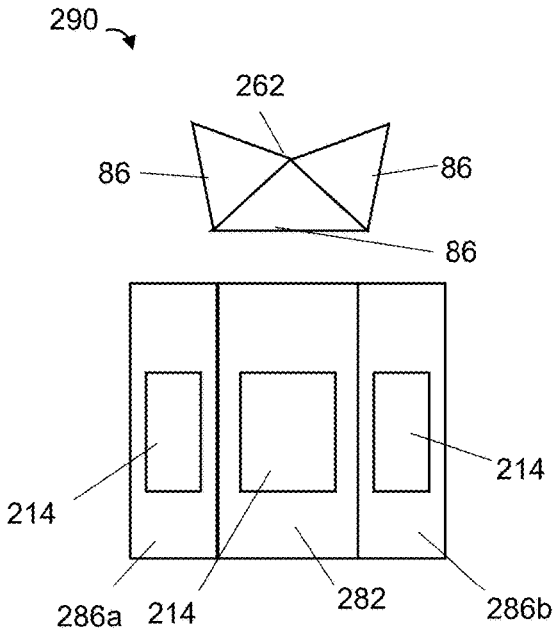
FIGS. 20A and 20B are front views of one of the present bay window assemblies when unassembled and assembled, respectively.
Figure 20B:
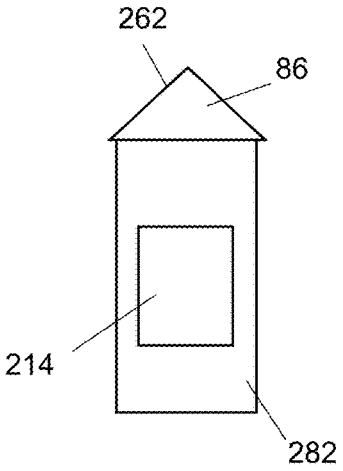

Referring to FIGS. 19A-19B and 20A-20B, some systems can include a dormer assembly 278 (FIGS. 19A-19B) and/or a bay window assembly 290 (FIGS. 20A-20B) that can each be expandable such that the assembly can remain flat during transport (FIGS. 19A and 20A) for space savings (e.g., to fit within interior space 158 of a wall assembly) and be moved to and assembled into a deployed state (FIGS. 19B and 20B) for use in the construction of a building to enhance its architectural appeal. As shown, dormer assembly 278 and bay window assembly 290 can each comprise a central wall 282 and two side walls 286*a* and 286*b* that are each pivotably coupled to a respective one of opposing heightwise edges of the central wall such that the central wall and side walls are movable between a flat state in which the outer surfaces of the walls are substantially parallel (FIGS. 19A and 20A) and a deployed state in which the outer surface of each of the side walls is angularly disposed (e.g., substantially perpendicular to) the outer surface of the central wall (FIGS. 19B and 20B) to mate with, for example, a wall or roof of the building. Dormer assembly 278 and bay window assembly 290 can each comprise one or more windows 214 to permit viewing therethrough; for example, the dormer assembly's central wall 282 can include a window, and the bay window assembly's central and side walls 282, 286*a*, and 286*b* can each include a window. Furthermore, dormer assembly 278 and bay window assembly 290 can each comprise a roof 262 that can remain detached from walls 282, 286*a*, and 286*b* during transport and can comprise pivotably-coupled roof panels 86 such that, as with the roof of porch assembly 258, the roof is movable between flat and deployed states. As shown, dormer assembly 278's roof 262 can have two roof panels 86 pivotably coupled in the same way that the roof panels of porch assembly 258's roof, with the dormer assembly comprising a support 270 coupled to and overlying central wall 282 and having two edges that can each be coupled to and underlie a respective one of the roof panels when the roof is in the deployed state (FIG. 19B). Bay window assembly 290's roof 262 can have three roof panels 86 that can each have a triangular rather than a rectangular planform and can pivot relative to one another from the flat state (FIG. 20A) to the deployed state (FIG. 20B) in each of the roof panels can be coupled to and overlie a respective one of the upper edges of central and side walls 282, 286*a*, and 286*b*.

Figure 21A:
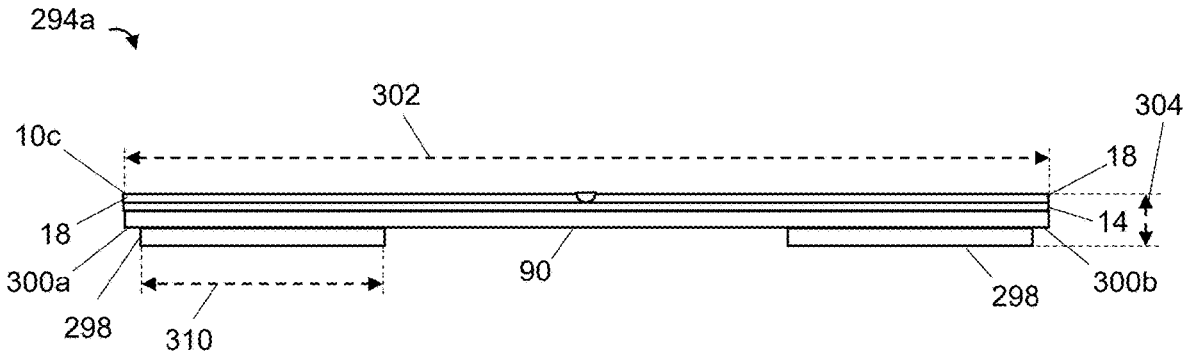
FIGS. 21A-21C are front, top, and bottom views, respectively, a first embodiment of the present building assemblies that includes four of the roof trusses of FIGS. 3A-3C, the ceiling panel of FIG. 8A fixed to the lower chord of each of the roof trusses, and two walls that are each coupled to the ceiling panel and pivotable between a stowed position and a deployed position.
Figure 21B:
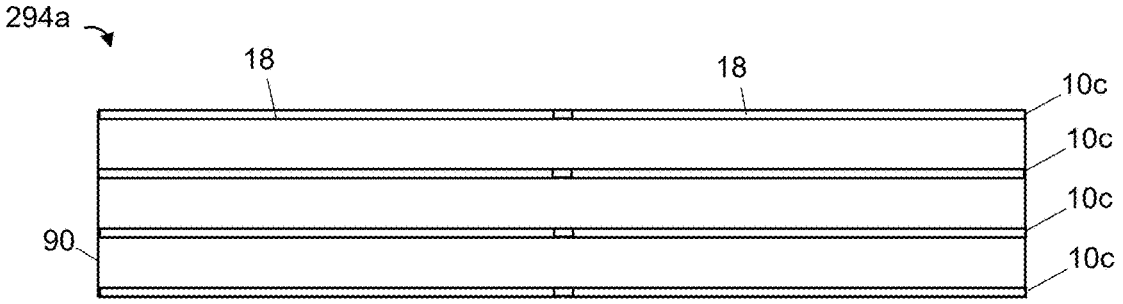
Figure 21C:
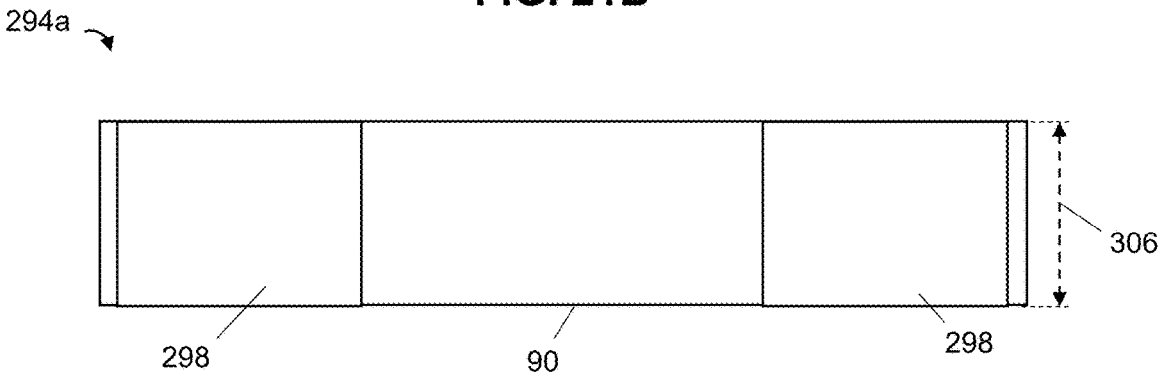
Figure 21D:
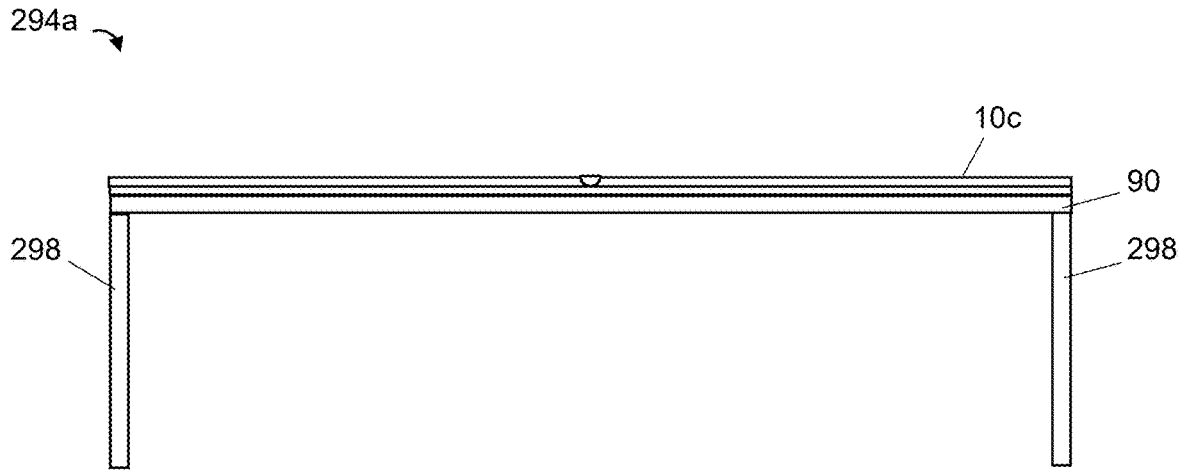
FIG. 21D is a front view of the building assembly of FIGS. 21A-21C when the walls are in the deployed position and the roof trusses are in the collapsed state.
Figure 21E:
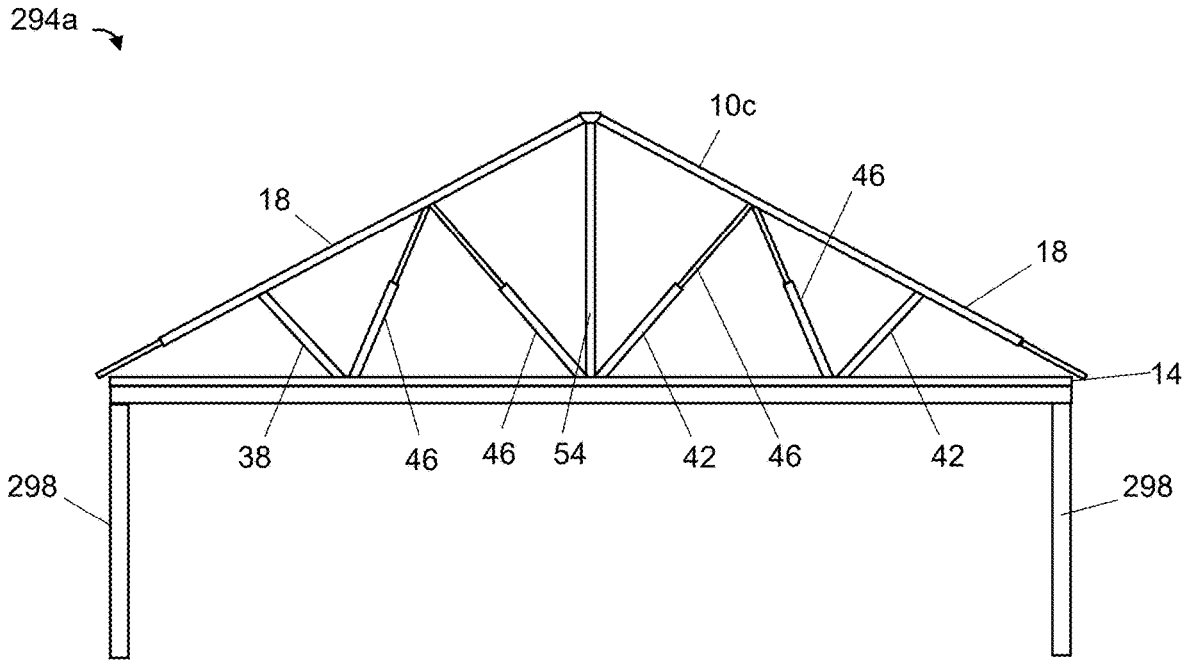
FIG. 21E is a front view of the building assembly of FIGS. 21A-21C when the walls are in the deployed position and the roof trusses are in the expanded state.

Referring to FIGS. 21A-21E, shown is a first embodiment 294*a* of the present building assemblies, which can include both wall and roof components and can be vertically expandable to allow rapid construction of a building using one or more of such building assemblies. To allow for rapid roof construction and provide an already-constructed ceiling, building assembly 294*a* can comprise two or more roof trusses—such as greater than or equal to any one of, or between any two of, two, three, four, five, six, seven, eight, nine, ten, eleven, or twelve roof trusses—that can each comprise a lower chord 14 to which a first one of one or more ceiling panels 90 (e.g., any of those described above) of the building assembly can be fixed (e.g., to underlie the lower chord). To permit building assembly 294*a* to have a compact form for transport and to expand for building construction, the building assembly can comprise two or more walls 298—which can be made up of one or more, optionally two or more, pairs of the walls—that can each be coupled to one of ceiling panel(s) 90 and can each be pivotable between a stowed position in which the wall is substantially parallel to the first ceiling panel (FIGS. 21A-21C) and a deployed position in which the wall is substantially perpendicular to the first ceiling panel (FIGS. 21D and 21E). For example, in the embodiment shown, building assembly 294*a* can comprise a single pair of walls 298, where each of the walls of the pair is pivotably coupled to a respective one of opposing ends 300*a* and 300*b* of first ceiling panel 90 between which the ceiling panel's length extends. With walls 298 in the stowed position, building assembly 294*a* can have a relatively compact thickness 304, such as a thickness that is less than or equal to any one of, or between any two of, 6, 5.5, 5, 4.5, 4, 3.5, 3, 2.5, or 2 feet (e.g., less than or equal to 3.5 feet). When walls 298 are moved to the deployed position, a height of building assembly 294*a* can increase by an amount that, for each pair of walls, is at least approximately equal to length 310 of each of the walls of the pair, which can be, for example, greater than or equal to any one of, or between any two of, 8, 10, 12, 14, 16, 18, 20, 22, 24, 26, 28, 30, 32, 34, 36, 38, 40, 42, 44, 46, 48, 50, 52, 54, 56, 58, or 60 feet to yield adequate clearance for one or more living spaces. Length 310 of each of walls 298 can thus be chosen based on the desired height of building assembly 294*a* and any living space(s) therein when deployed; for example the length of each of the walls of a pair can be more-compact (e.g., between 8 and 16 feet) when defining a single-story living space between the walls or larger (e.g., between 30 and 53 feet or about 40 feet) when defining a multi-story living space as described in further detail below.

A planform of building assembly 294*a* can, as with other ones of the above-described building components, be sized to, for example, permit transport thereof with a truck and/or in an ISO container when its walls 298 are in the stowed position. For example, width 306 of building assembly 294*a* can be less than or equal to any one of, or between any two of, 40%, 35%, 32.5%, 30%, 27.5%, 25%, 22.5%, 20% or 17.5% (e.g., less than or equal to 30%) of the building assembly's length 302 when the building assembly's walls 298 are in the stowed position, such as with the width being less than or equal to any one of, or between any two of, 16, 15, 14, 13, 12, 11, 10, 9, 8, or 7 feet (e.g., less than or equal to 102 inches or between 7 and 10 feet) and the length being greater than or equal to any one of, or between any two of, 20, 25, 30, 35, 40, 45, 50, 55, 60, 65, 70, 75, or 80 feet (e.g., between 30 and 53 feet or about 40 feet). To promote a compact planform, in the embodiment shown walls 298 do not extend beyond widthwise edges of first ceiling panel 90, e.g., with each of the walls underlying the first ceiling panel and having a length 310 that is less than or approximately equal to length 302 of building assembly 294*a*, such as a length that is less than or equal to any one of, or between any two of, 90%, 80%, 70%, 60%, 50%, 40%, or 30% of the building assembly's length.

Figure 22A:
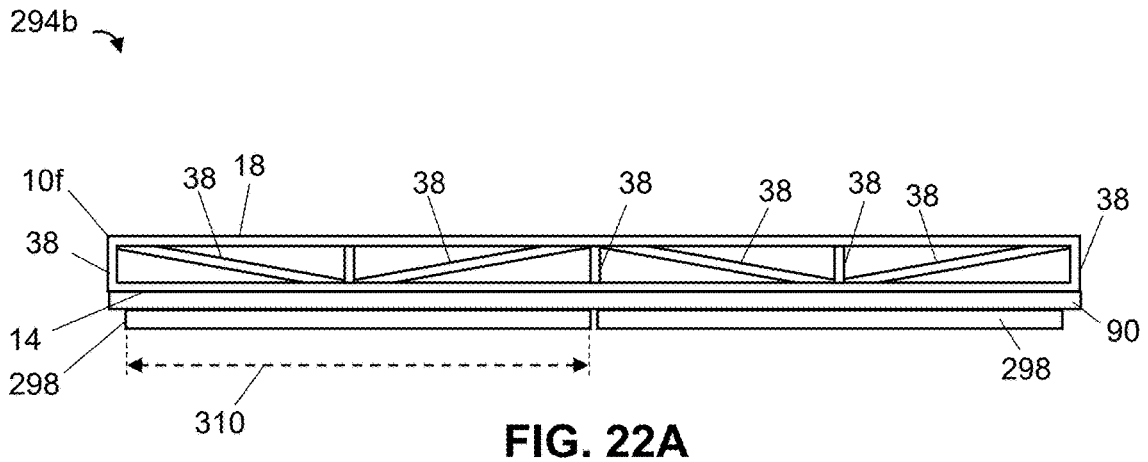
FIG. 22A is a front view of a second embodiment of the present building assemblies that is substantially the same as the building assembly of FIG. 21A, the primary exception being that the roof trusses of the building assembly of FIG. 22A are not expandable.
Figure 22B:
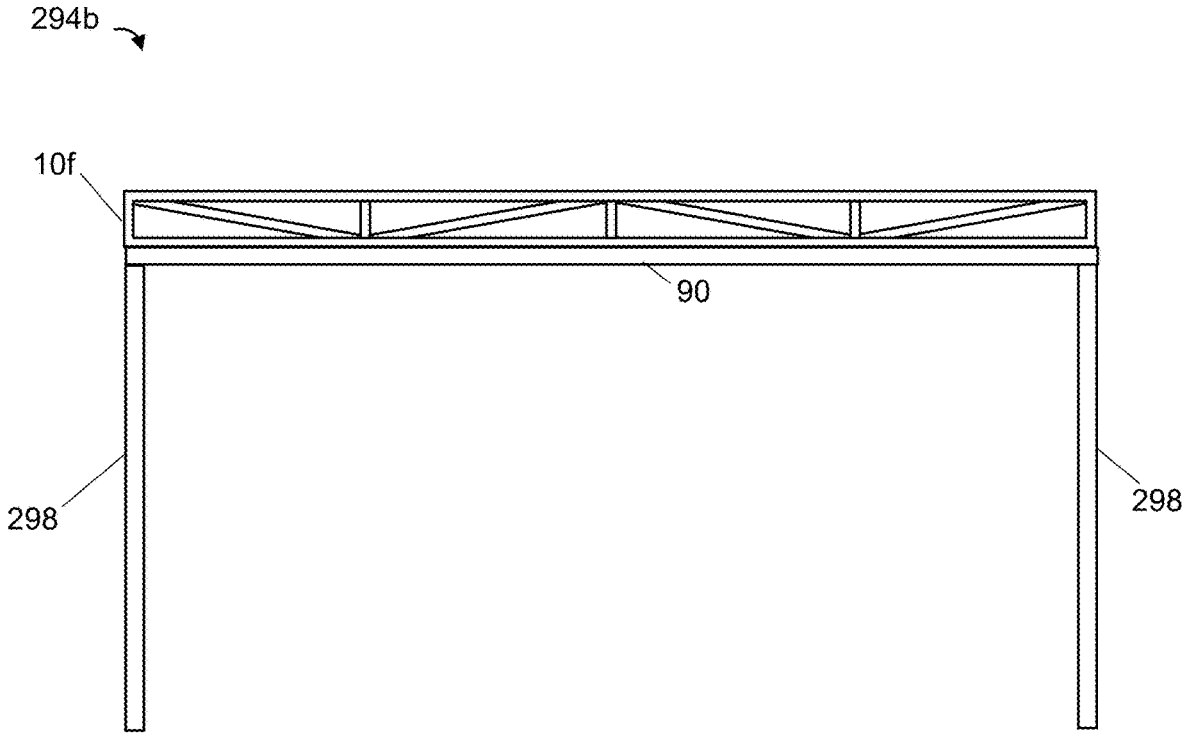
FIG. 22B is a front view of the building assembly of FIG. 22A when the walls are in the deployed position.

Building assembly 294*a* can comprise any suitable roof trusses, which can each have—in addition to a lower chord 14—one or more upper chords 18 and a plurality of braces 38 that can each extend between and be coupled to one of the upper chord(s) and the lower chord. For example, building assembly 294*a*'s roof trusses can be any of the above-described expandable roof trusses (e.g., 10*a*-10*e*) having two upper chords 18 such that that roof trusses can be moved between the collapsed state (FIG. 21D) and the expanded state (FIG. 21E) to define a pitched roof (e.g., after moving walls 298 from the stowed position to the deployed position); as shown, the building assembly has a plurality of roof trusses 10*c*. Such expandable roof trusses can optionally have, for each of upper chords 18, a roof panel 86 coupled to and overlying the upper chord such that building assembly 294*a* includes one of the present roof assemblies (e.g., 82*a*) (e.g., with first ceiling panel 90 being the ceiling panel of the roof assembly). However, referring to FIGS. 22A and 22B that shown a second embodiment 294*b* of the present building assemblies that is substantially the same as building assembly 294*a*, in other embodiments the building assembly's roof trusses can each have a single upper chord 18 that is substantially parallel to lower chord 14. As shown, building assembly 294*b*'s roof trusses 10 are each a non-expandable roof truss whose braces 38 are fixed relative to its lower and upper chords 14 and 18, but in another embodiments one or more (e.g., two or more) of the braces can be expandable braces 46 to allow the upper chord and lower chord to be moved apart to increase the height of the truss as described above.

Figure 23A:
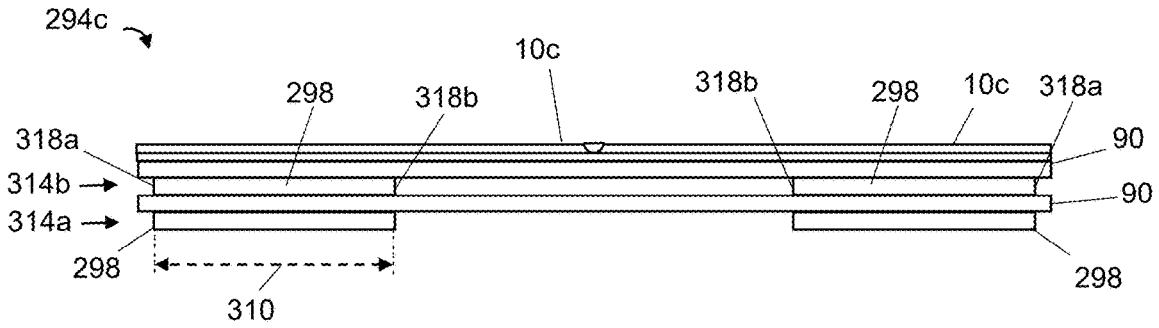
FIG. 23A is a front view of a third embodiment of the present building assemblies that is substantially the same as the building assembly of FIG. 21A, the primary exception being that the building assembly of FIG. 23A includes two ceiling panels and four walls pivotable between stowed and deployed positions, where two of the walls each have an end slidably coupled to one of the ceiling panels that underlies the wall when the wall is in the stowed position.
Figure 23B:
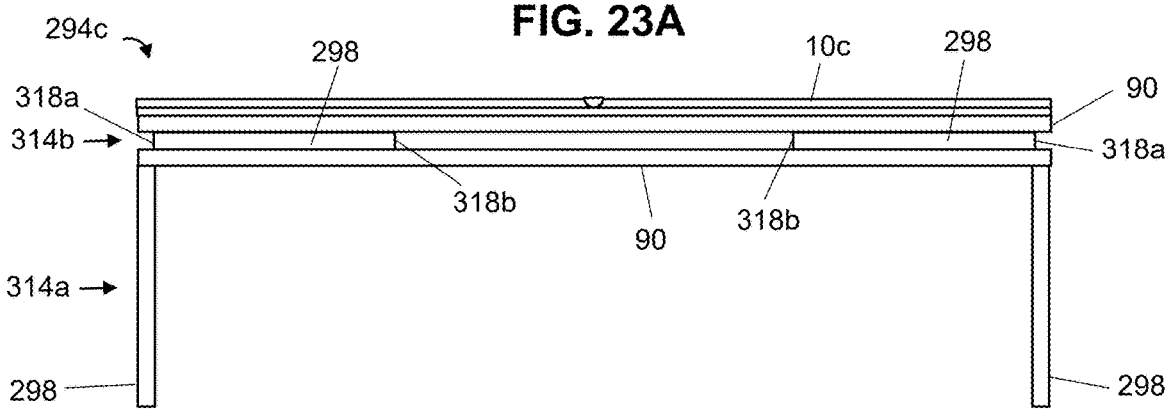
FIG. 23B is a front view of the building assembly of FIG. 23A when two of the walls are in the deployed position, two of the walls are in the stowed position, and the roof trusses are in the collapsed state.
Figure 23C:
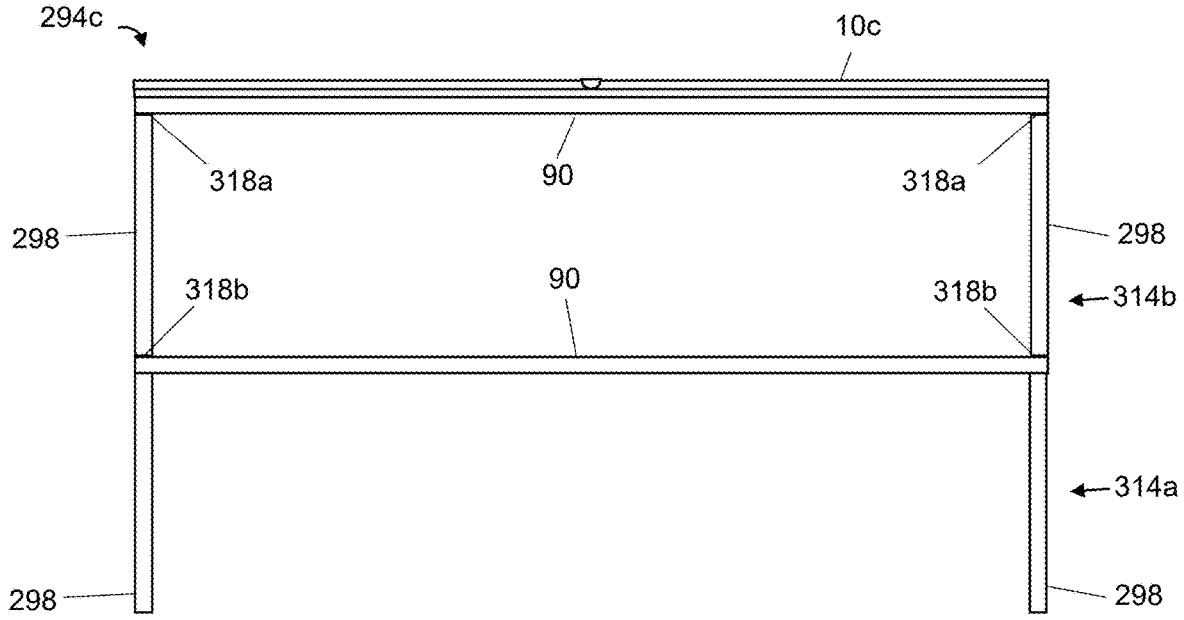
FIG. 23C is a front view of the building assembly of FIG. 23A when the walls are in the deployed position and the roof trusses are in the collapsed state.
Figure 23D:
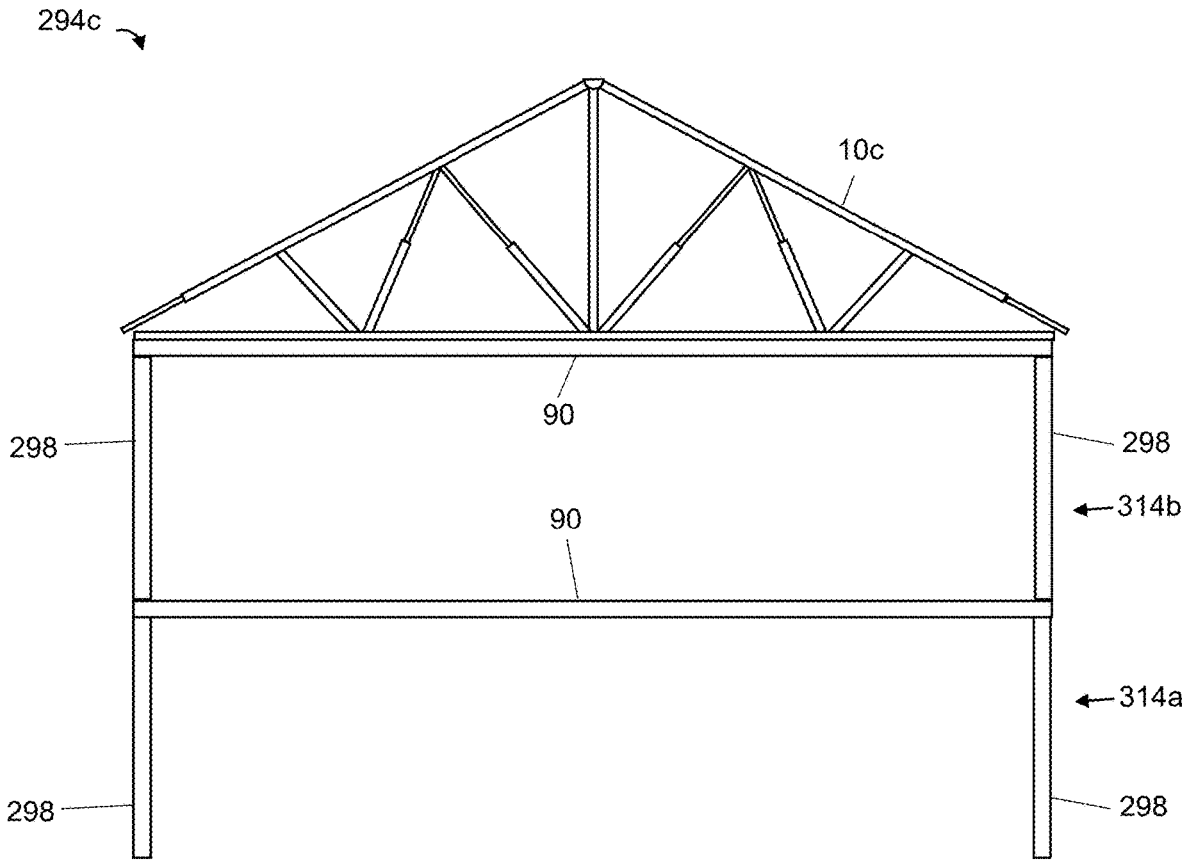
FIG. 23D is a front view of the building assembly of FIG. 23A when the walls are in the deployed position and the roof trusses are in the collapsed state.
Figure 24A:
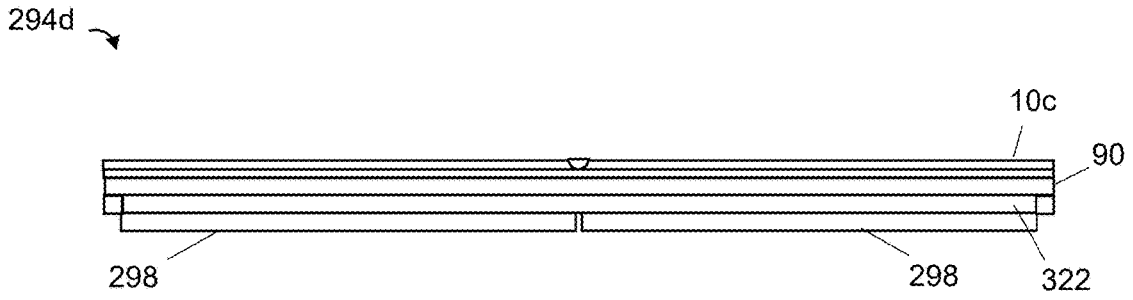
FIG. 24A is a front view of a fourth embodiment of the present building assemblies that is substantially the same as the building assembly of FIG. 21A, the primary exception being that the building assembly of FIG. 24A includes two ceiling panels, at least one of which is a slidable ceiling panel that is vertically slidable along the walls between which it extends when the walls are in the deployed position.
Figure 24B:
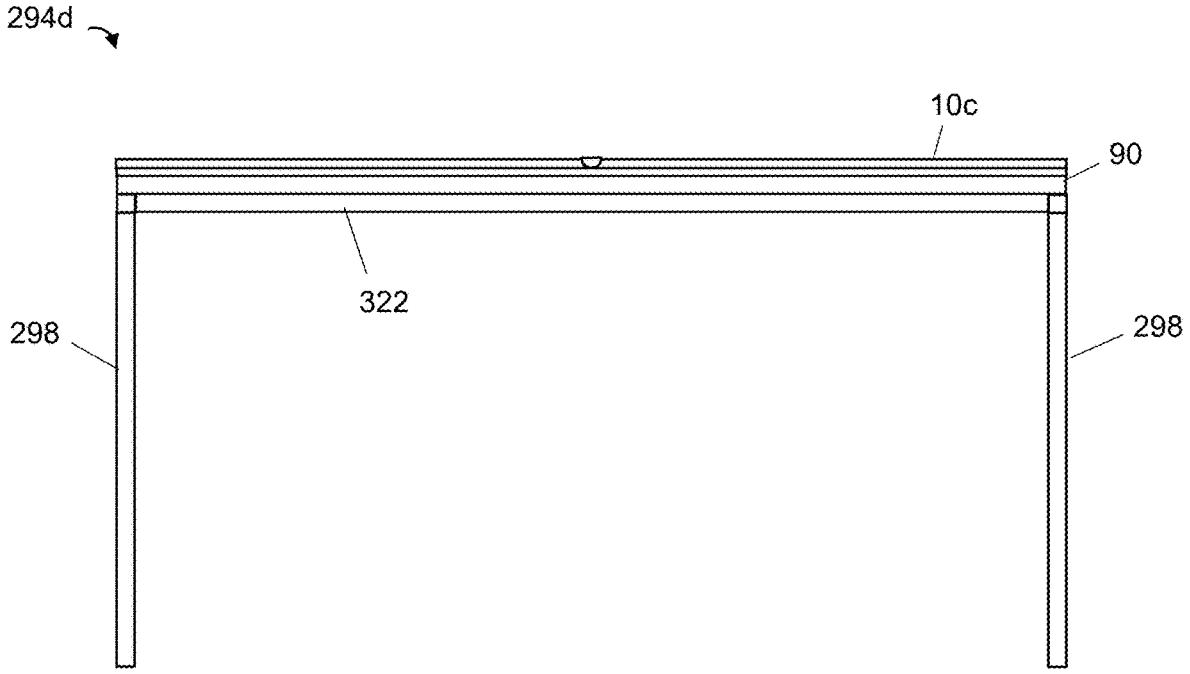
FIGS. 24B and 24C are front views of the building assembly of FIG. 24A when the walls are in the deployed position and the roof trusses are in the collapsed state and illustrate sliding of the slidable ceiling panel along the walls.
Figure 24C:
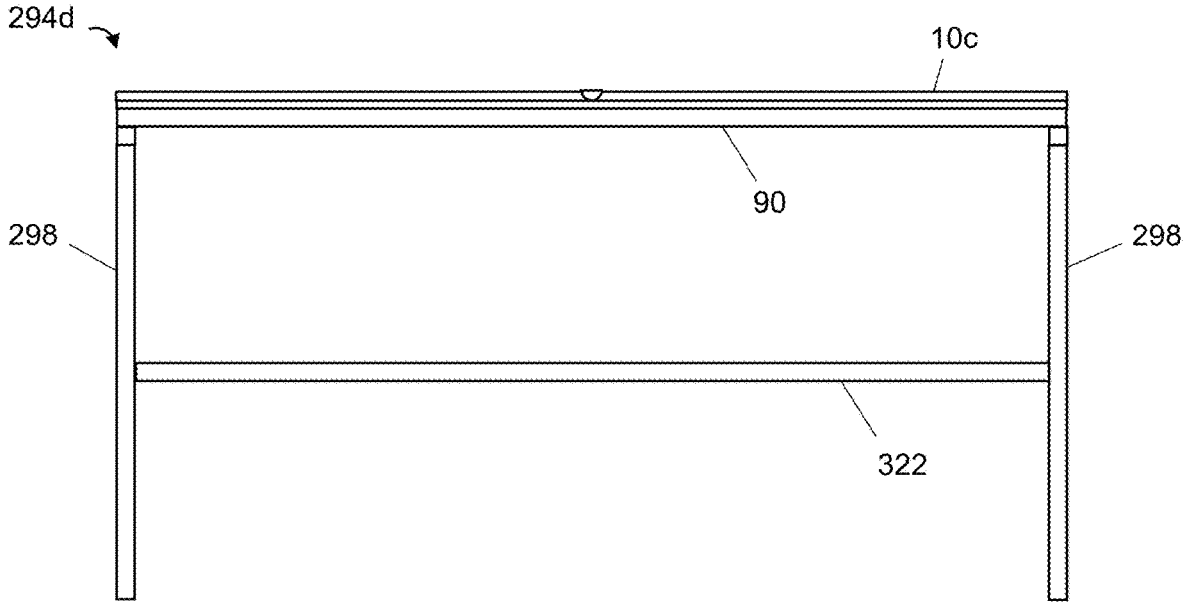
Figure 24D:
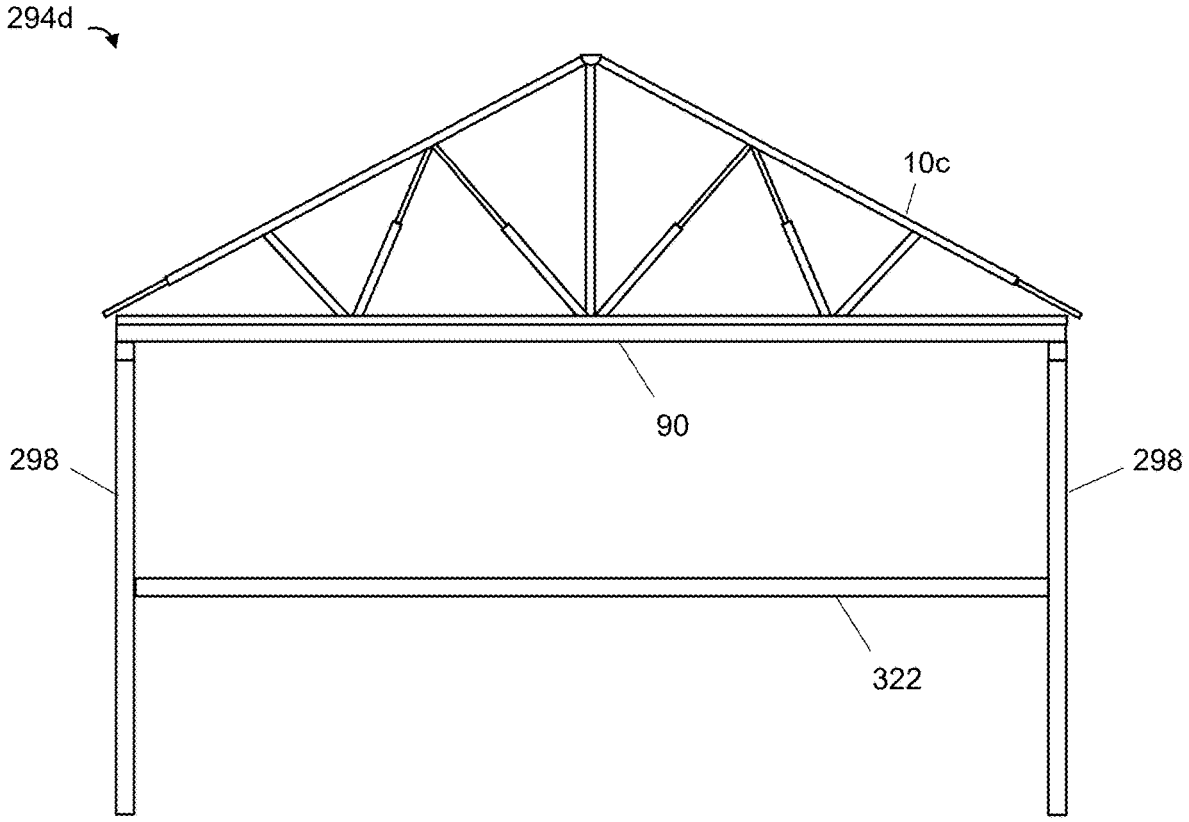
FIG. 24D is a front view of the building assembly of FIG. 24A when the walls are in the deployed position, the slidable ceiling panel has been slid vertically downward along the walls, and the roof trusses are in the expanded state.
Figure 25A:
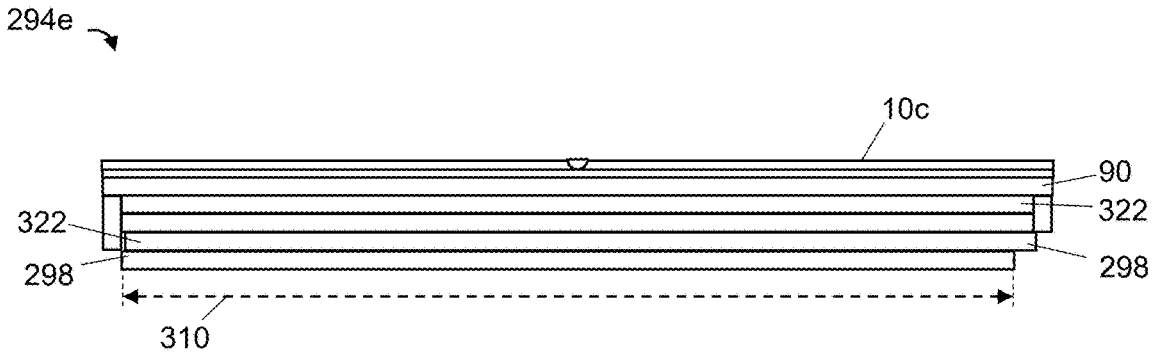
FIG. 25A is a front view of a fifth embodiment of the present building assemblies that is substantially the same as the building assembly of FIG. 21A, the primary exception being that each of the pivotable walls of the building assembly of FIG. 25A has a length that is substantially the same as a length of the building assembly and the FIG. 25A building assembly has two slidable ceiling panels.
Figure 25B:
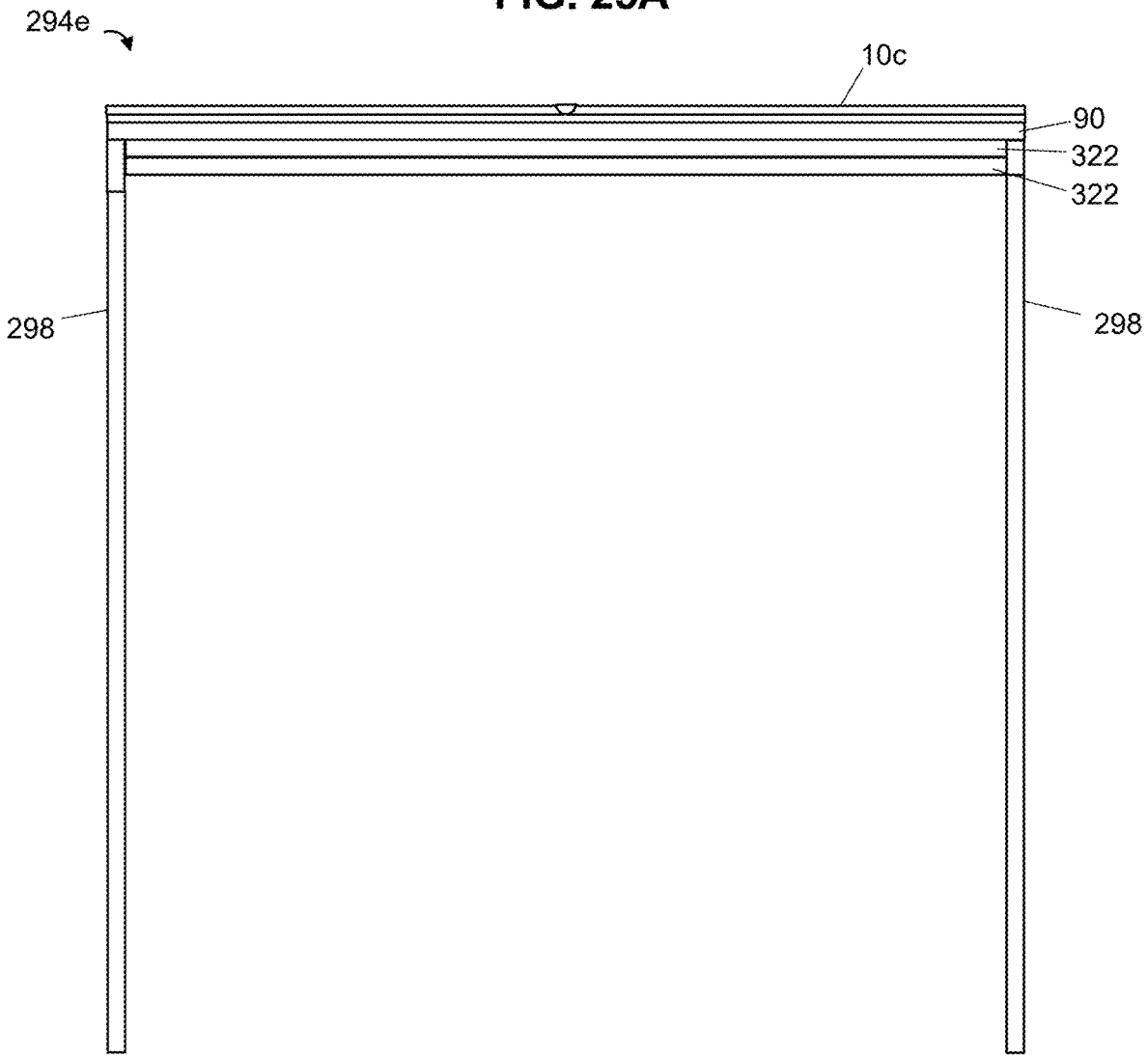
FIGS. 25B and 25C are front views of the building assembly of FIG. 25A when the walls are in the deployed position and the roof trusses are in the collapsed state and illustrate sliding of the slidable ceiling panels along the walls.
Figure 25C:
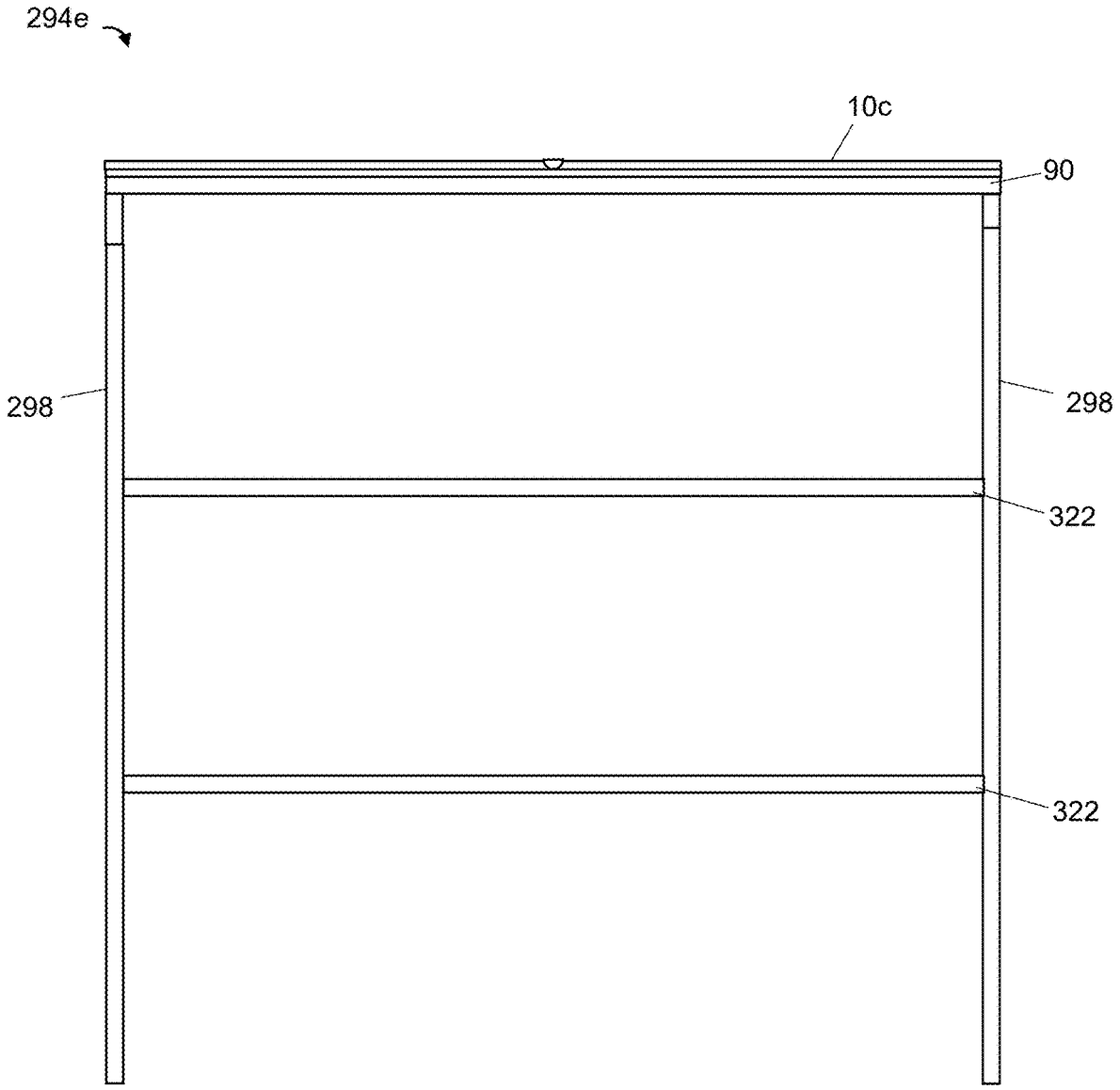
Figure 25D:
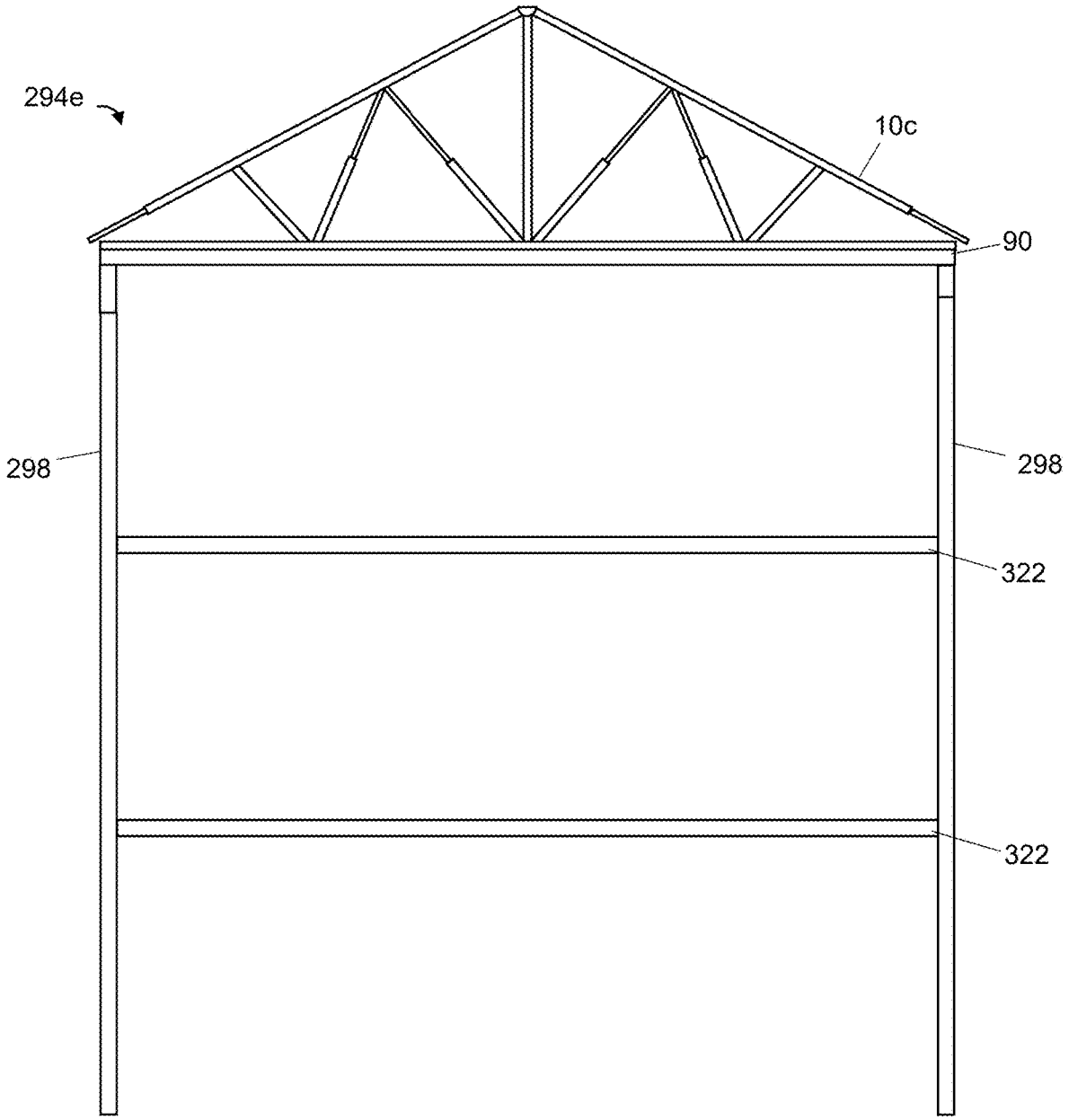
FIG. 25D is a front view of the building assembly of FIG. 25A when the walls are in the deployed position, the slidable ceiling panels have been slid vertically downward along the walls, and the roof trusses are in the expanded state.

In some building assemblies, there can be multiple (e.g., two or more) ceiling panels 90 for the construction of a multi-story building. Referring to FIGS. 23A-23D, shown is a third embodiment 294*c* of the present building assemblies that, while otherwise substantially the same as building assembly 294*a*, has two or more ceiling panels 90. As shown, walls 298 can comprise four or more walls that include two or more pairs 314*a* and 314*b* of walls, where for at least one of the pairs of walls (e.g., second pair 314*b* of walls disposed between two of ceiling panels 90, in the embodiment shown), each of the walls of the pair has a first end 318*a* pivotable coupled to one of ceiling panels that overlies the wall when the wall is in the stowed position and a second end 318*b* slidably coupled to one of the ceiling panels that underlies the wall when the wall is in the stowed position. To deploy building assembly 294*c*, the building assembly can be lifted to allow walls 298 of first pair 314*a* to be pivoted to the deployed position (FIG. 23B), and ceiling panel 90 that overlies the walls of second pair 314*b* can be lifted to cause each of the walls of the second pair to pivot at its first end 318*a* while its second end 318*b* slides along the ceiling panel that underlies the wall when the wall is in the stowed position (FIG. 23C). The deployment of walls 298 of second pair 214*b* can thus yield vertical separation between ceiling panels 90 between which the second pair's walls were disposed when in the stowed position to define a living space that can be, for example, above a ground-floor living space.

Referring to FIGS. 24A-24D, shown is another embodiment 294*d* of the present building assemblies that can also include two or more ceiling panels 90 and can also be otherwise substantially the same as building assembly 294*a*. To allow building assembly 294*d*'s ceiling panels 90—which can each overlie walls 298 when the walls are in the stowed position—to be vertically spaced apart to define multi-story living spaces, the ceiling panels can include at least one slidable ceiling panel 322. When walls 298 of building assembly 294*d* are each in the deployed position (FIG. 24B), each of slidable ceiling panel(s) 322 can be configured to slide vertically along two of walls 298 between which the slidable ceiling panel extends (FIG.

24C), after which the slidable ceiling panel can be fixed relative to the walls to keep it in place. While in the embodiment shown building assembly 294*d* only has one slidable ceiling panel 322, referring to FIGS. 25A-25D—which show an embodiment 294*e* of the present building assemblies that substantially the same as building assembly 294*d*—in other embodiments there can be two or more slidable ceiling panels that can each be vertically slid relative to walls 298 between which the slidable ceiling panel extends to define additional floors. When providing for more floors, walls 298 each preferably have a larger length 310 to allow for adequate vertical spacing between ceiling panels 90; for example, while the length of each of walls 298 of building assembly 294*d* can be approximately equal to half of the building assembly's length 302 when the walls are each in the stowed position, the length of each of the walls of building assembly 294*e* (which has more ceiling panels 90 and thus more floors than building assembly 294*d*) can be approximately the same as the building assembly's length when the walls are each in the stowed position.

Figure 26A:
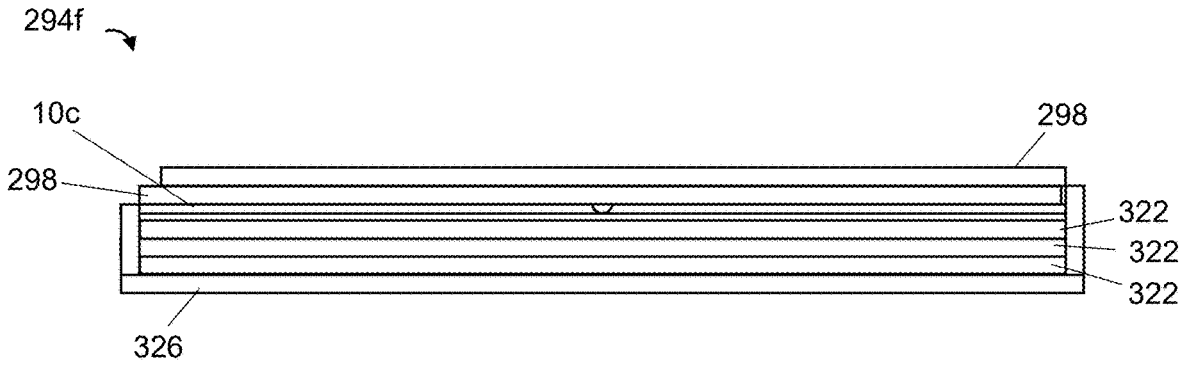
FIG. 26A is a front view of a sixth embodiment of the present building assemblies that is substantially the same as the building assembly of FIG. 25A, the primary exception being that each the walls of the building assembly overlies the roof trusses and the ceiling panels when the wall is in the stowed position and each of the slidable ceiling panels and each of the roof trusses is configured to slide vertically upward along the walls when the walls are each in the deployed position.
Figure 26B:
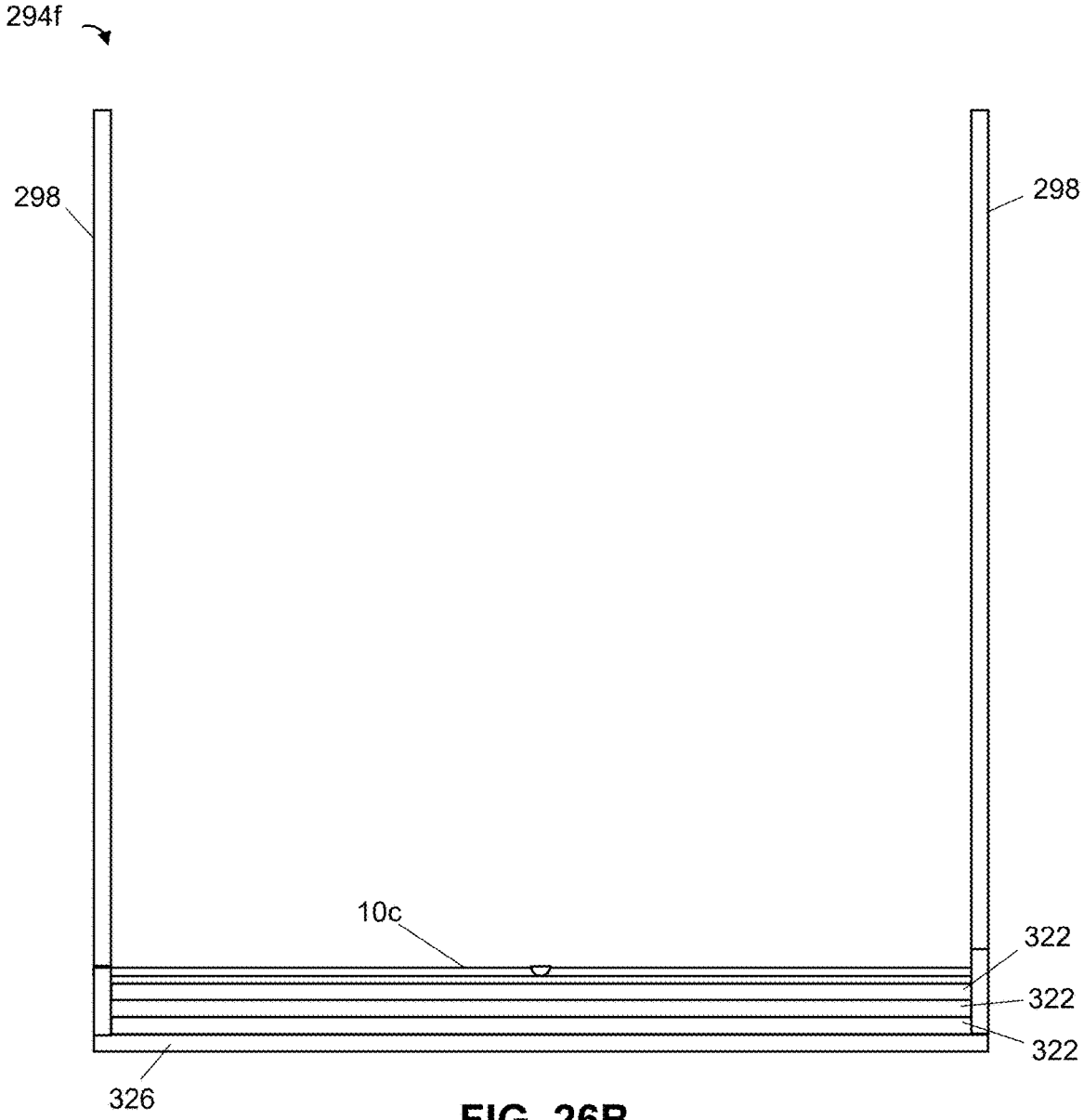
FIGS. 26B and 26C are front views of the building assembly of FIG. 26A when the walls are in the deployed position and the roof trusses are in the collapsed state and illustrate sliding of the slidable ceiling panels and roof trusses along the walls.
Figure 26C:
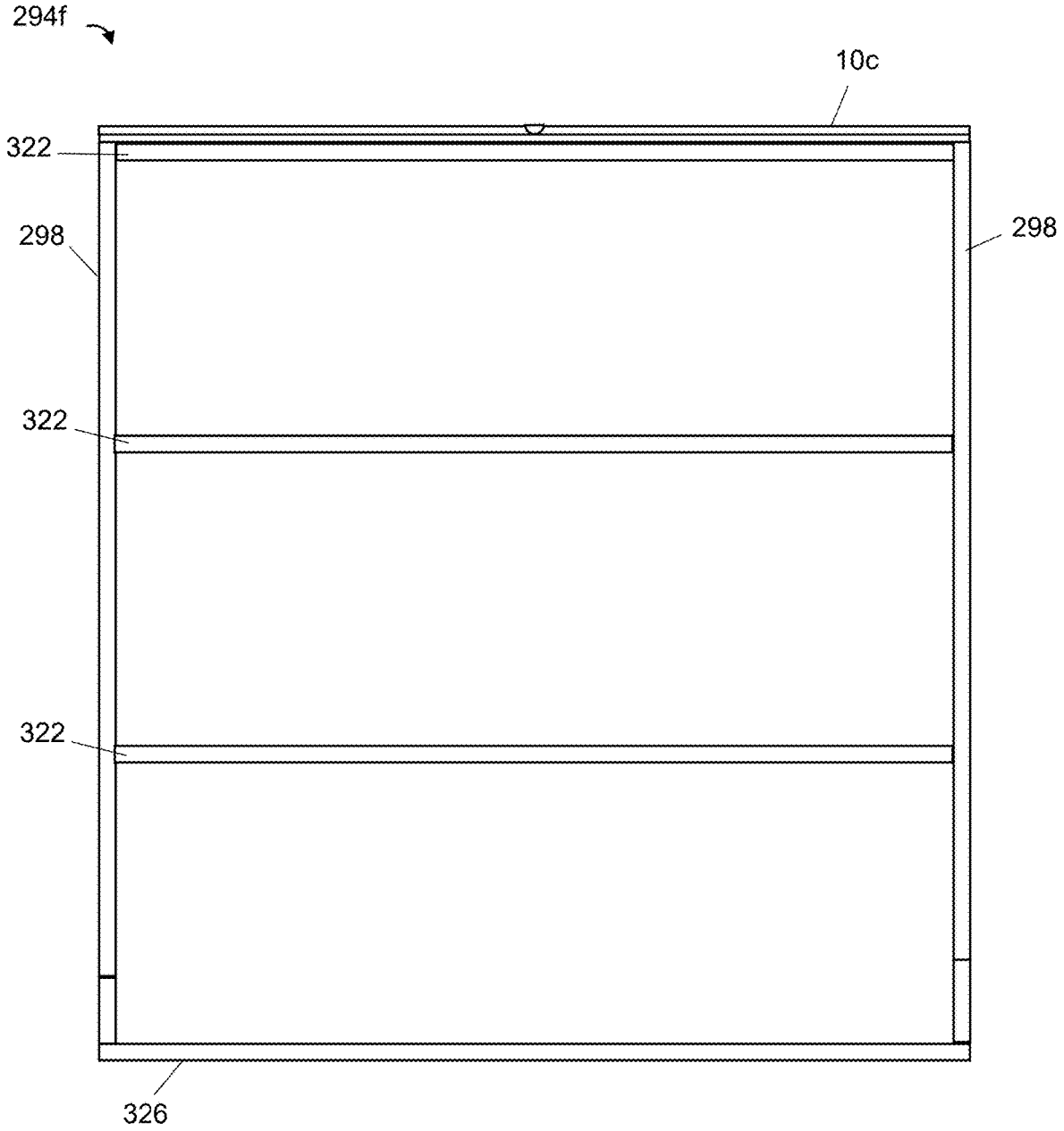
Figure 26D:
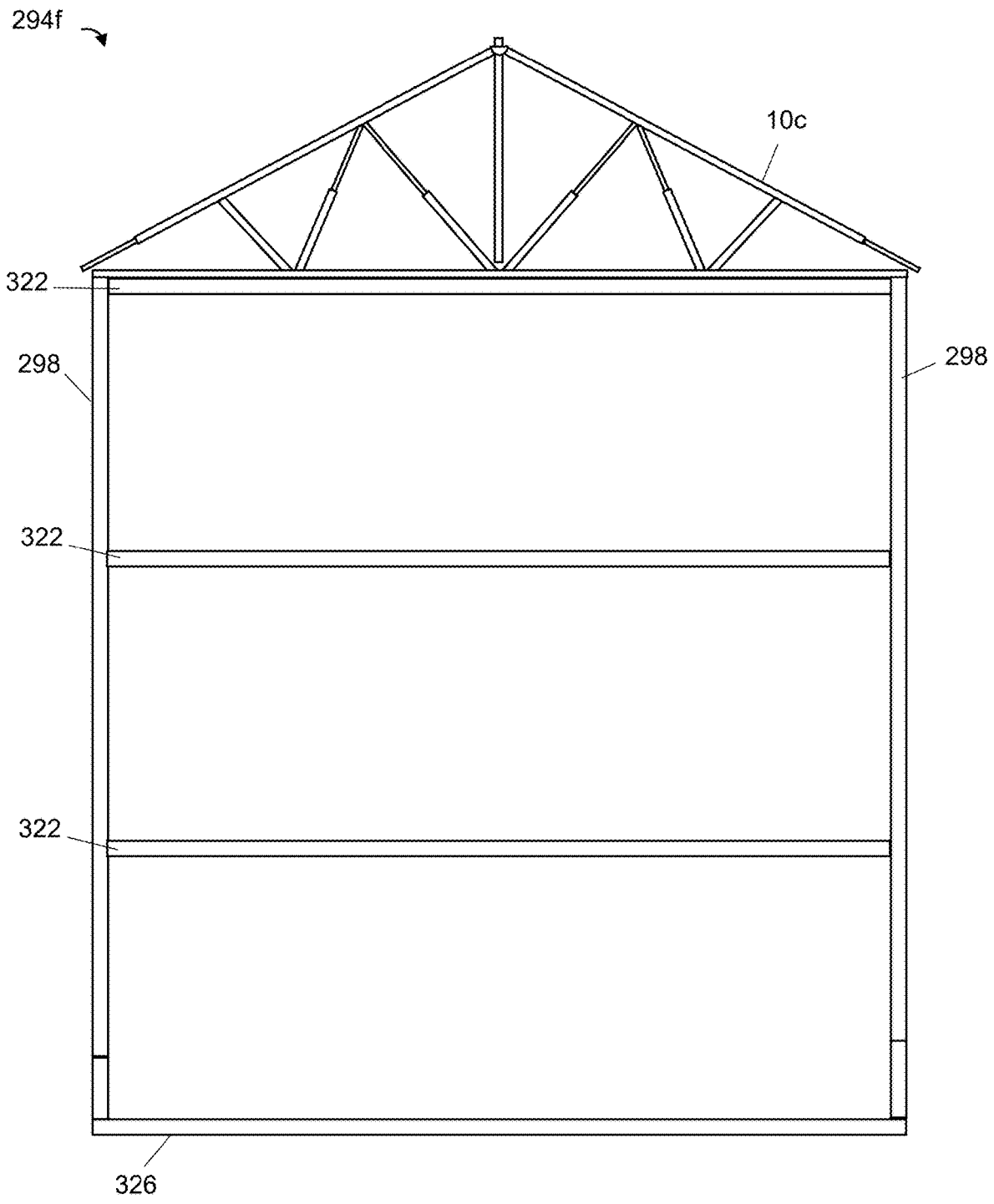
FIG. 26D is a front view of the building assembly of FIG. 26A when the walls are in the deployed position, the slidable ceiling panels and roof trusses have been slid vertically upward along the walls, and the roof trusses are in the expanded state.

Referring to FIGS. 26A-26D, shown is a sixth embodiment 294*f* of the present building assemblies that is substantially the same as building assembly 294*e*, except that building assembly 294*f*'s walls 298 each overlie the roof trusses and ceiling panels 90 when in the stowed position (FIG. 26A). To deploy building assembly 294*f*, walls 298 can each be pivoted to the deployed position (FIG. 26B) and each of the roof trusses can be configured to slide vertically along two of the walls between which the roof truss extends such that they can be slid upwardly along the walls (e.g., to upper ends of the walls) (FIG. 26C) where the roof truss can be fixed relative to the walls. Additionally, slidable ceiling panels 322 can each be slid vertically upward along walls 298 between which the ceiling panel extends.

In any building assembly (e.g., 294*c*-294*f*) comprising multiple ceiling panels 90, for each of the ceiling panels, a separation between the ceiling panel and at least one other of the ceiling panels after walls 298 are moved to the deployed position (and any slidable ceiling panel(s) are slid vertically) can be adequate for a living space between those ceiling panels, such as greater than or equal to any one of, or between any two of, 7, 8, 9, 10, 11, 12, 13, 14, 15, or 16 feet.

Building systems that include one or more of the above-described components—including one or more roof trusses 10*a*-10*e*, one or more roof assemblies 82*a*-82*b*, one or more wall assemblies 134*a*-134*c*, and/or one or more building assemblies 294*a*-294*f*—can be easily transported to a building site where they can be rapidly deployed. Because such building components can define a significant portion of a building to be constructed therefrom, the use of such components can significantly decrease the amount of time needed to construct the building, compared to conventional stick-built construction. And such components' expandability after transport allows them to be transported at a lower cost than conventional modular housing and to be used to make a building with larger features than conventional modular housing.

Figure 27A:
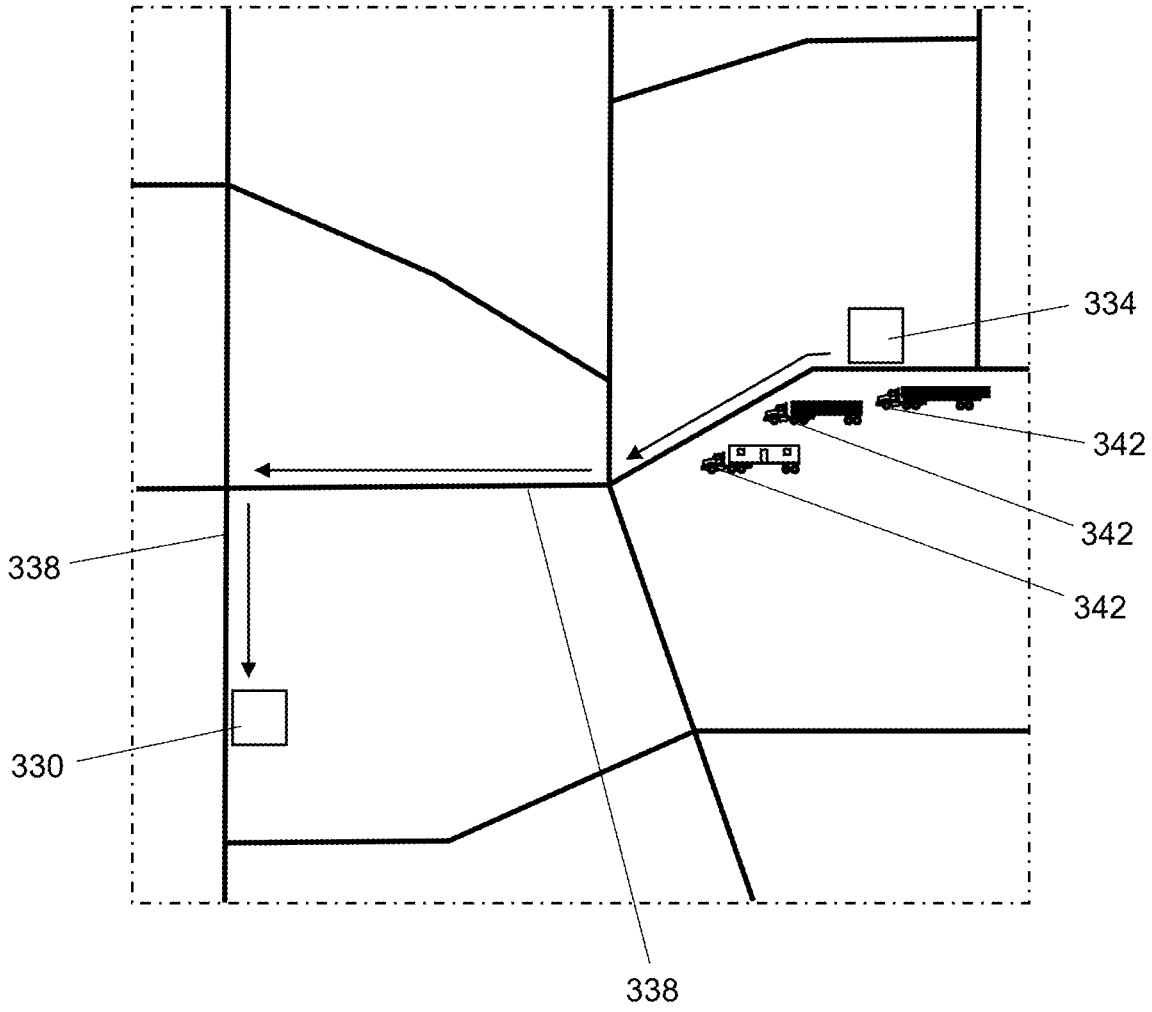
FIGS. 27A and 27B illustrate transportation of some of the present building components to a building site using one or more trucks.
Figure 27B:
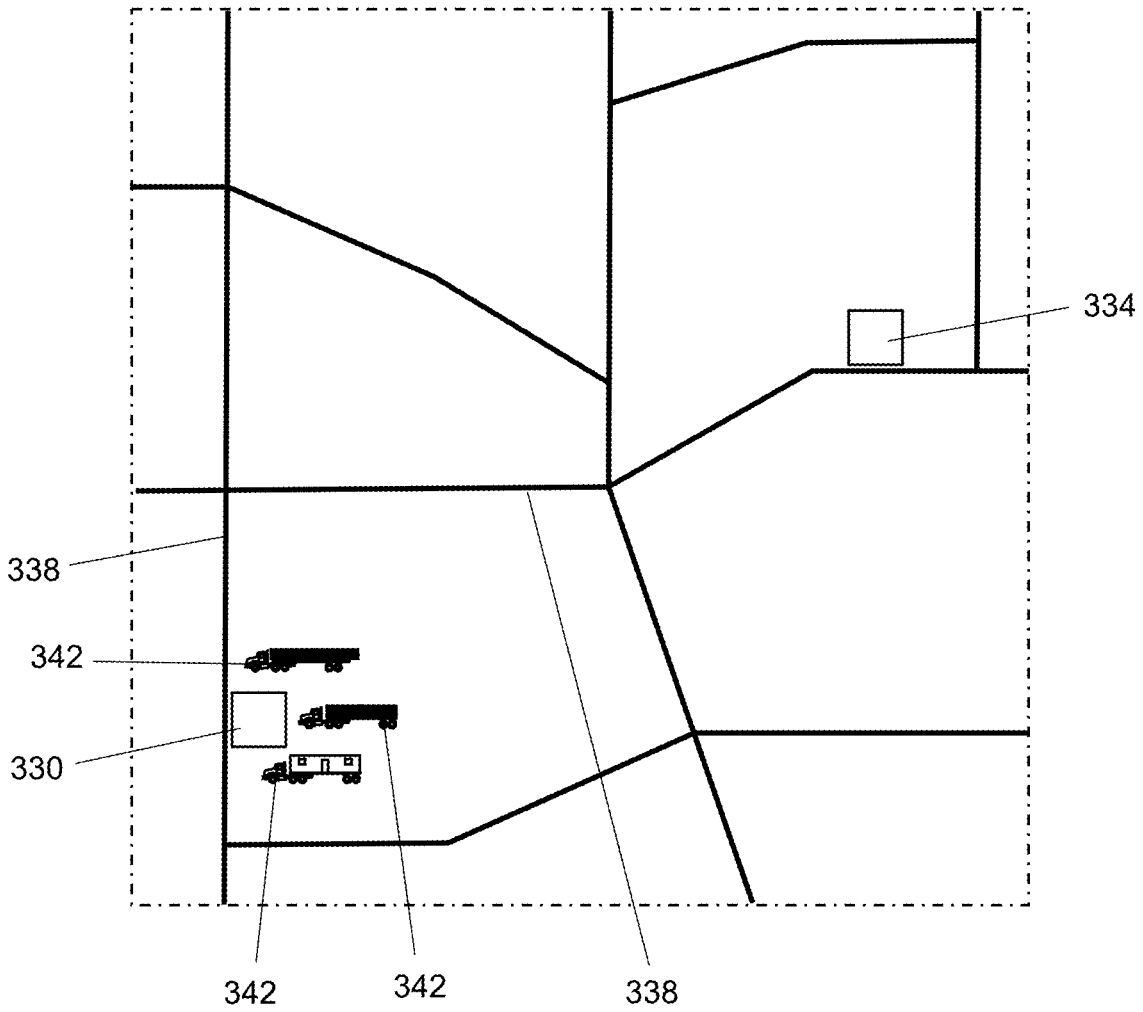

Referring to FIGS. 27A and 27B, some of the present methods of constructing a building at a building site (e.g., 330) comprise transporting, over one or more roads (e.g., 338), one or more of the above-described components to the building site, including one or more (optionally a plurality) of the roof trusses (e.g., 10*a*-10*e*), one or more (optionally a plurality) of the roof assemblies (e.g., 82*a*-82*b*), one or more (optionally a plurality) of the wall assemblies (e.g., 134*a*-134*c*), and/or one or more (e.g., optionally a plurality of) the building assemblies (e.g., 294*a*-294*f*). Such component(s) can be transported from an origination site (e.g., 334) at which the component(s) are stored, which can be, for example, a factory at which the component(s) were manufactured, a storage site (e.g., at a port, airport, or train station, to which the component(s) were transported over water (such as via a ship), air (such as via an airplane), or rail (such as via a train)), and/or the like, and they can be transported using one or more trucks (e.g., 342). The distance over which the component(s) are transported over the road(s) can be greater than or equal to any one of, or between any two of, 1, 5, 10, 20, 30, 40, 50, 60, 70, 80, 90, 100, 200, 300, 400, or 500 miles (e.g., depending on the proximity of the building site to the origination site). Any suitable building can be constructed using such component(s), such as a single-family home, a multi-family building (e.g., a condo complex or apartment building), or a commercial building (e.g., a restaurant, warehouse, store, and/or the like).

Figure 28A:
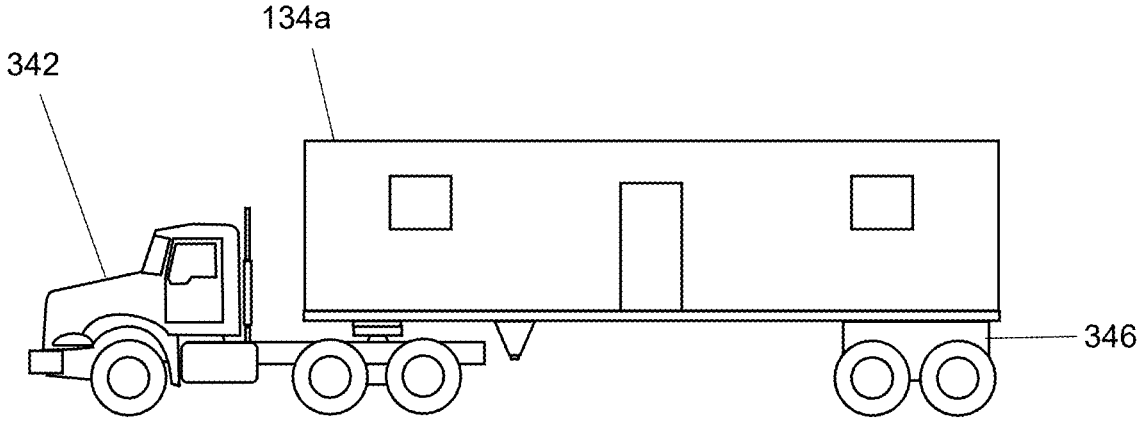
FIGS. 28A and 28B are side and top views, respectively, of a truck coupled to a trailer with the wall assembly of FIG. 10A disposed on the trailer in the folded state and building components—including ceiling panels, a prefabricated wall, a roof panel, and roof trusses—disposed in the interior volume of the wall assembly such that the truck can transport the wall assembly and building components to the building site.
Figure 28B:
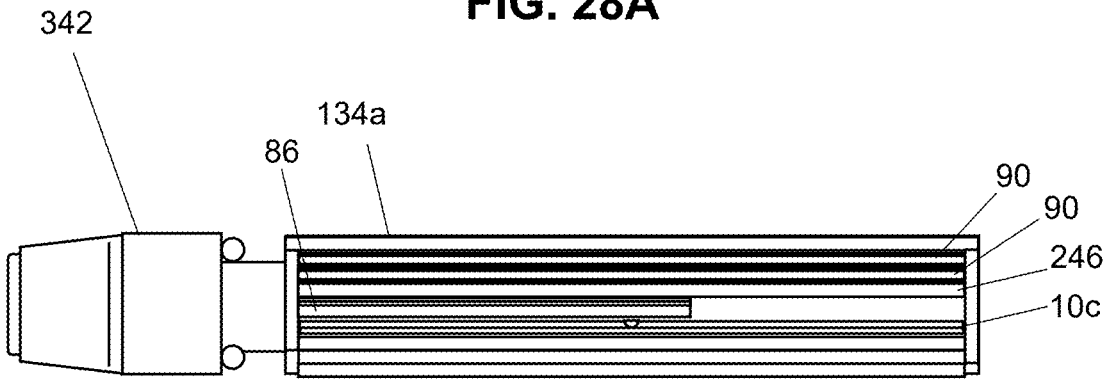

Referring to FIGS. 28A and 28B, when transporting with one or more truck(s), each of the truck(s) can tow a trailer (e.g., 346) on which at least some of the component(s) (e.g., roof trusse(s), roof assembly(ies), wall assembly(ies), and/or building assembly(ies)) are disposed when being transported to the building site. As shown, the trailer is a flatbed trailer, although in some embodiments the truck can tow an ISO container in which at least some of the component(s) are disposed.

As shown in FIGS. 28A and 28B, when transporting one or more (optionally a plurality) of wall assemblies, each of the one or more wall assemblies can be in the folded state such that the wall assembly has a compact form and can, for example, be disposed on the trailer during transport. Furthermore, as explained above, for at least one (up to and including each) of the one or more wall assemblies, at least one other component can be disposed in the interior volume of the wall assembly while the wall assembly is in the folded state and is transported to the building site. For example, as shown, one or more ceiling panels/floor assemblies (e.g., 90), one or more prefabricated walls (e.g., 246), one or more roof panels (e.g., 86), and one or more of the roof truss(es) can be disposed in the interior volume on the trailer. Architectural enhancements such as one or more porch assemblies (e.g., 258), one or more dormer assemblies (e.g., 278), and/or one or more bay window assemblies (e.g., 290) can also be disposed in the interior volume as explained above. With one or more other components disposed in the wall assembly's interior volume, the wall assembly can serve as a container and the space therein can be efficiently used to transport components needed to construct the building, thereby reducing the number of loads needed for material transport.

Figure 29:
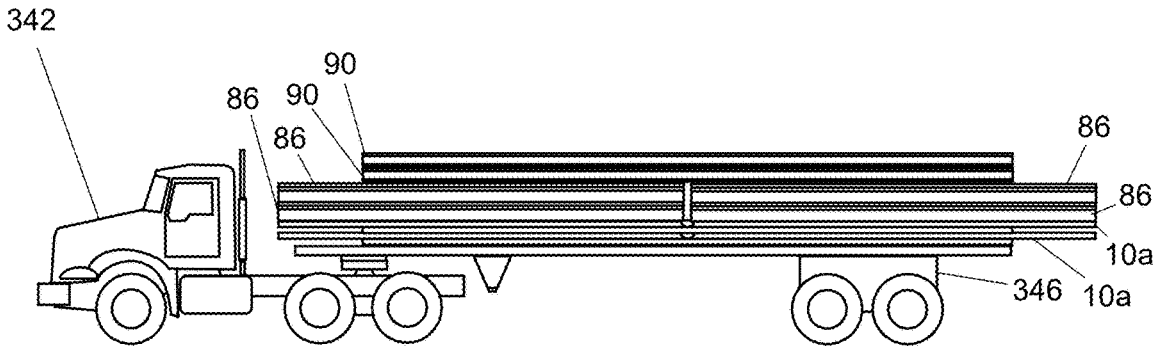
FIG. 29 is a side view of a truck coupled to a trailer with ceiling panels, roof panels, and roof trusses disposed on the trailer such that the truck can transport them to the building site.

When transporting one or more (optionally a plurality) of roof trusses to the building site, each of the roof trusses can be in the collapsed state. The roof truss(es) need not be part of an assembly during transport, and while as shown in FIGS. 28A and 28B they can be transported while in the interior volume of a wall assembly, as shown in FIG. 29 in other methods (including, but not limited to, those that do not involve the transport of a wall assembly) they need not be transported in a wall assembly's interior volume. For example, the roof truss(es) can be disposed on a trailer while transported to the building site, optionally with one or more other components—such as one or more roof panels and/or one or more ceiling panels—that will later be fixed to the roof truss(es) when constructing the building.

Figure 30:
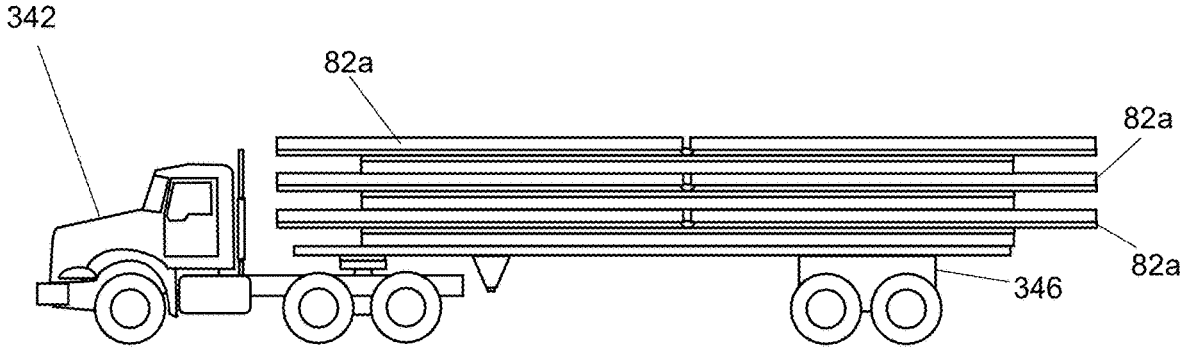
FIG. 30 is a side view of a truck coupled to a trailer with roof assemblies disposed on the trailer such that the truck can transport them to the building site.
Figure 31:
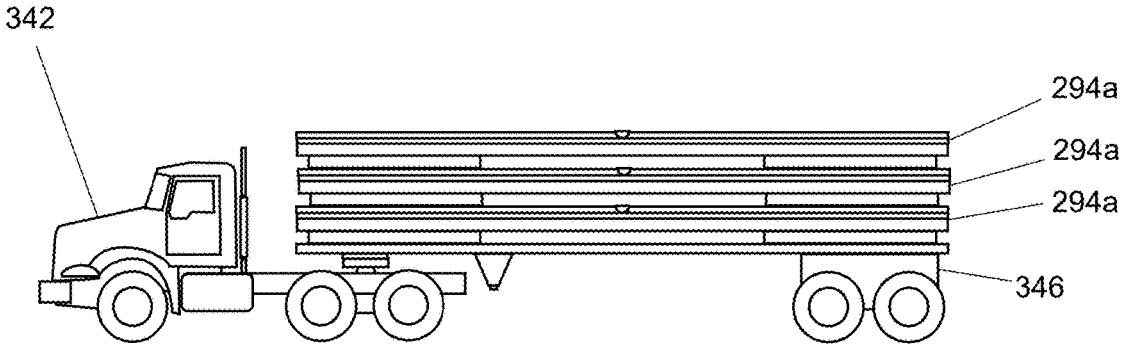
FIG. 31 is a side view of a truck coupled to a trailer with building assemblies disposed on the trailer such that the truck can transport them to the building site.

Referring to FIGS. 30 and 31, in some methods the roof trusses can be part of one or more roof assemblies (FIG. 30)

and/or of one or more building assemblies (FIG. 31) as explained above. In such methods, transporting the roof trusses of each roof assembly to the building site can comprise transporting the roof assembly to the building site (e.g., with the truck while the roof assembly is on a trailer towed by the truck), and transporting the roof trusses of each building assembly to the building site can comprise transporting the building assembly to the building site while the building assembly's walls (e.g., 298) are each on the stowed position (e.g., with the truck while the building assembly is on a trailer towed by the truck).

Figure 32A:
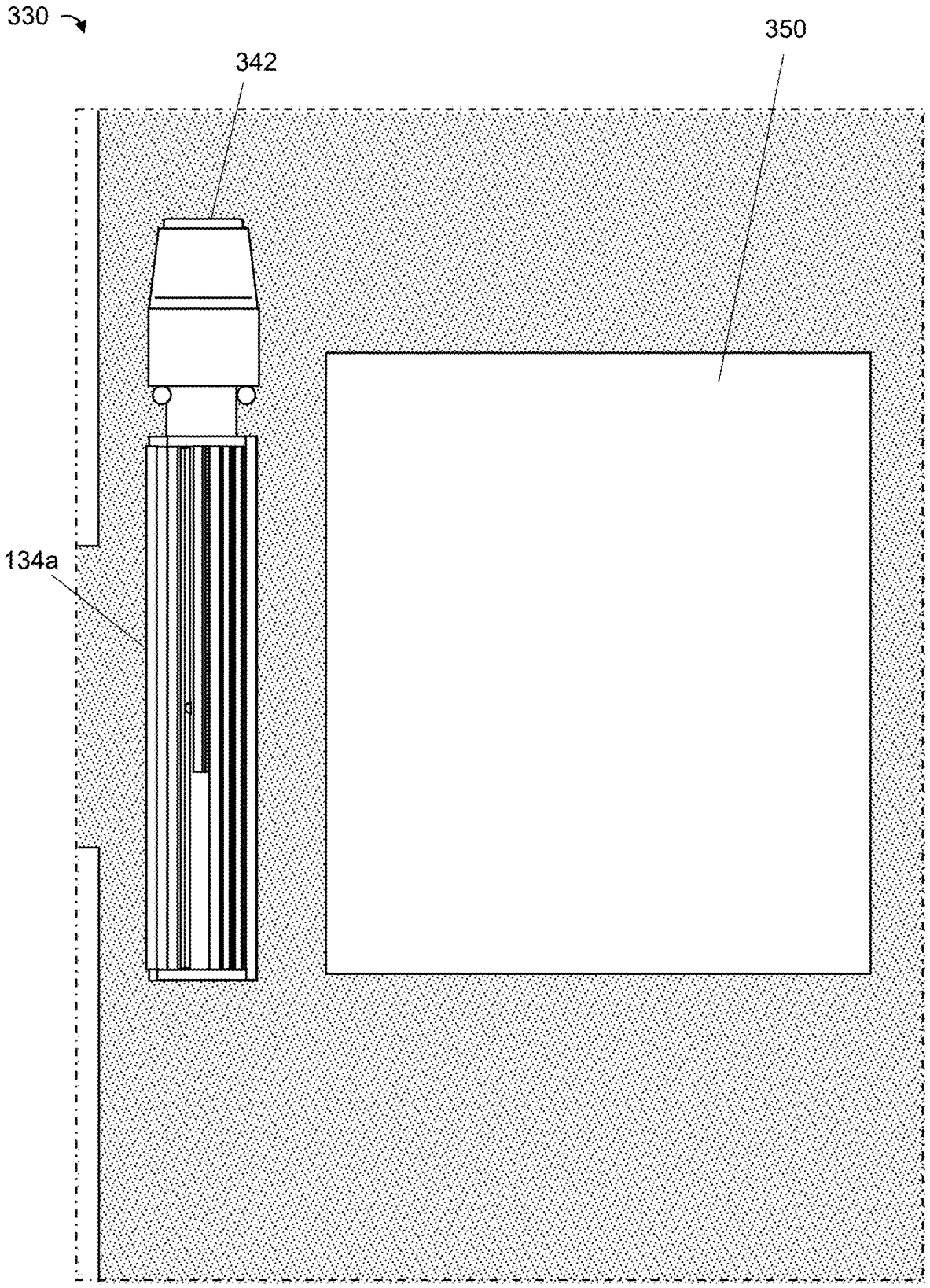
FIG. 32A is a top view of a building site that includes a slab, where the truck of FIGS. 28A and 28B that is coupled to a trailer carrying the wall assembly and building components disposed in the wall assembly's interior volume is disposed at the building site.
Figure 32B:
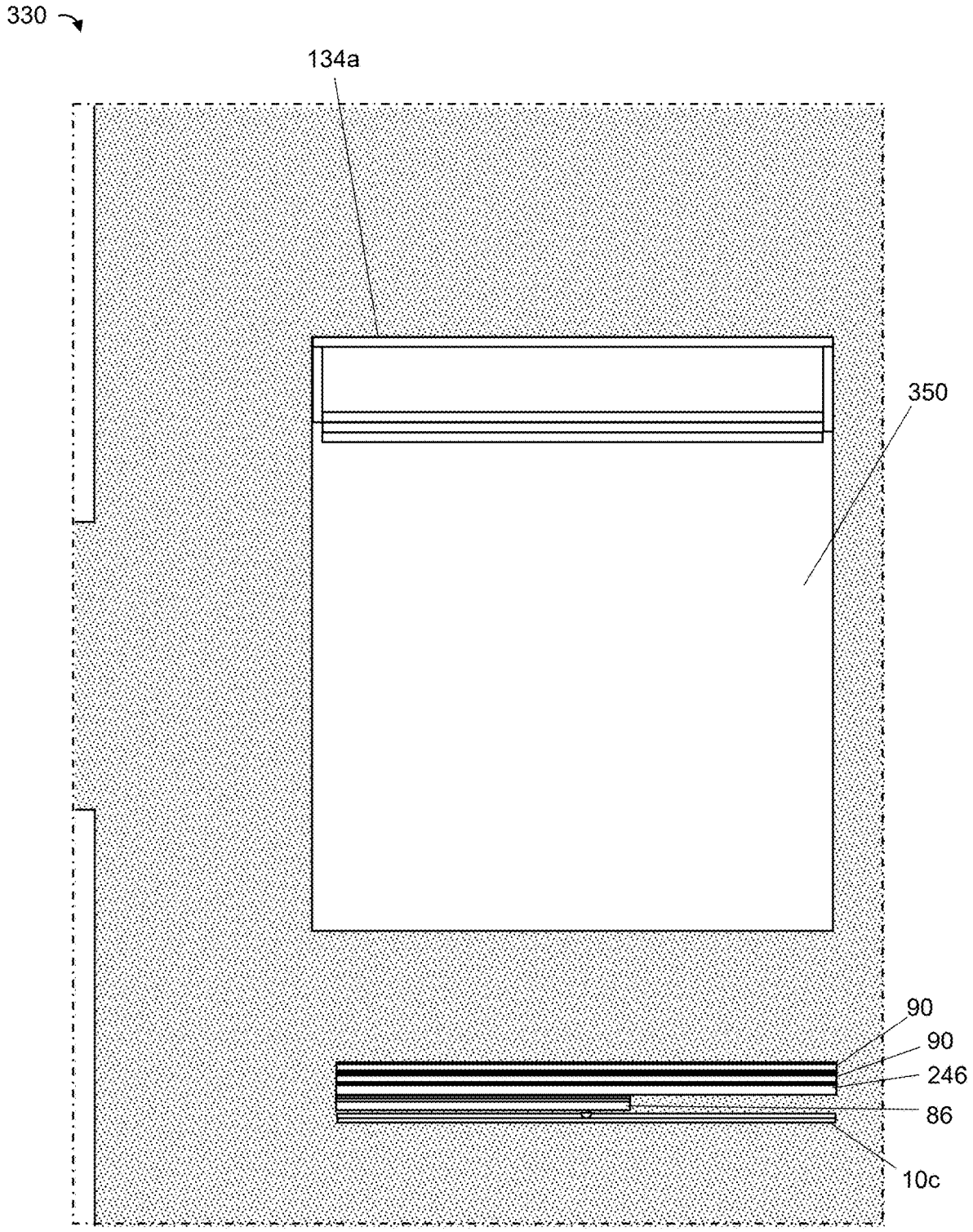
FIGS. 32B and 32C are top and front views, respectively, of the building site of FIG. 32A after the wall assembly and building components disposed on the trailer are unloaded.
Figure 32C:
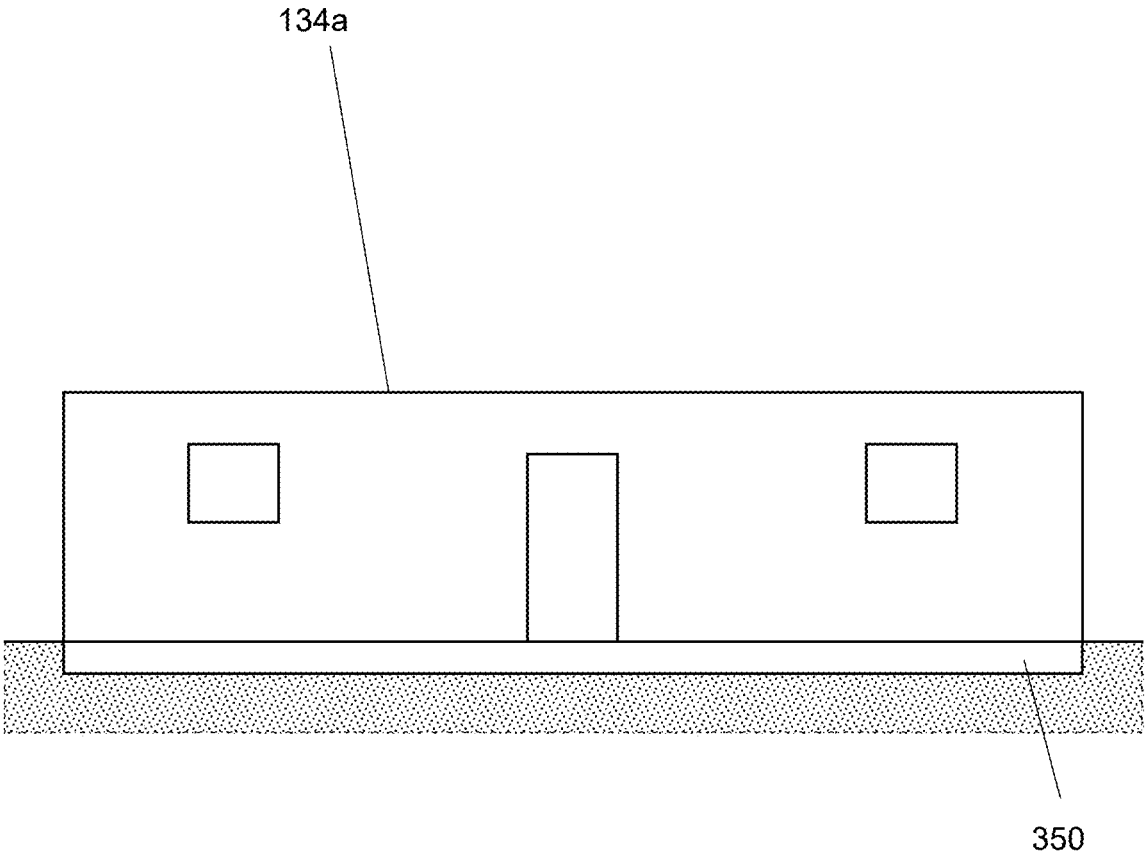
Figure 32D:
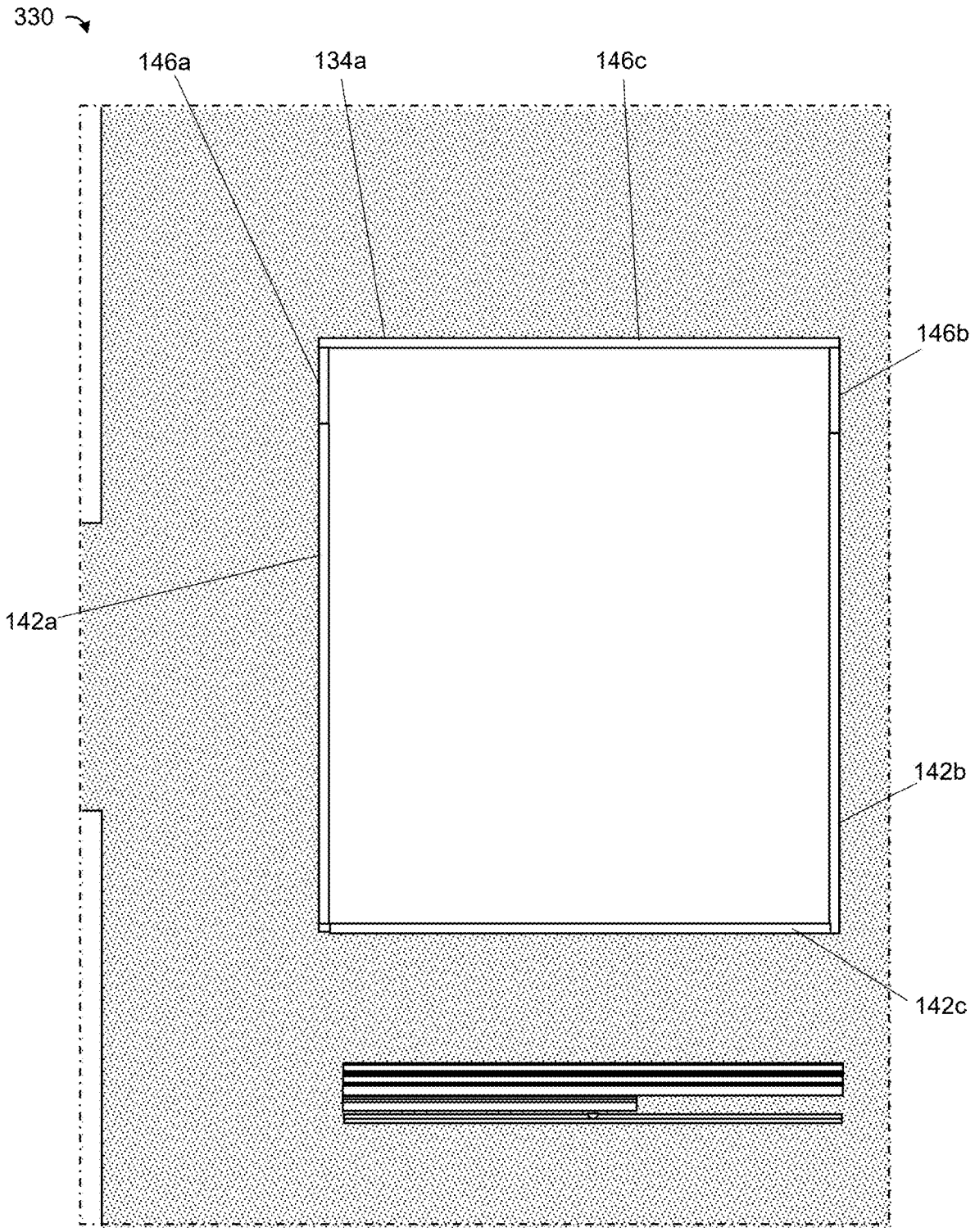
FIG. 32D is a top view of the building site of FIG. 32A with the wall assembly moved to the unfolded state while on the slab.

Referring to FIGS. 32A-32D, illustrated are steps of some of the present methods in which the building is constructed using one or more of the wall assemblies. For each wall assembly, when the wall assembly arrives at the building site (FIG. 32A), it—and any components disposed in its interior volume—can be unloaded onto the building site while the wall assembly is in the folded state (FIGS. 32B and 32C). As shown, the building site can comprise, for example, a slab (e.g., 350) that can serve as a foundation for the building and can comprise concrete. The wall assembly can thus be disposed on the slab before being moved to the unfolded state. In other embodiments, however, the wall assembly need not be placed on a slab, especially if it includes jacks (e.g., 222) as described above to facilitate leveling thereof when the ground is not level. In some embodiments, the foundation can comprise a plurality of floor assemblies (e.g., 90) that can be disposed on piers or footing at the building site, which can allow quick deployment and disassembly if the building constructed is a temporary construction. This can be particularly useful for, for example, military camps, and can also define a crawl space or basement underneath the floor assemblies (which can be enclosed with one or more of the present prefabricated walls). Each of the wall assembly's pivotable wall segments (e.g., 142*a*-142*c*) can then be pivoted in any of the manners described above to move the wall assembly from the folded state to the unfolded state (FIG. 32D). In the embodiment shown the deployed wall assembly is one with a single set of three pivotable wall segments, but in other embodiments any of the other above-described wall assembly configurations can be employed. When the wall assembly is disposed on a foundation, the foundation can be large enough such that the foundation underlies the wall assembly when the wall assembly is in the unfolded state.

Figure 33:
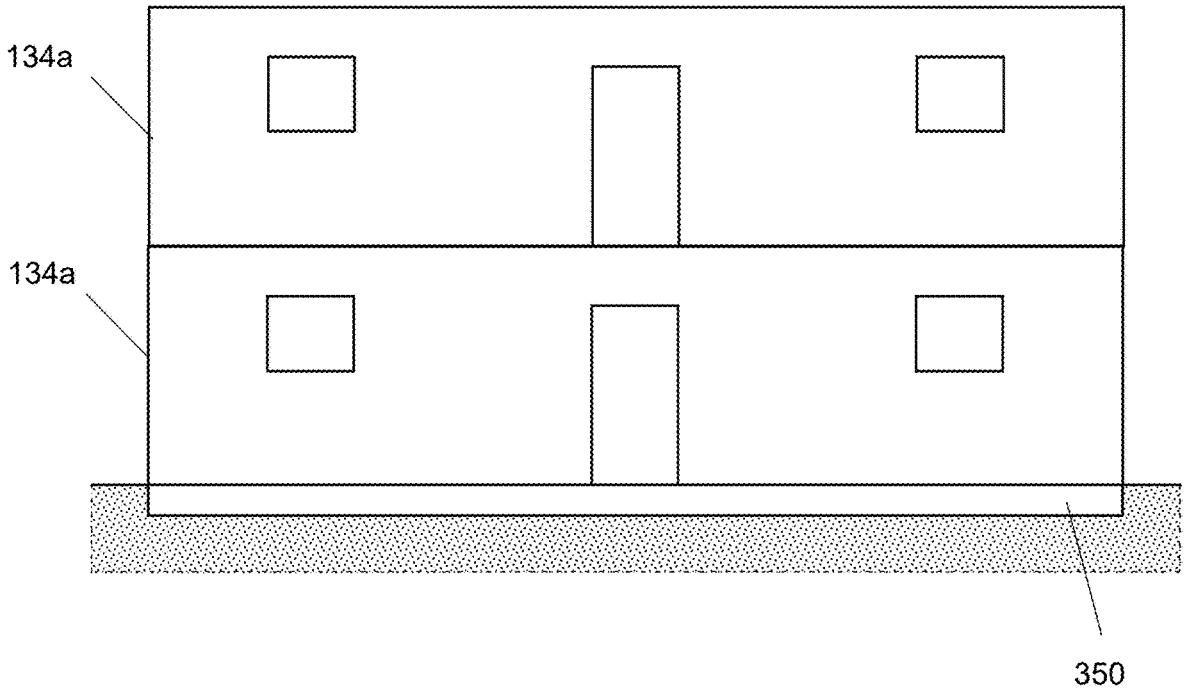
FIG. 33 is a front view of the building site of FIG. 32A with another wall assembly of FIG. 10A disposed on the unfolded wall assembly of FIG. 32D to create a two-story building.

Referring to FIG. 33, in methods in which the one or more wall assemblies comprise two or more wall assemblies, after a first one of the wall assemblies is moved to the unfolded state, a second one of the wall assemblies can be disposed on the first wall assembly and moved to the unfolded state for the construction of a multi-story building.

Figure 34A:
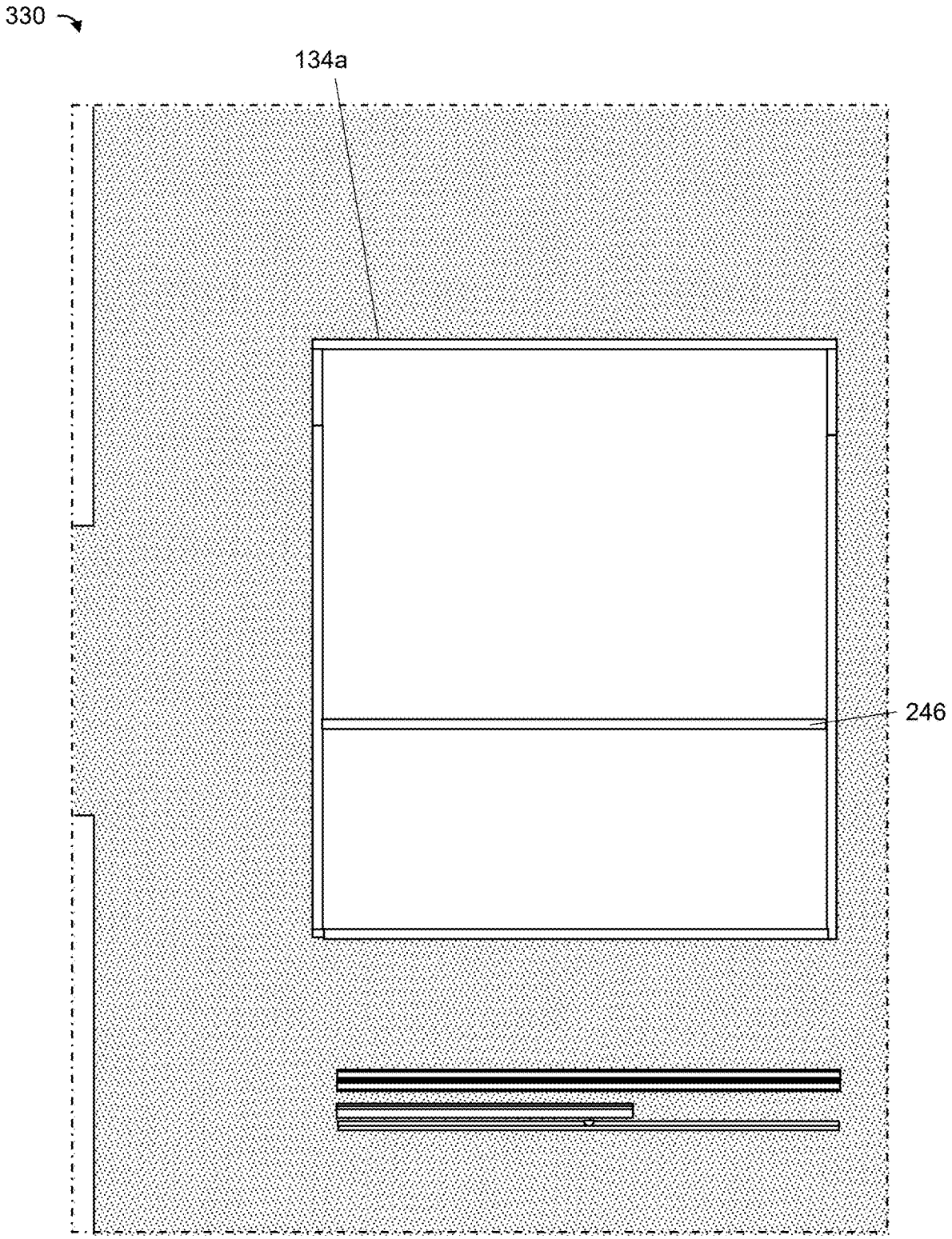
FIG. 34A is a top view of the building site of FIG. 32A with a prefabricated wall transported by the truck of FIGS. 28A and 28B installed within the interior volume of the unfolded wall assembly of FIG. 32D.
Figure 34B:
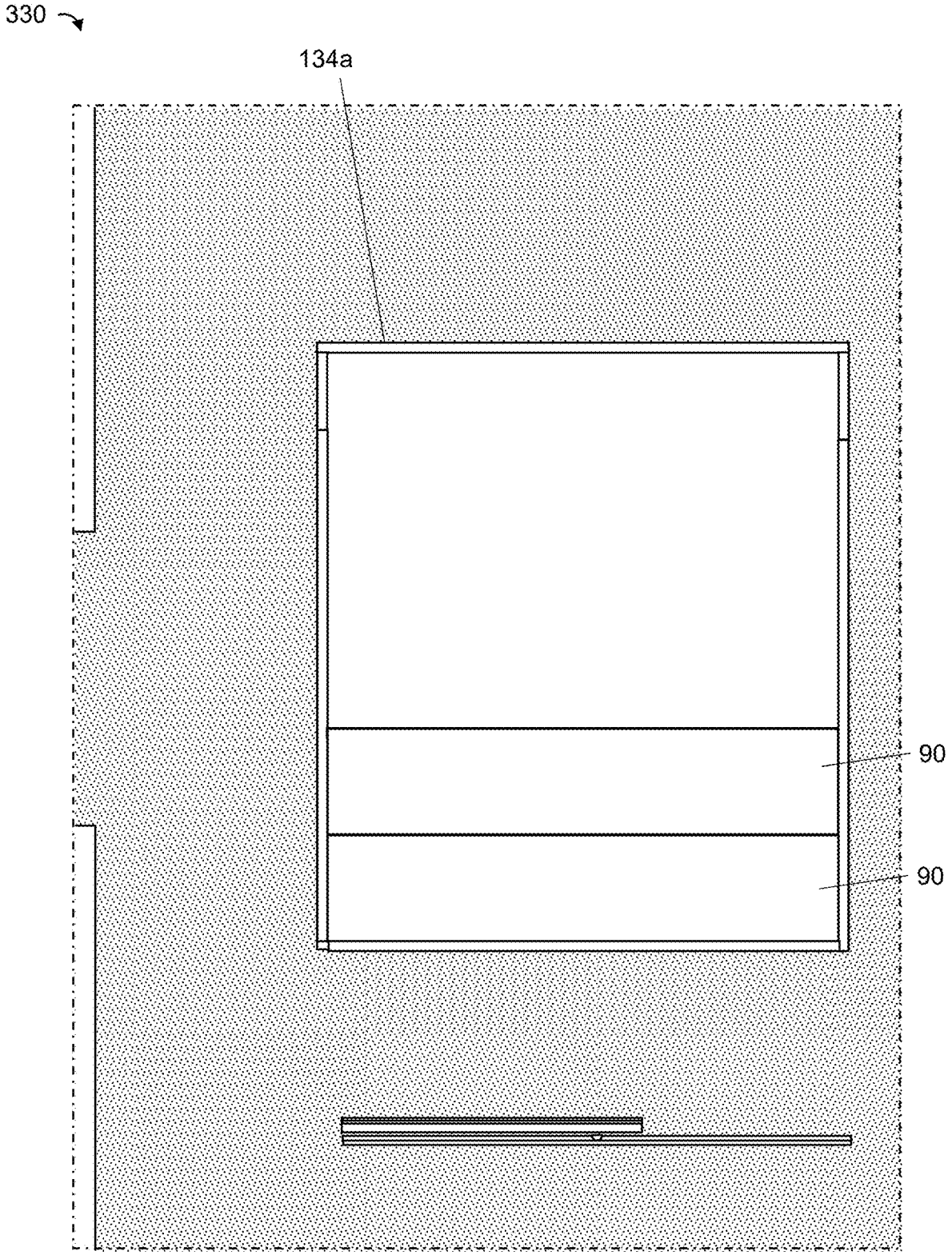
FIG. 34B is a top view of the building site with two ceiling panels transported by the truck of FIGS. 28A and 28B installed on the unfolded wall assembly of FIG. 32D after installation of the prefabricated wall.

Referring to FIGS. 34A and 34B, after the wall assembly is moved to the unfolded state, one or more components can be coupled to the wall assembly to define one or more rooms within and/or a ceiling on the wall assembly. For example, at least one—up to and including each—of the prefabricated wall(s)—which can be wall(s) that were transported to the building site in the wall assembly's interior volume—can be coupled to and disposed in the interior volume of the wall assembly, optionally such that the prefabricated wall extends between opposing walls of the wall assembly (FIG. 34A). As another example, at least one—up to and including each—of the ceiling panels/floor assemblies can be coupled to the wall assembly to overlie the interior volume of the wall assembly (FIG. 34B).

Figure 35A:
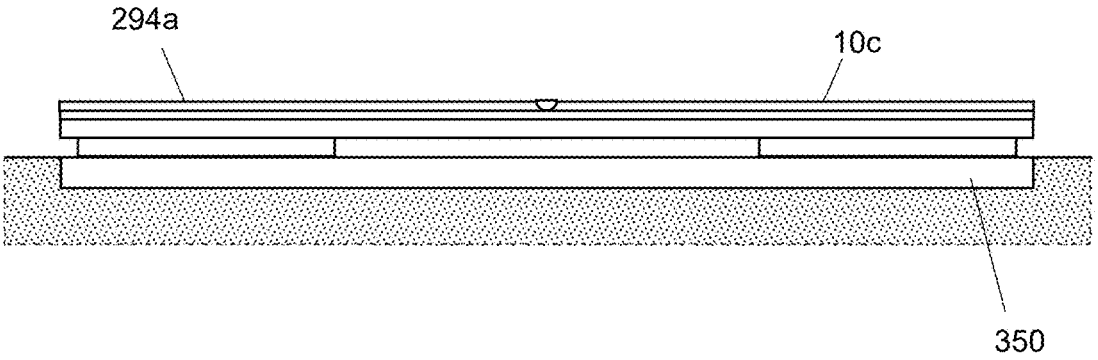
FIG. 35A is a front view of a building site that includes a slab, where the building assembly of FIGS. 21A-21C is positioned on the slab while its walls are in the stowed position and its roof trusses are in the collapsed state.
Figure 35B:
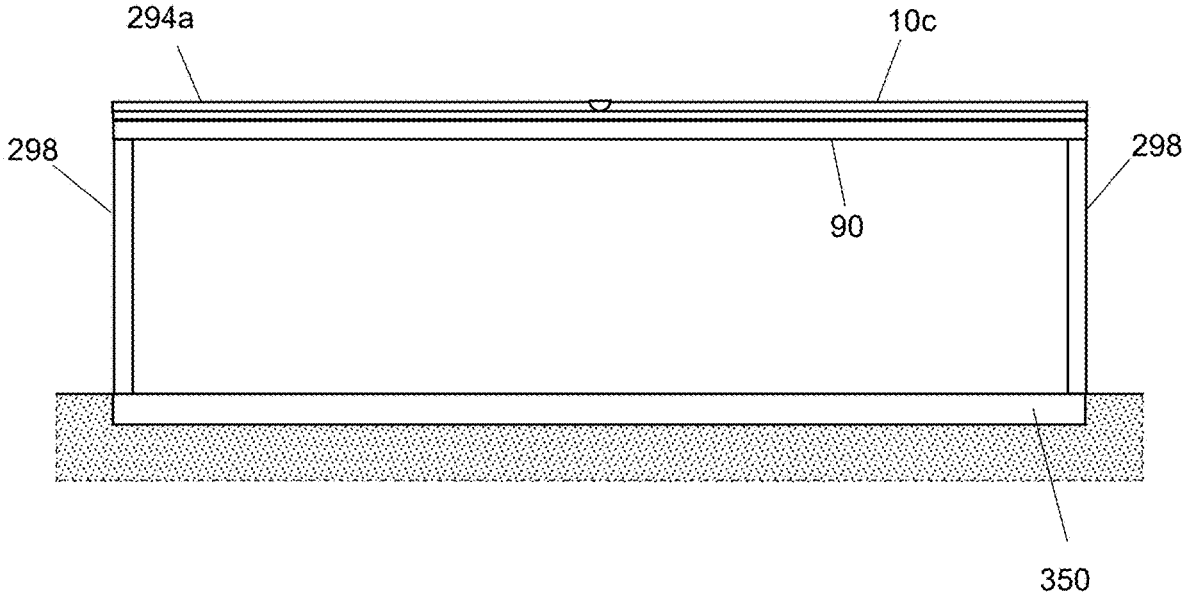
FIG. 35B is a front view of the building site of FIG. 35A with the building assembly's walls pivoted to the deployed state while positioned on the slab.

Referring to FIGS. 35A and 35B, illustrated are steps of some of the present methods in which the building is constructed using one or more of the building assemblies. As shown, each of the one or more building assemblies can be unloaded onto the building site, optionally on the foundation, while the walls of the building assembly are in the stowed position (FIG. 35A). Each of the walls of the building assembly can then be pivoted from the stowed position to the deployed position at the building site in the manner explained above (FIG. 35B). In the embodiment shown in which the building assembly is one whose walls underlie the first ceiling panel when in the stowed position, each of the walls can be pivoted to the deployed position at least by lifting the building assembly away from the ground while the walls are each in the stowed position (e.g., using a crane), pivoting the walls to the deployed position, and fixing at least two of the walls to the ground (e.g., to the foundation).

Figure 36A:
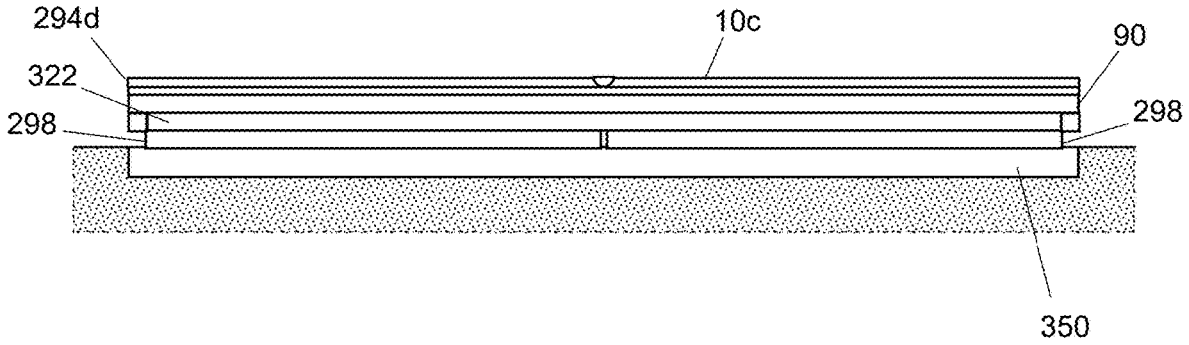
FIG. 36A is a front view of a building site that includes a slab, where the building assembly of FIG. 24A is positioned on the slab while its walls are in the stowed position and its roof trusses are in the collapsed state.
Figure 36B:
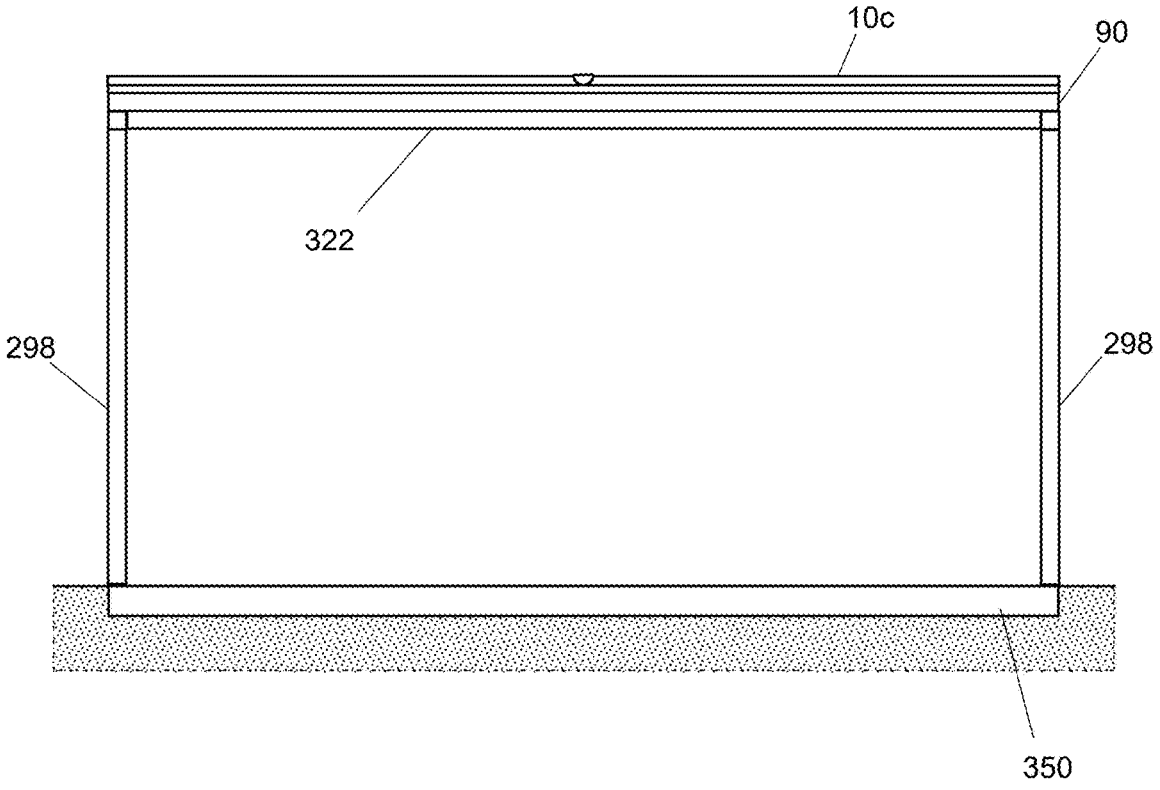
FIG. 36B is a front view of the building site of FIG. 36A with the building assembly's walls pivoted to the deployed state and fixed to the slab.
Figure 36C:
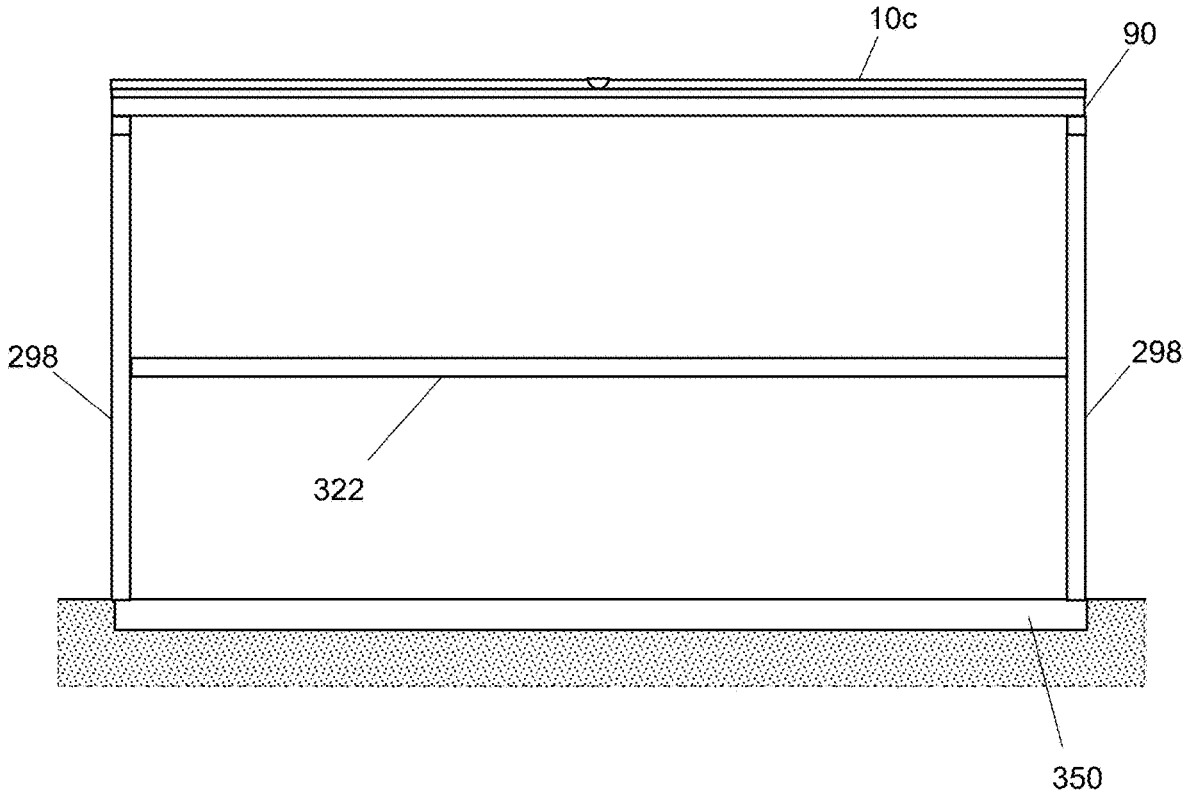
FIG. 36C is a front view of the building site of FIG. 36A after the building assembly's slidable ceiling panel have been slid along its deployed walls.
Figure 37A:
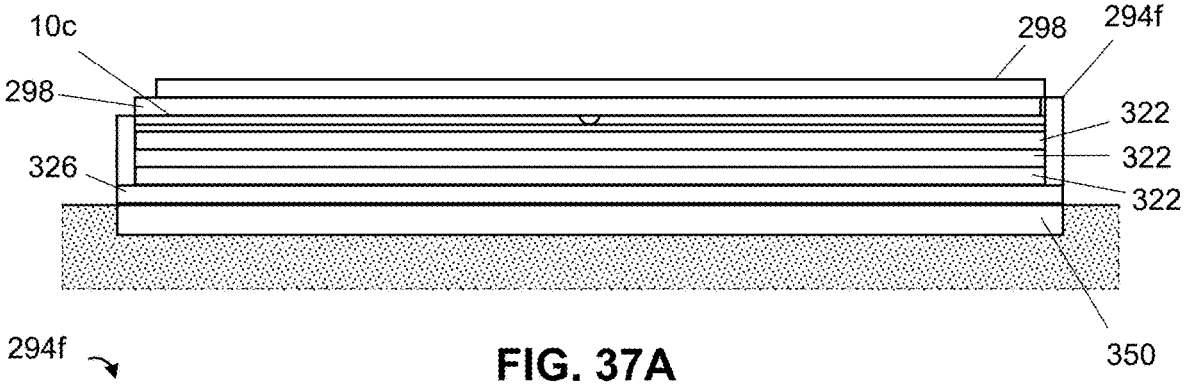
FIG. 37A is a front view of a building site that includes a slab, where the building assembly of FIG. 26A is positioned on the slab while its walls are in the stowed position and its roof trusses are in the collapsed state.
Figure 37B:
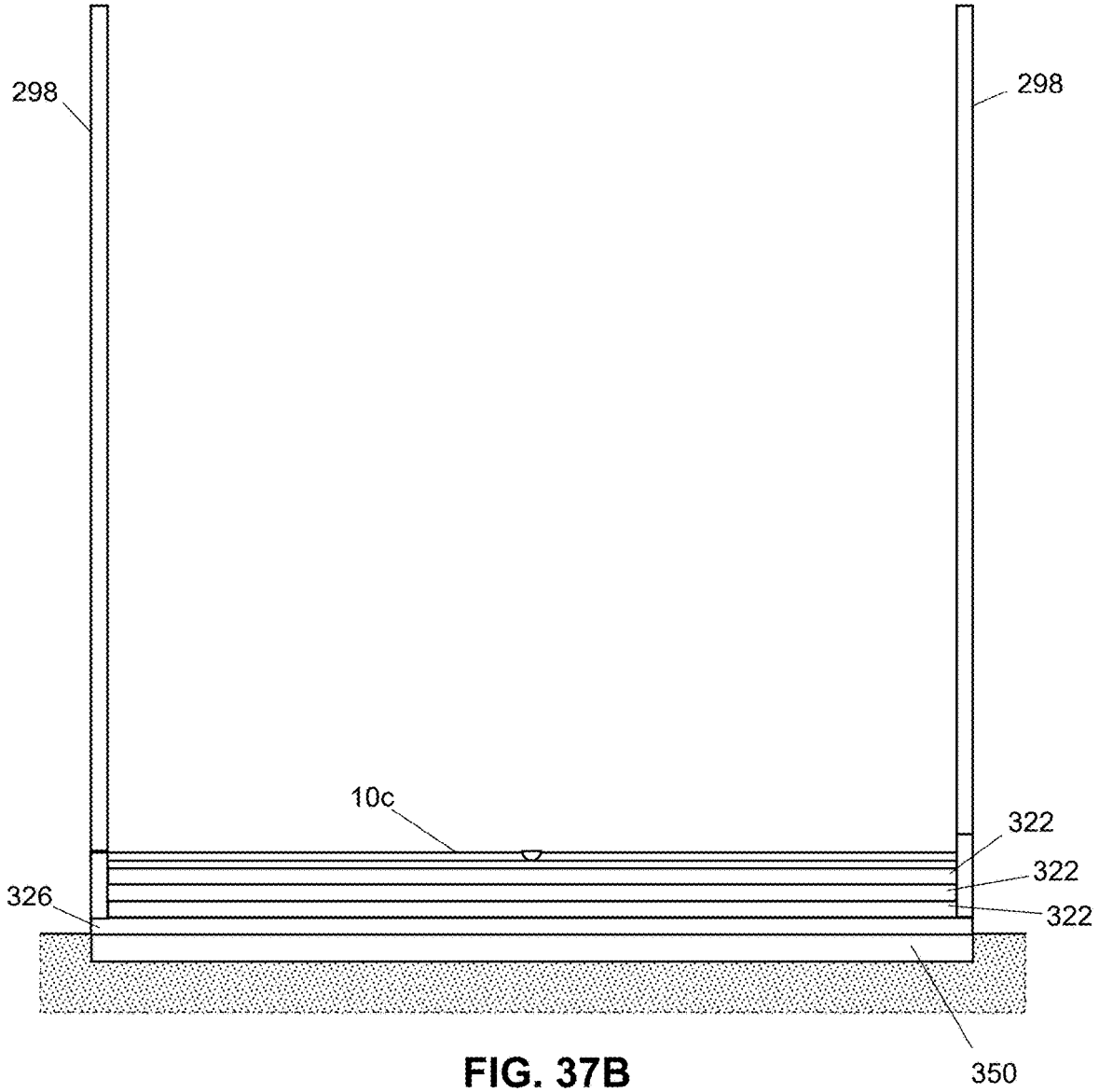
FIG. 37B is a front view of the building site of FIG. 37A with the building assembly's walls pivoted to the deployed state and fixed to the slab.
Figure 37C:
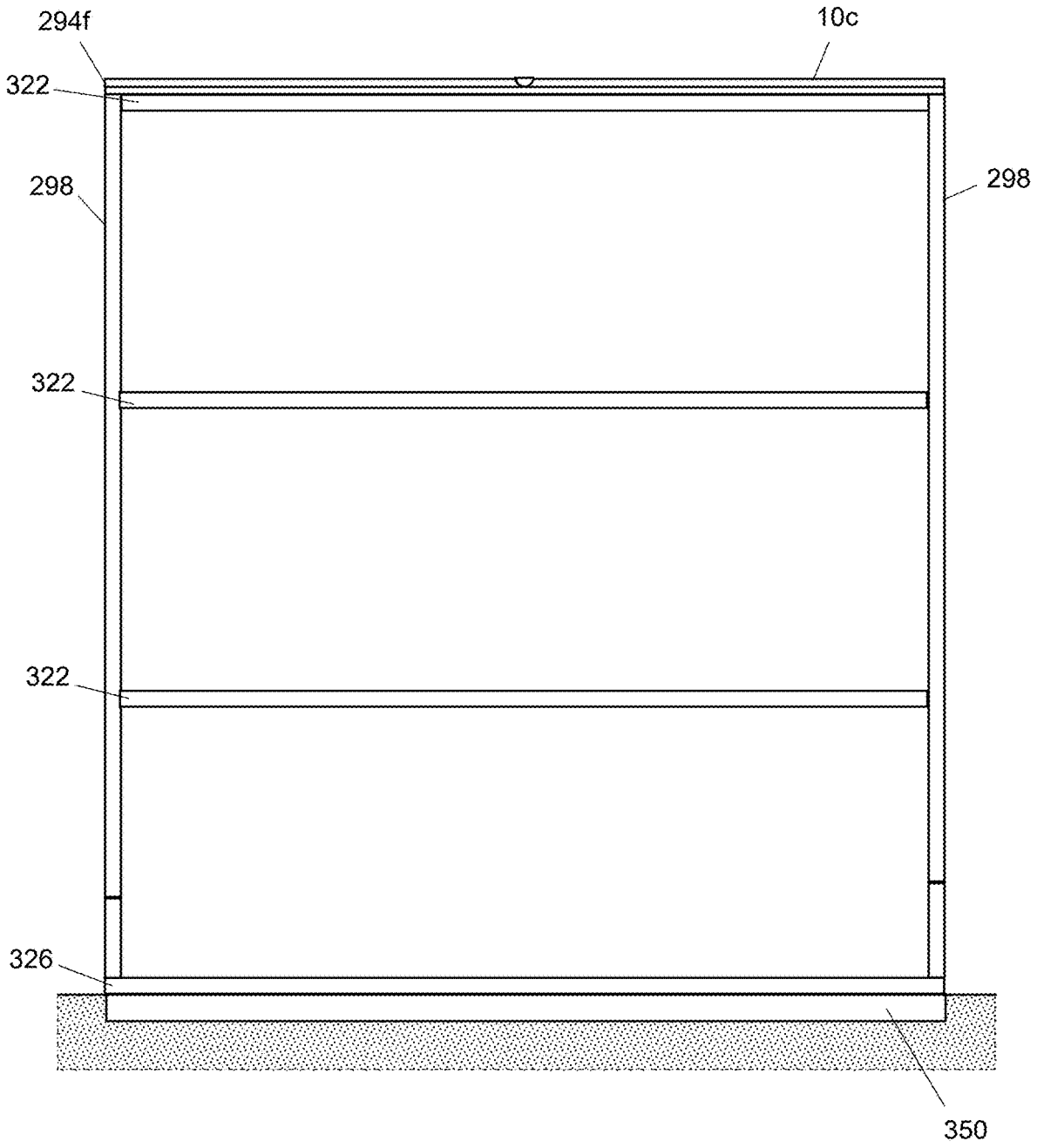
FIG. 37C is a front view of the building site of FIG. 37A after the building assembly's slidable ceiling panels and roof trusses have been slid along its deployed walls.

As explained above, for some embodiments in which the building assembly has multiple ceiling panels and two or more pairs of walls (e.g., with building assembly 294*c*), for at least one of the pairs of the walls pivoting each of the walls of the wall can comprise lifting the ceiling panel that overlies the wall when the wall is in the stowed position such that the second end of the wall slides along the ceiling panel that underlies the wall when the wall is in the stowed position. And, referring to FIGS. 36A-36C, as also explained above for embodiments in which the building assembly's ceiling panels include at least one slidable ceiling panel (e.g., 322) (e.g., with building assemblies 294*d*-294*f*), some methods comprise, after pivoting the walls to the deployed position (FIGS. 36A and 36B), sliding each of the slidable ceiling panel(s) vertically along two of the walls and, after sliding the slidable ceiling panel(s), fixing the slidable ceiling panel(s) relative to the walls (FIG. 36C). When the slidable ceiling panel(s) overlie the walls when the walls are in the stowed position, such vertical sliding can include lowering each of the slidable ceiling panel(s), and as shown in FIGS. 37A-37C, for embodiments in which the walls overlie the ceiling panels—and roof trusses—when the walls are each in the stowed position, such vertical sliding can include lifting each of the slidable ceiling panel(s), in addition to sliding each of the roof trusses upwardly as described above and thereafter fixing the roof trusses relative to the walls.

Figure 38:
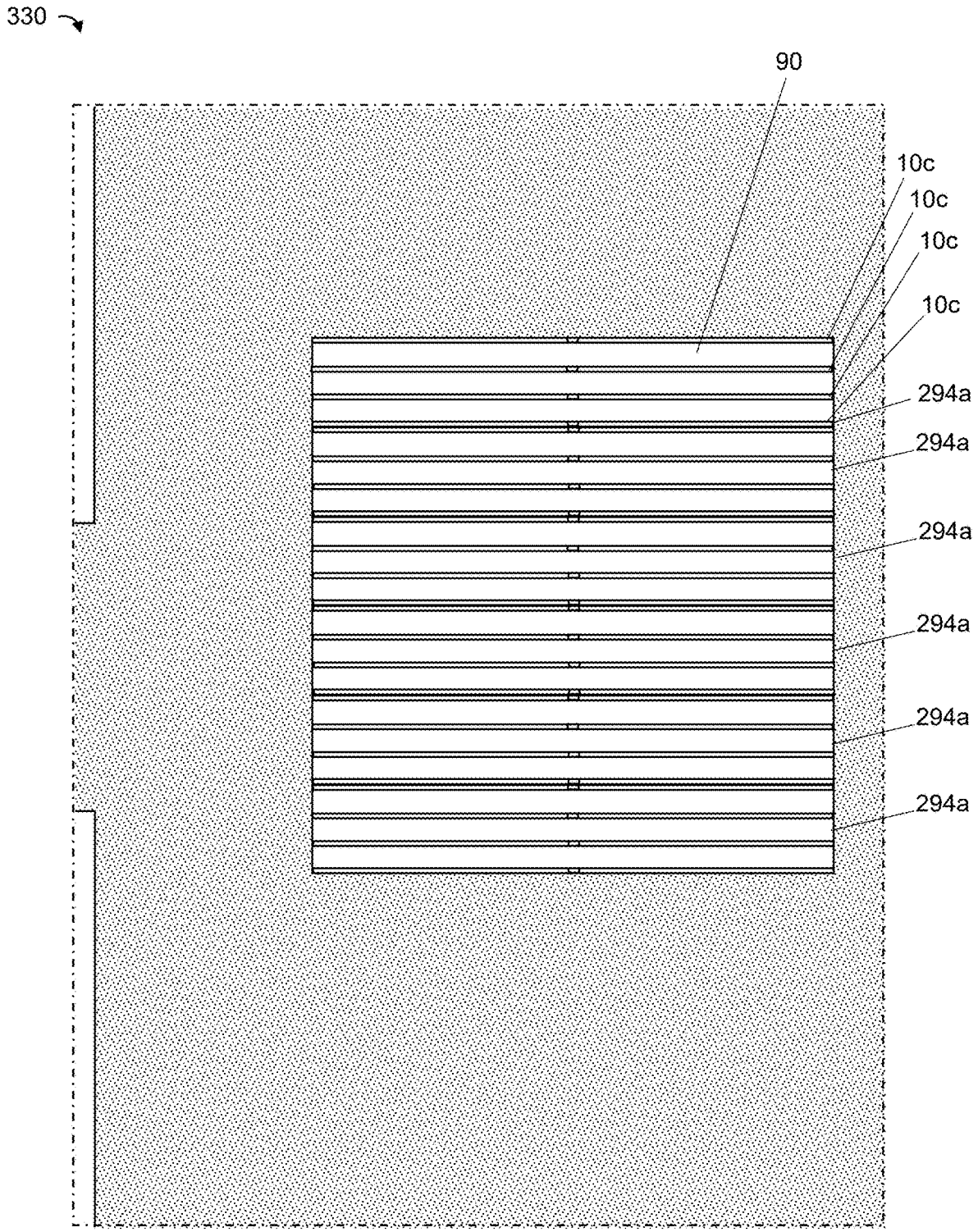
FIG. 38 is a top view of the building site of FIG. 35A, where additional building assemblies of FIGS. 21A-21C are positioned on the slab and the building assemblies' walls are pivoted to the deployed state and fixed to the slab.

Referring to FIG. 38, because each of the one or more building assemblies can have a compact width for transport, to construct a large-width building, a plurality of the building assemblies can be transported to the building site, deployed as described above (e.g., on the foundation), and coupled together such that a length of the coupled-together building assemblies is approximately the same as the length of each of the building assemblies and a width of the coupled-together building assemblies is approximately equal to at least the sum of the widths of the building assemblies.

Figure 39A:
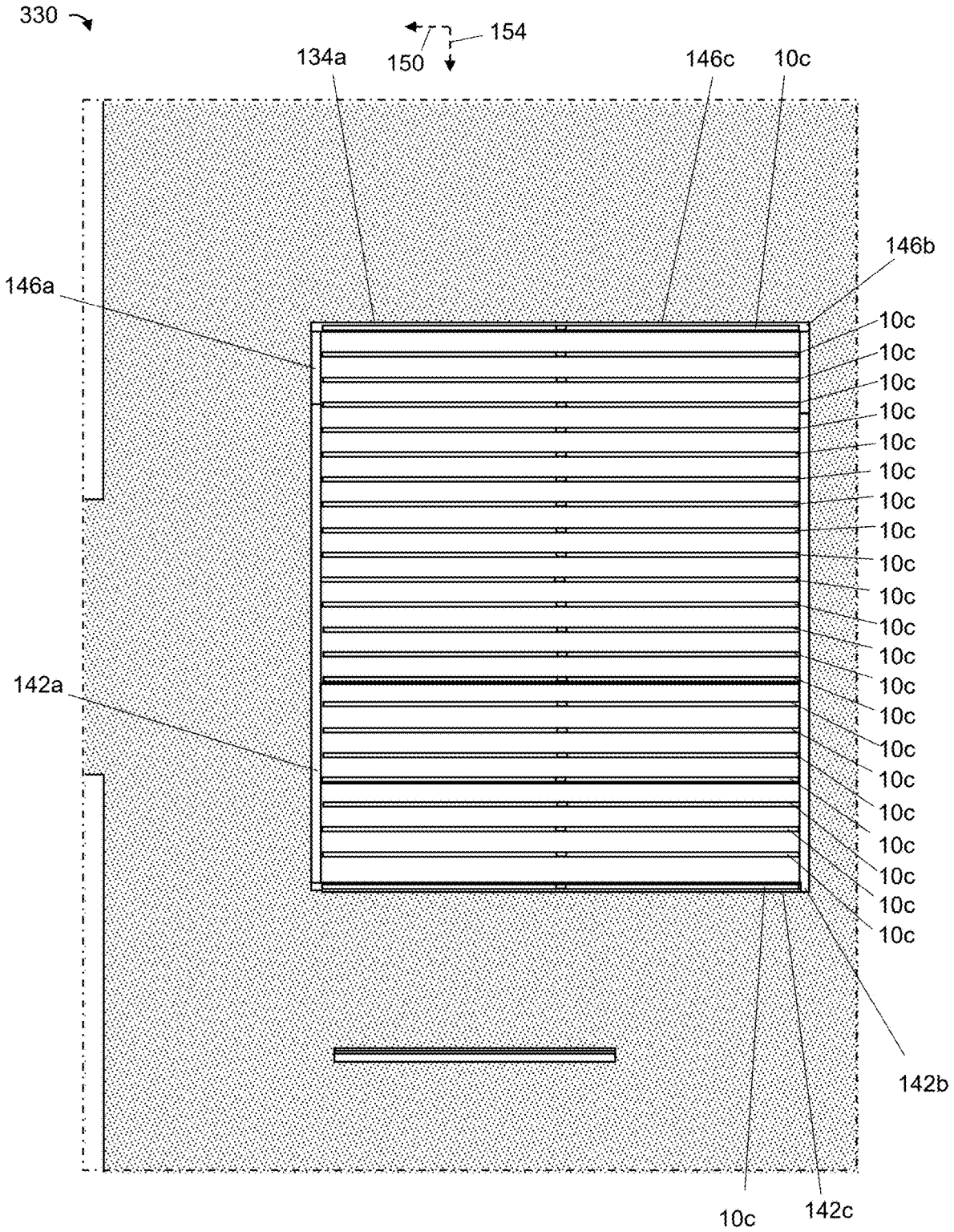
FIGS. 39A and 39B are top and front views, respectively, of the building site of FIG. 32A with a plurality of roof trusses of FIGS. 3A-3C fixed to the walls of the unfolded wall assembly of FIG. 32D while in the collapsed state.
Figure 39B:
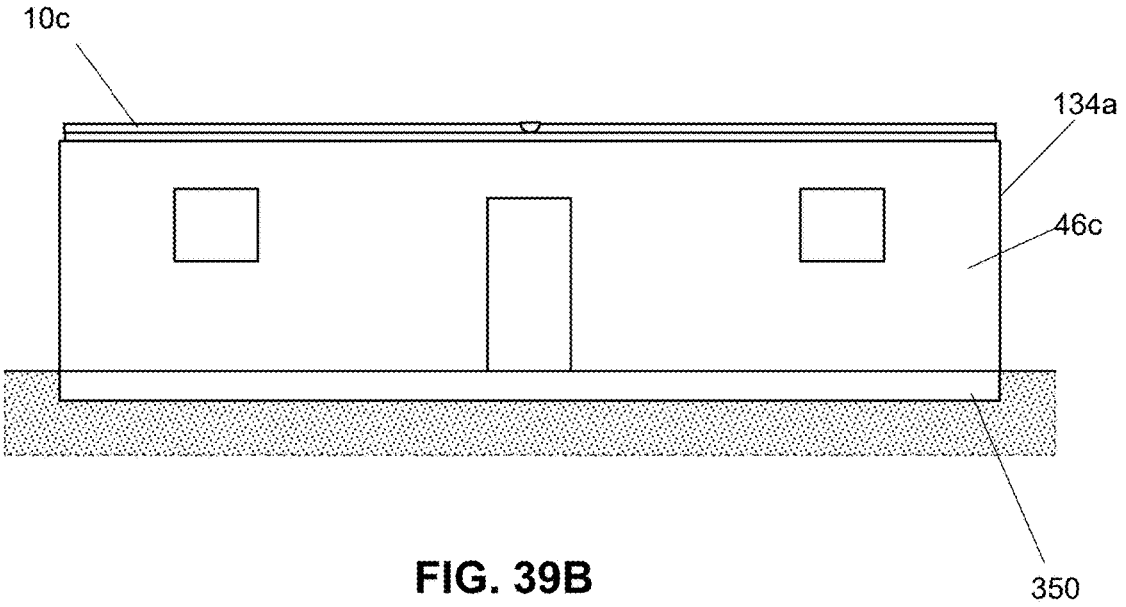
Figure 39C:
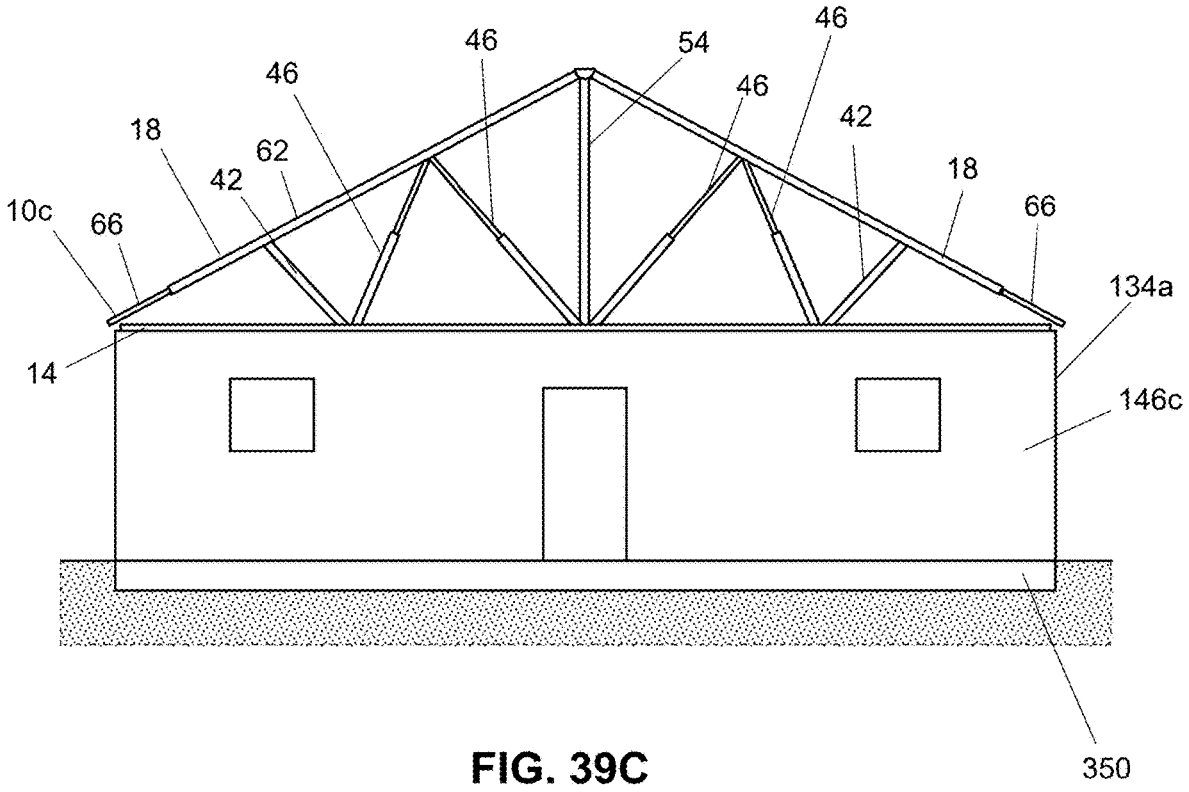
FIG. 39C is a front view of the building site of FIG. 32A where the roof trusses of FIGS. 3A-3C that are fixed to the walls of the unfolded wall assembly of FIG. 32D are in the expanded state.

Referring to FIGS. 39A-39C, for methods in which expandable roof trusses are used, some methods comprise, for each of the roof trusses, at the building site and while the roof truss is fixed to at least one wall, moving the roof truss from the collapsed state (FIGS. 39A and 39B) to the expanded state (FIG. 39C) in any of the manners described above, such as by lifting the second end of each of the upper chords of the roof truss using a crane and/or jack. In the embodiment shown, each of the roof trusses, before being moved to the expanded state, can be disposed on and fixed to at least one of the walls defined by a wall assembly that was moved to the unfolded state. However, in other embodiments, the roof trusses can each be fixed to at least one conventionally-constructed (e.g., stick-built) wall, or can already be fixed to the walls of a deployed building assembly that the roof truss is part of. As shown, the lower chord of each of the roof trusses can extend in the lengthwise direction (e.g., 150) (e.g., between two opposing, widthwise-extending walls that each extend in the widthwise direction (e.g., 154)). When each of the roof trusses is in the expanded state, the lengths of its extendible braces (e.g., 46)—which can each be in the extended state when the roof truss is in the expanded state as explained above—can each be fixed such that the extendible brace is not compressible to the shortened state (e.g., using a pin) to support the upper chords relative to the lower chord, and each of the roof truss's upper chords can be fixed to a respective one of the ends of the lower chord to help maintain the shape of the expanded roof truss. For embodiments in which one or more (e.g., each) of the roof trusses comprise upper chords that are each extendible from a shortened state to an extended state (e.g., roof truss 10*c* or 10*d*), for each of such roof trusses, at the building site each of the upper chords can be extended from the shortened state—that the upper chord was in during transport to the building site—to the extended state and the length of the upper chord can thereafter be fixed such that the upper chord is not compressible to the shortened state. And for embodiments in which one or more (e.g., each) of the roof trusses comprise a lower chord that can be shortened from an extended state to a shortened state (e.g., roof truss 10*e*), for each of such roof trusses, at the building site the lower chord can be shortened from the extended state—that the lower chord was in during transport to the building site—to the shortened state (e.g., to help move the roof truss to the expanded state as explained above) and the length of the lower chord can thereafter be fixed such that the upper chord is not extendible to the extended state.

Figure 40A:
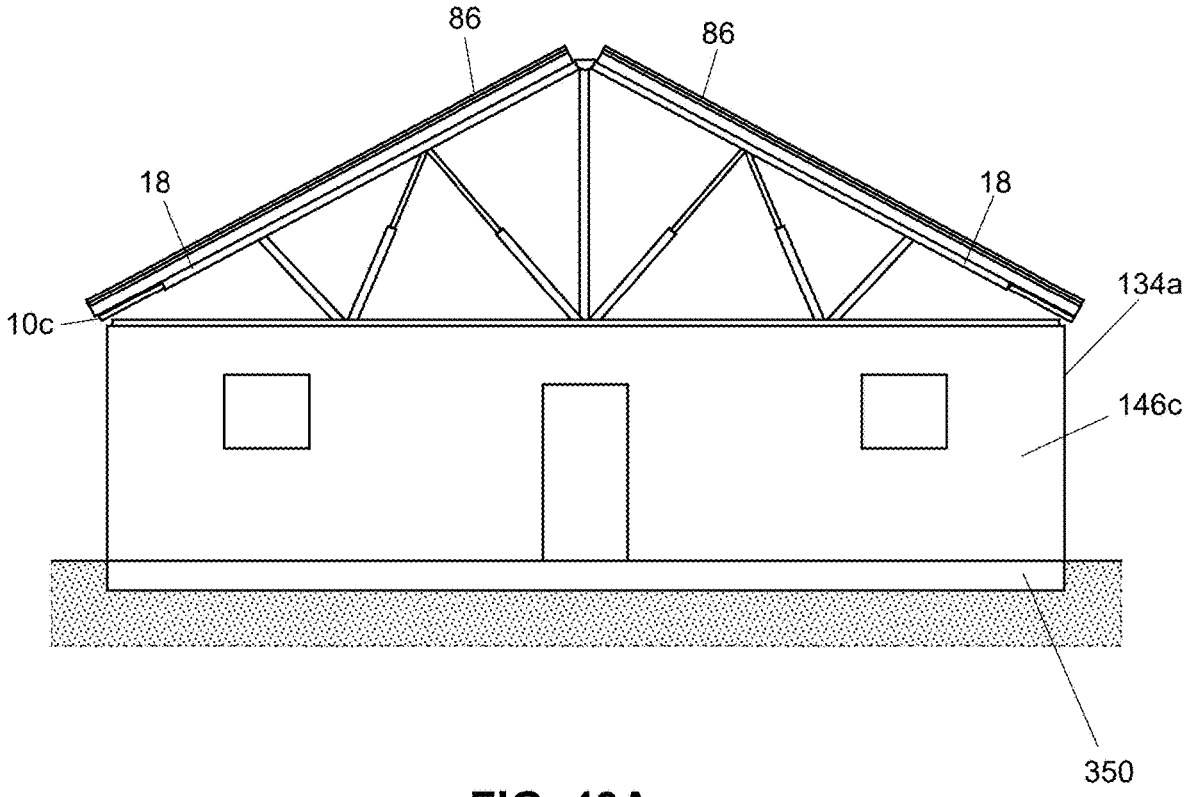
FIGS. 40A and 40B are front and top views, respectively, of the building site of FIG. 32A where the roof trusses of FIGS. 3A-3C that are fixed to the walls of the unfolded wall assembly of FIG. 32D are in the expanded state and roof panels are coupled to and overlie the upper chords of the roof trusses.
Figure 40B:
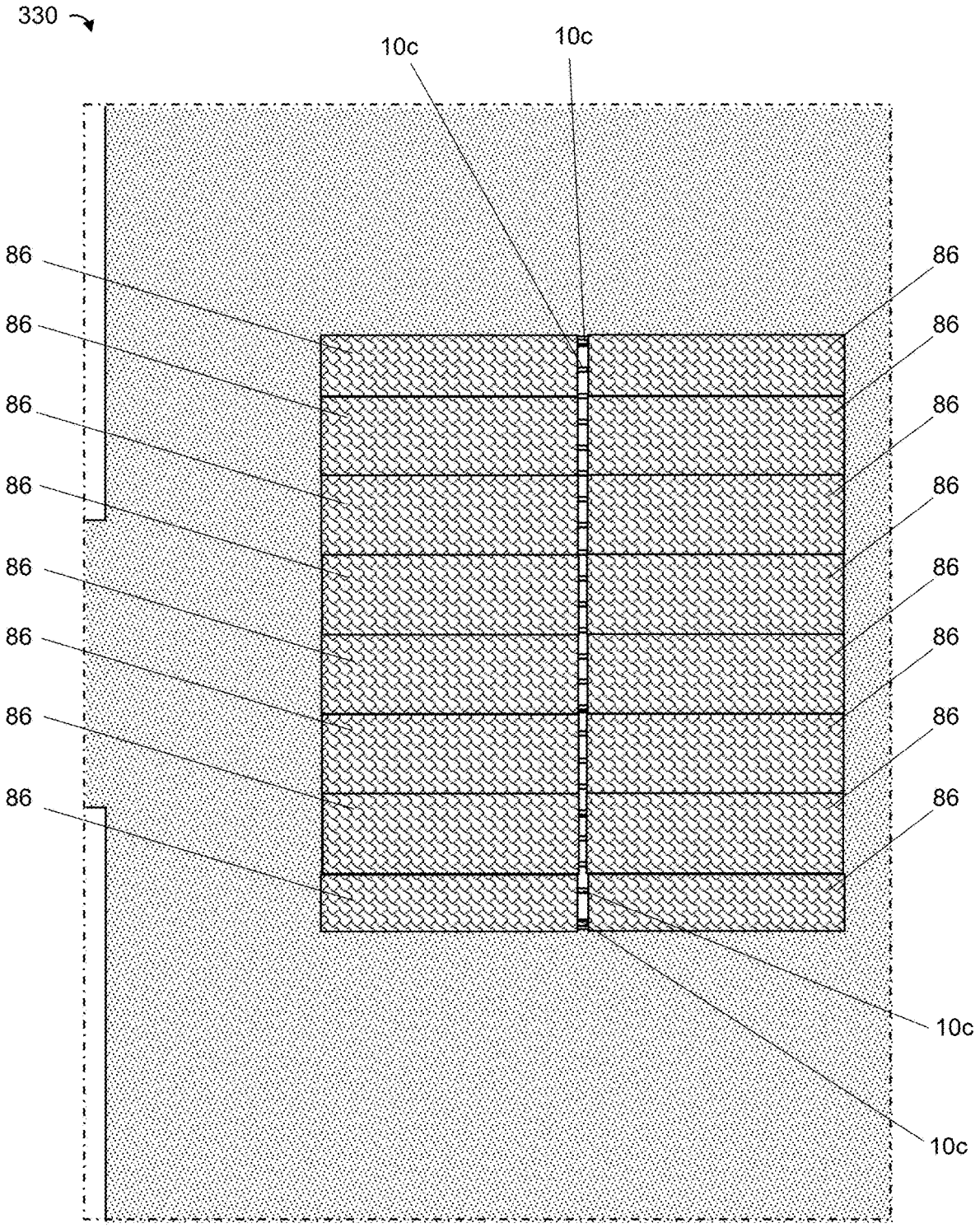

Referring to FIGS. 40A and 40B, after each of the roof trusses is moved to expanded state (and the optional extension of each of its upper chords and/or shortening of its lower chord), a plurality of roof panels can be coupled to the upper chords of the roof trusses such that each of the roof panels overlies, for each of a plurality of the roof trusses, one of the upper chords of the roof truss. The roof panels can overlie an interior space of the building to protect it from the elements, optionally such that the roof panels overlie greater than or equal to any one of, or between any two of, 80%, 85%, 90%, 95%, or 99% (up to and including all) of an area between the walls to which the roof trusses are fixed. In embodiments in which the roof trusses are part of a plurality of roof assemblies that already have roof panels fixed to the upper chords, roof panels need not be coupled to the roof trusses after the roof trusses are moved to the expanded state.

Figure 41:
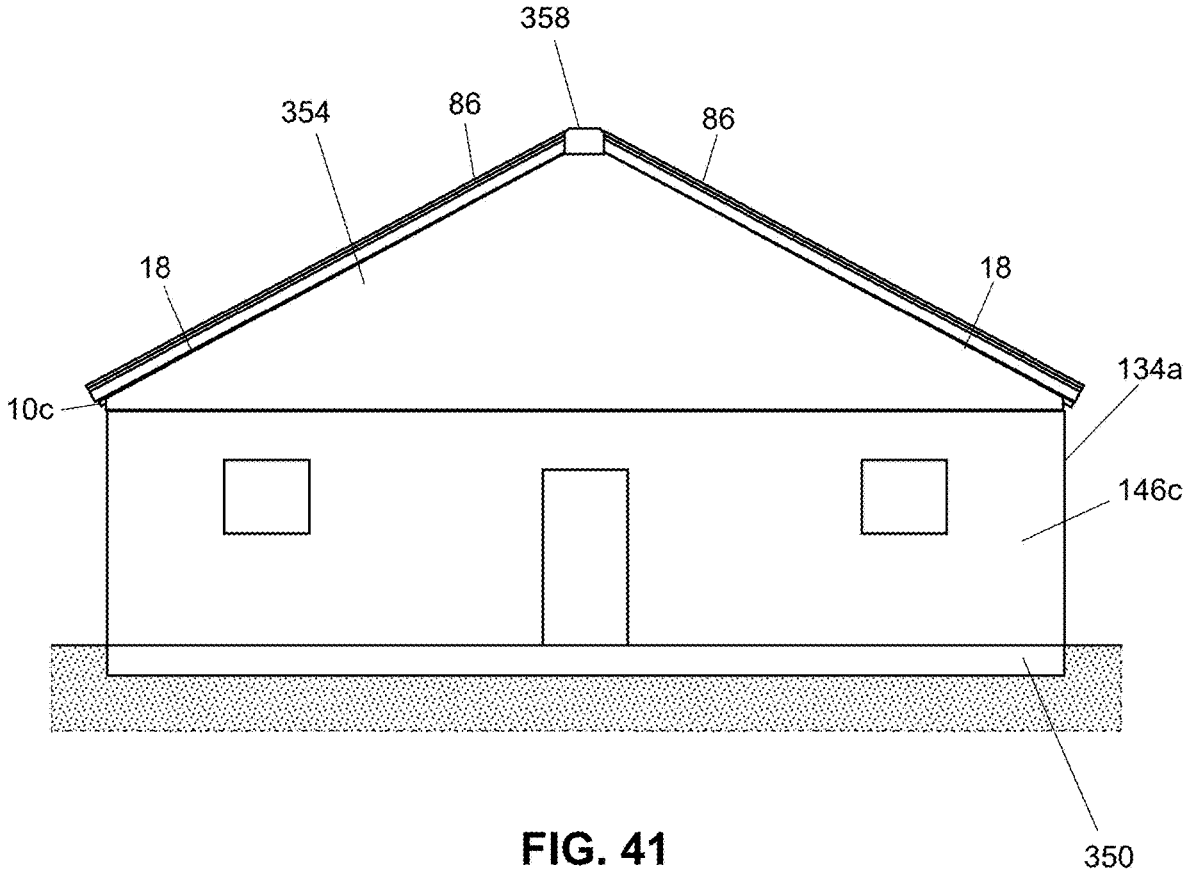
FIG. 41 is a front view of the building site of FIG. 32A with a complete building constructed.

Referring to FIG. 41, after deployment and installation of expandable components at the building site, finishings can be installed to, for example, seal any remaining gaps and complete the building. For example, for embodiments in which construction of the building comprises installation of the expandable trusses as described above, one or more—optionally two or more—gables (e.g., 354) can each be coupled to one of the roof trusses to cover an area disposed between the upper chords and lower chord of the roof truss (e.g., one of the roof trusses that is disposed above one of the opposing lengthwise-extending walls), and a truss cover (e.g., 358) can be coupled to the roof panels and can extend in the widthwise direction to overlie the second ends of the upper chords of the roof trusses and cover a space between first and second sets of the roof panels. As another example, joints at which wall segments or walls were pivoted can be sealed. Such finishings can be completed in a relatively short amount of time, relative to the time needed to construct a building using conventional techniques. Accordingly, use of some of the present expandable building components—including one or more roof trusses, roof assemblies, wall assemblies, and/or building assemblies—can allow the building to be constructed quickly and cost-effectively.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the products, systems, and methods are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A building assembly comprising:

two or more roof trusses that each comprise:

one or more upper chords, the one or more upper chords comprise two upper chords that each have a first end and a second end that is pivotably coupled to the second end of an adjacent one of the upper chords;

a lower chord, wherein the second end of each of the upper chords overlies the lower chord; and a plurality of braces that each extend between and are coupled to one of the upper chords and the lower chord, the plurality of braces include at least one pivotable brace having a first end pivotably coupled to the lower chord and a second end pivotably coupled to one of the upper chords and at least one extendible brace extendible from a shortened state to an extended state;

one or more ceiling panels, wherein a first one of the ceiling panels is fixed to the lower chord of each of the roof trusses of the building assembly; and two or more walls, wherein each of the walls is coupled to at least one of the one or more ceiling panels and is pivotable between:

a stowed position in which the wall is substantially parallel to the first ceiling panel; and a deployed position in which the wall is substantially perpendicular to the first ceiling panel.

2. The building assembly of claim 1, wherein:

the one or more ceiling panels comprise two or more ceiling panels;

the two or more walls comprise four or more walls that include two or more pairs of the walls, wherein for at least one of the pairs of the walls, each of the walls of the pair has:

a first end pivotably coupled to one of the ceiling panels that overlies the wall when the wall is in the stowed position; and a second end slidably coupled to one of the ceiling panels that underlies the wall when the wall is in the stowed position.

3. The building assembly of claim 1, wherein for each of the roof trusses:

the braces include:

two or more pivotable braces that each have the first end pivotably coupled to the lower chord and the second end pivotably coupled to one of the upper chords;

wherein the pivotable braces include at least two extendible braces that are each extendible from the shortened state to the extended state, wherein a length of the extendible brace is longer when in the extended state than when in the shortened state;

each of the upper chords is pivotably coupled to the second end of at least one of the pivotable braces;

the roof truss is movable between a collapsed state in which each of the extendible braces is in the shortened state and an expanded state in which each of the extendible braces is in the extended state;

the second end of each of the upper chords is disposed further from the lower chord when the roof truss is in the expanded state than when the roof truss is in the collapsed state; and each of the pivotable braces pivots relative to the lower chord and relative to the upper chord to which the second end of the pivotable brace is pivotably coupled when the roof truss moves between the collapsed state and the expanded state.

4. The building assembly of claim 1, wherein a length of the building assembly is between 30 and 53 feet when the walls are each in the stowed position.

5. The building assembly of claim 1, wherein a width of the building assembly, measured in a direction perpendicular to the length of the building assembly, is between 7 and 16 feet when the walls are each in the stowed position.

6. The building assembly of claim 1, wherein each of the walls comprises:

a plurality of vertically-extending studs and a plurality of horizontally-extending supports coupled to the studs, wherein the studs and supports each comprise steel;

one or more drywall panels coupled to a first side of the studs; and exterior siding coupled to a second side of the studs.

7. The building assembly of claim 1, wherein:

the one or more ceiling panels comprise two or more ceiling panels that include at least one slidable ceiling panel; and when the walls are each in the deployed position, each of the slidable ceiling panel(s) is configured to slide vertically along two of the walls between which the slidable ceiling panel extends.

8. The building assembly of claim 7, wherein:

the at least one slidable ceiling panel includes two or more slidable ceiling panels; and each of the walls has a length that is approximately the same as a length of the building assembly when the walls are each in the stowed position.

9. The building assembly of claim 7, wherein:

each of the walls overlies the roof trusses and the ceiling panels when the wall is in the stowed position; and when the walls are each in the deployed position, each of the roof trusses is configured to slide vertically along two of the walls between which the roof truss extends.

10. A method of constructing a building at a building site, the method comprising:

transporting, over one or more roads, one or more building assemblies to the building site, wherein each of the one or more building assemblies comprises:

two or more roof trusses that each comprise:

one or more upper chords, the one or more upper chords comprise two upper chords that each have a first end and a second end that is pivotably coupled to the second end of an adjacent one of the upper chords;

a lower chord, wherein the second end of each of the upper chords overlies the lower chord; and a plurality of braces that each extend between and are coupled to one of the upper chords and the lower chord, the plurality of braces include at least one pivotable brace having a first end pivotably coupled to the lower chord and a second end pivotably coupled to one of the upper chords and at least one extendible brace extendible from a shortened state to an extended state;

one or more ceiling panels, wherein a first one of the ceiling panels is fixed to the lower chord of each of the roof trusses of the building assembly; and two or more walls, wherein each of the walls is coupled to at least one of the one or more ceiling panels and is pivotable between:

a stowed position in which the wall is substantially parallel to the first ceiling panel; and a deployed position in which the wall is substantially perpendicular to the first ceiling panel;

wherein the building assembly is transported to the building site while each of the walls of the building assembly is in the stowed position; and for each of the one or more building assemblies, pivoting each of the walls of the building assembly from the stowed position to the deployed position at the building site.

11. The method of claim 10, wherein for each of the one or more building assemblies:

the one or more ceiling panels comprise two or more ceiling panels;

the two or more walls comprise four or more walls that include two or more pairs of the walls, wherein for at least one of the pairs of the walls, each of the walls of the pair has:

a first end pivotably coupled to one of the ceiling panels that overlies the wall when the wall is in the stowed position; and a second end slidably coupled to one of the ceiling panels that underlies the wall when the wall is in the stowed position;

wherein pivoting the wall comprises lifting the ceiling panel that overlies the wall when the wall is in the stowed position such that the second end of the wall slides along the ceiling panel that underlies the wall when the wall is in the stowed position.

12. The method of claim 10, wherein for each of the one or more building assemblies:

for each of the roof trusses of the building assembly:

the braces include:

two or more pivotable braces that each have the first end pivotably coupled to the lower chord and the second end pivotably coupled to one of the upper chords;

wherein the pivotable braces include at least two extendible braces that are each extendible from the shortened state to the extended state, wherein a length of the extendible brace is longer when in the extended state than when in the shortened state;

each of the upper chords is pivotably coupled to the second end of at least one of the pivotable braces;

the roof truss is movable between a collapsed state in which each of the extendible braces is in the shortened state and an expanded state in which each of the extendible braces is in the extended state;

the second end of each of the upper chords is disposed further from the lower chord when the roof truss is in the expanded state than when the roof truss is in the collapsed state; and each of the pivotable braces pivots relative to the lower chord and relative to the upper chord to which the second end of the pivotable brace is pivotably coupled when the roof truss moves between the collapsed state and the expanded state; and the method comprises, for each of the roof trusses of the building assembly, at the building site and after pivoting each of the walls of the building assembly:

moving the roof truss from the collapsed state to the expanded state such that:

the second end of each of the upper chords moves upwardly away from the lower chord; and each of the pivotable braces pivots relative to the lower chord and relative to the upper chord to which the second end of the pivotable brace is pivotably coupled; and fixing the length of each of the extendible braces when the roof truss is in the expanded state such that the extendible brace is not compressible to the shortened state.

13. The method of claim 10, wherein for each of the one or more building assemblies, a length of the building assembly is between 30 and 53 feet when the walls are each in the stowed position.

14. The method of claim 10, wherein for each of the one or more building assemblies, a width of the building assembly, measured in a direction perpendicular to the length of the building assembly, is between 7 and 16 feet when the walls are each in the stowed position.

15. The method of claim 10, wherein for each of the one or more building assemblies, each of the walls comprises:

a plurality of vertically-extending studs and a plurality of horizontally-extending supports coupled to the studs, wherein the studs and supports each comprise steel;

one or more drywall panels coupled to a first side of the studs; and exterior siding coupled to a second side of the studs.

16. The method of claim 10, wherein:

the building site includes a slab; and the method comprises, for each of the one or more building assemblies, fixing at least two of the walls of the building assembly to the slab.

17. The method of claim 16, wherein the slab comprises concrete.

18. The method of claim 10, wherein for each of the one or more building assemblies:

the one or more ceiling panels comprise two or more ceiling panels that include at least one slidable ceiling panel; and the method comprises, after pivoting each of the walls of the building assembly from the stowed position to the deployed position:

sliding each of the slidable ceiling panel(s) vertically along two of the walls; and after sliding each of the slidable ceiling panel(s), fixing the slidable ceiling panel(s) relative to the walls.

19. The method of claim 18, wherein for each of the one or more building assemblies:

the at least one slidable ceiling panel includes two or more slidable ceiling panels; and each of the walls has a length that is approximately the same as a length of the building assembly when the walls are each in the stowed position.

20. The method of claim 18, wherein for each of the one or more building assemblies:

each of the walls overlies the roof trusses and the ceiling panels when the wall is in the stowed position; and sliding each of the slidable ceiling panel(s) comprises lifting each of the slidable ceiling panel(s); and the method comprises:

sliding each of the roof trusses upwardly along two of the walls between which the roof truss extends; and after sliding each of the roof trusses, fixing the roof trusses relative to the walls.

* * * * *